US008978555B2

(12) United States Patent
Kurokawa et al.

(10) Patent No.: US 8,978,555 B2
(45) Date of Patent: Mar. 17, 2015

(54) LITHOGRAPHIC PRINTING PLATE SUPPORT AND PRESENSITIZED PLATE

(75) Inventors: Shinya Kurokawa, Haibara-gun (JP); Yuya Miyagawa, Haibara-gun (JP); Yoshiharu Tagawa, Haibara-gun (JP); Atsuo Nishino, Haibara-gun (JP); Hirokazu Sawada, Haibara-gun (JP)

(73) Assignee: FUJIFILM Corporation, Tokyo (JP)

( * ) Notice: Subject to any disclaimer, the term of this patent is extended or adjusted under 35 U.S.C. 154(b) by 651 days.

(21) Appl. No.: 13/361,700

(22) Filed: Jan. 30, 2012

(65) Prior Publication Data

US 2012/0192742 A1 Aug. 2, 2012

(30) Foreign Application Priority Data

Jan. 31, 2011 (JP) ..... 2011-017945
Feb. 28, 2011 (JP) ..... 2011-042604

(51) Int. Cl.

| | |
|---|---|
| ***B41N 1/00*** | (2006.01) |
| ***B41N 3/03*** | (2006.01) |
| ***C25D 11/12*** | (2006.01) |
| ***C25D 11/16*** | (2006.01) |
| ***C25D 11/24*** | (2006.01) |

(52) U.S. Cl.

CPC ..... *B41N 3/034* (2013.01); *C25D 11/12* (2013.01); *C25D 11/16* (2013.01); *C25D 11/24* (2013.01)

USPC ..... 101/459; 101/463.1

(58) Field of Classification Search

CPC ..... B41N 1/083; B41N 3/034

USPC ..... 101/459

See application file for complete search history.

(56) References Cited

U.S. PATENT DOCUMENTS

2006/0210926 A1* 9/2006 Sawada et al. ..... 430/302
2007/0235342 A1* 10/2007 Matsuo et al. ..... 205/175

FOREIGN PATENT DOCUMENTS

JP 11-291657 A 10/1999

OTHER PUBLICATIONS

The First Office Action, dated Oct. 10, 2014, issued in corresponding CN Application No. 201210026895.7, 9 pages in English and Chinese.

* cited by examiner

*Primary Examiner* — Allen Parker
*Assistant Examiner* — Michael Robinson
(74) *Attorney, Agent, or Firm* — Sughrue Mion, PLLC

(57) ABSTRACT

A lithographic printing plate support includes an aluminum plate and an anodized film formed at a surface of the aluminum plate and having micropores which extend in a depth direction of the anodized aluminum film from a surface of the anodized film opposite from the aluminum plate. Each of the micropores includes a large-diameter portion and a dendritic small-diameter portion. The lithographic printing plate support has excellent scratch resistance and is capable of obtaining a presensitized plate which exhibits excellent on-press developability and enables a lithographic printing plate formed therefrom to have a long press life and excellent deinking ability after suspended printing.

20 Claims, 7 Drawing Sheets

LITHOGRAPHIC PRINTING PLATE SUPPORT AND PRESENSITIZED PLATE

TECHNICAL FIELD

The present invention relates to a lithographic printing plate support and a presensitized plate obtained using the support.

Lithographic printing is a printing process that makes use of the inherent immiscibility of water and oil. Lithographic printing plates used in lithographic printing have formed on a surface thereof regions which are receptive to water and repel oil-based inks (referred to below as "non-image areas") and regions which repel water and are receptive to oil-based inks (referred to below as "image areas").

The aluminum support employed in a lithographic printing plate (referred to below simply as a "lithographic printing plate support") is used in such a way as to carry non-image areas on its surface. It must therefore have a number of conflicting properties, including, on the one hand, an excellent hydrophilicity and water retention and, on the other hand, an excellent adhesion to the image recording layer that is provided thereon. If the hydrophilicity of the support is too low, ink is likely to be attached to the non-image areas at the time of printing, causing a blanket cylinder to be scummed and thereby causing so-called scumming to be generated. In addition, if the water retention of the support is too low, clogging in the shadow area is generated unless the amount of fountain solution is increased at the time of printing. Thus, a so-called water allowance is narrowed.

Various studies have been made to obtain lithographic printing plate supports exhibiting good properties. For example, JP 11-291657 A discloses a method of manufacturing a lithographic printing plate support which includes a first step for anodizing a roughened aluminum plate surface and a second step for reanodizing under such conditions that the diameter of micropores may be smaller than that in the anodized film formed in the first step. It is described that the lithographic printing plate obtained using the lithographic printing plate support does not deteriorate the deinking ability in continued printing, improves the adhesion to the photosensitive layer, does not cause highlight areas to be blown out, and has a long press life.

On the other hand, printing may be suspended. In such a case, the lithographic printing plate is left to stand on the plate cylinder and its non-image areas may be scummed under the influence of the contamination in the atmosphere. Therefore, when the printing having been suspended is resumed, a number of sheets must be printed until normal printing can be made, thus causing wasted use of printing paper or other defect. It is known that these defects prominently occur in the lithographic printing plates having undergone electrochemical graining treatment in an acidic solution containing hydrochloric acid. In the following description, the number of sheets wasted when the printing having been suspended is resumed is used to evaluate the deinking ability after suspended printing and the deinking ability after suspended printing is rated "good" when the number of wasted sheets is small.

In addition, a large number of researches have been made on computer-to-plate (CTP) systems which are under remarkable progress in recent years. In particular, a presensitized plate which can be mounted for printing on a printing press without being developed after exposure to light has been required to solve the problem of wastewater treatment while further rationalizing the process.

One of the methods for eliminating a treatment step is a method called "on-press development" in which an exposed presensitized plate is mounted on a plate cylinder of a printing press and fountain solution and ink are supplied as the plate cylinder is rotated to thereby remove non-image areas of the presensitized plate. In other words, this is a system in which the exposed presensitized plate is mounted on the printing press without any further treatment so that development completes in the usual printing process. The presensitized plate suitable for use in such on-press development is required to have an image recording layer which is soluble in fountain solution or an ink solvent and to have a light-room handling property suitable to the development on a printing press placed in a light room. In the following description, the number of sheets of printed paper required to reach the state in which no ink is transferred to non-image areas after the completion of the on-press development of the unexposed areas is used to evaluate the on-press developability, which is rated "good" when the number of wasted sheets is small.

The resistance to dotted scumming is another feature required in the presensitized plate. In cases where the presensitized plate was stored for a long period of time, ink was prone to adhere to part of the non-image area surface, causing dot- or ring-shaped stains (hereinafter also referred to as "dotted scumming") on printed paper and it has been desired to improve this defect.

SUMMARY OF THE INVENTION

The inventors of the invention have made an intensive study on various properties of the lithographic printing plate and the presensitized plate obtained using the lithographic printing plate support specifically described in JP 11-291657 A and found that the press life has a trade-off relation with the deinking ability after suspended printing or the on-press developability and these properties cannot be simultaneously achieved, which is not necessarily satisfactory in practical use. In addition, it has been found that the scratch resistance of the lithographic printing plate support is also to be improved.

It has been found that dotted scumming very often occurs in the lithographic printing plate obtained using the lithographic printing plate support specifically described in JP 11-291657 A and a further improvement is necessary.

In addition, a photopolymer type image recording layer was formed on the lithographic printing plate support to prepare a presensitized plate and its performance was studied. It has been found that perfect-circle-shaped image spots (also referred to as "white spots") may occur when printing is performed using the lithographic printing plate obtained by exposing and developing the presensitized plate which was stored for a long period of time.

In view of the situation as described above, an object of a first aspect of the invention is to provide a lithographic, printing plate support that has excellent scratch resistance and is capable of obtaining a presensitized plate which exhibits excellent on-press developability and enables a lithographic printing plate formed therefrom to have a long press life and excellent deinking ability after suspended printing. Another object of the first aspect of the invention is to provide the presensitized plate obtained using the support.

In view of the situation as described above, an object of a second aspect of the invention is to provide a lithographic printing plate support that has excellent scratch resistance and is capable of obtaining a presensitized plate which exhibits excellent on-press developability and enables a lithographic printing plate formed therefrom to have a long press life, and excellent deinking ability after suspended printing and excellent resistance to dotted scumming while suppressing the occurrence of white spots. Another object of the second aspect of the invention is to provide the presensitized plate obtained using the support.

The inventors of the invention have made an intensive study to achieve the objects in the first aspect and as a result found that the foregoing problems can be solved by controlling the shape of micropores in the anodized film.

The inventors of the invention have also made an intensive study to achieve the objects in the second aspect and as a result found that the foregoing problems can be solved by controlling the shape of micropores in the anodized film and the thickness of the anodized film between the bottoms of the micropores and the aluminum plate.

Specifically, the invention provides the following (1) to (11).

(1) A lithographic printing plate support comprising: an aluminum plate; and an anodized film formed at a surface of the aluminum plate and having micropores which extend in a depth direction of the anodized film from a surface of the anodized film opposite from the aluminum plate, wherein each of the micropores has a large-diameter portion which extends to a depth A of 5 to 60 nm from the surface of the anodized film and a dendritic small-diameter portion which communicates with a bottom of the large-diameter portion, and branches off and extends to a depth of 900 to 2,000 nm from a communication position between the small-diameter portion and the large-diameter portion, wherein an aperture average diameter of the large-diameter portion at the surface of the anodized film is from 10 to 100 nm and a ratio of the depth A of the large-sized portion to the aperture average diameter of the large-diameter portion (depth A/aperture average diameter) is from 0.1 to 4.0, wherein a communication position average diameter of the small-diameter portion at the communication position is more than 0 but less than 20 nm, and wherein a ratio of the communication position average diameter of the small-diameter portion to the aperture average diameter of the large-diameter portion (communication position average diameter/aperture average diameter) is up to 0.85.

(2) The lithographic printing plate support according to (1), wherein a thickness of the anodized film between a bottom of the small-diameter portion and the surface of the aluminum plate is at least 20 nm.

(3) The lithographic printing plate support according to (1) or (2), wherein a small-diameter portion density A in a cross section of the anodized film at the communication position is 100 to 3,000 pcs/$\mu m^2$ pcs is defined to be an abbreviation for pieces.

(4) The lithographic printing plate support according to any one of (1) to (3), wherein a small-diameter portion density B in a cross section of the anodized film at a central position in the depth direction of the small-diameter portion is larger than the small-diameter portion density A in the cross section of the anodized film at the communication position, and the density B is 300 to 9,000 pcs/$\mu m^2$.

(5) A presensitized plate comprising: the lithographic printing plate support according to any one of (1) to (4); and an image recording layer formed thereon.

(6) A lithographic printing plate support comprising: an aluminum plate; and an anodized film formed at a surface of the aluminum plate and having micropores which extend in a depth direction of the anodized film from a surface of the anodized film opposite from the aluminum plate.

wherein each of the micropores has a large-diameter portion which extends to a depth A of 5 to 60 nm from the surface of the anodized film and a small-diameter portion which communicates with a bottom of the large-diameter portion and extends to a depth of 900 to 2,000 nm from a communication position between the small-diameter portion and the large-diameter portion, wherein an aperture average diameter of the large-diameter portion at the surface of the anodized film is from 10 to 60 nm and a ratio of the depth A to the aperture average diameter (depth A/aperture average diameter) is from 0.1 to 4.0, wherein a communication position average diameter of the small-diameter portion at the communication position is more than 0 but less than 20 nm, wherein a ratio of the communication position average diameter of the small-diameter portion to the aperture average diameter of the large-diameter portion (communication position average diameter/aperture average diameter) is up to 0.85, and wherein a thickness of the anodized film between a bottom of the small-diameter portion and the surface of the aluminum plate is at least 25 nm.

(7) The lithographic printing plate support according to (6), wherein the aperture average diameter of the large-diameter portion is from 10 to 50 nm.

(8) The lithographic printing plate support according to (6) or (7), wherein the depth A is from 10 to 50 nm.

(9) The lithographic printing plate support according to any one of (6) to (8), wherein the ratio of the depth A to the aperture average diameter is at least 0.30 but less than 3.0.

(10) The lithographic printing plate support according to any one of (6) to (9), wherein the micropores are formed at a density of 100 to 3,000 pcs/$\mu m^2$.

(11) A presensitized plate comprising: the lithographic printing plate support according to any one of (6) to (10); and an image recording layer formed thereon.

The first aspect of the invention can provide a lithographic printing plate support that has excellent scratch resistance and is capable of obtaining a presensitized plate which exhibits excellent on-press developability and enables a lithographic printing plate formed therefrom to have a long press life and excellent deinking ability after suspended printing, as well as the presensitized plate obtained using the support.

The second aspect of the invention can provide a lithographic printing plate support that has excellent scratch resistance and is capable of obtaining a presensitized plate which exhibits excellent on-press developability and enables a lithographic printing plate formed therefrom to have a long press life, and excellent deinking ability after suspended printing and excellent resistance to dotted scumming while suppressing the occurrence of white spots as well as the presensitized plate obtained using the support.

DETAILED DESCRIPTION OF THE INVENTION

The lithographic printing plate supports according to the first and second aspects of the invention and their manufacturing methods are described below.

[First Aspect]

The lithographic printing plate support according to the first aspect of the invention includes an aluminum plate and an anodized film formed thereon, each of micropores in the anodized film being of such a shape that a large-diameter portion having a larger average diameter communicates with a dendritic small-diameter portion having a smaller average diameter along the depth direction (i.e., the thickness direction of the film). Particularly in the invention, although the press life has been deemed to have a trade-off relation with the deinking ability after suspended printing or the on-press developability, these properties can be simultaneously achieved at a higher level by controlling the depth of the large-diameter portions having a larger average diameter in the micropores and forming the dendritic small-diameter portions.

Figure 1:
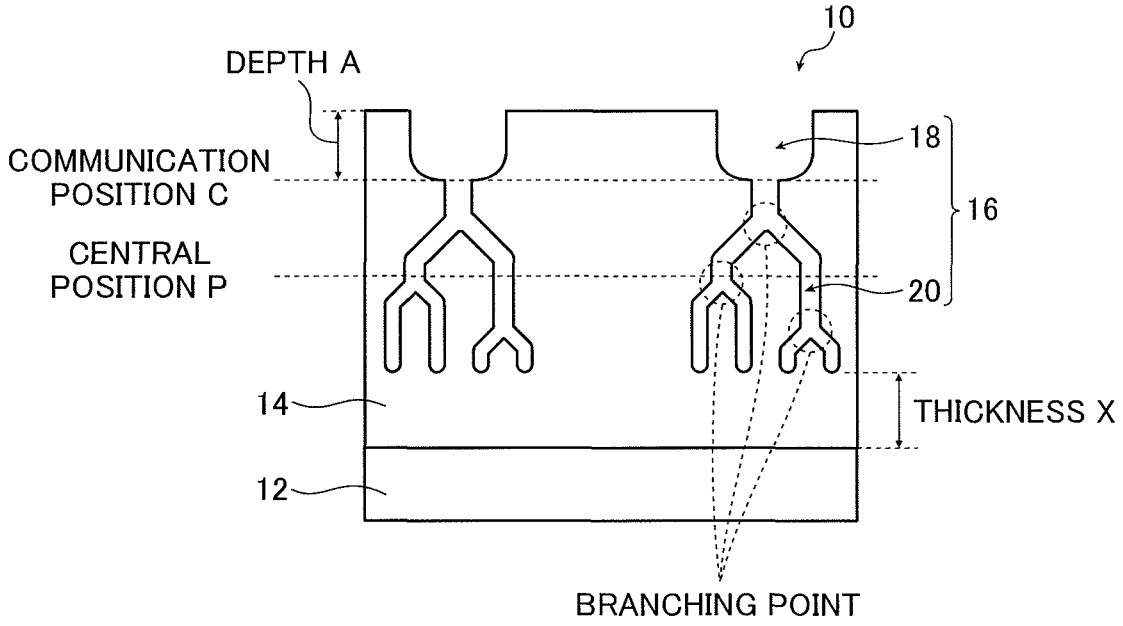
FIG. 1 is a schematic cross-sectional view showing an embodiment of a lithographic printing plate support according to the first aspect of the invention.

FIG. 1 is a schematic cross-sectional view showing an embodiment of the lithographic printing plate support according to the first aspect of the invention.

A lithographic printing plate support 10 shown in FIG. 1 is of a laminated structure in which an aluminum plate 12 and an anodized aluminum film 14 are stacked in this order. The anodized film 14 has micropores 16 extending from its surface toward the aluminum plate 12 side, and each micropore 16 has a large-diameter portion 18 and a dendritic small-diameter portion 20. The term "micropore" is commonly used to denote a pore in the anodized film and does not define the size of the pore.

The aluminum plate 12 and the anodized film 14 are first described in detail.

[Aluminum Plate]

The aluminum plate 12 (aluminum support) used in the invention is made of a dimensionally stable metal composed primarily of aluminum; that is, aluminum or aluminum alloy. The aluminum plate is selected from among plates of pure aluminum, alloy plates composed primarily of aluminum and containing small amounts of other elements, and plastic films or paper on which aluminum (alloy) is laminated or vapor-deposited. In addition, a composite sheet as described in JP 48-18327 A in which an aluminum sheet is attached to a polyethylene terephthalate film may be used.

In the following description, the above-described plates made of aluminum or aluminum alloys are referred to collectively as "aluminum plate 12." Other elements which may be present in the aluminum alloy include silicon, iron, manganese, copper, magnesium, chromium, zinc, bismuth, nickel and titanium. The content of other elements in the alloy is not more than 10 wt %. In the invention, the aluminum plate used is preferably made of pure aluminum but may contain small amounts of other elements because it is difficult to manufacture completely pure aluminum from the viewpoint of smelting technology. The aluminum plate 12 which is applied to the invention as described above is not specified for its composition but conventionally known materials such as JIS A1050, JIS A1100, JIS A3103 and JIS A3005 materials can be appropriately used.

The aluminum plate 12 used in the invention is treated as it continuously travels usually in a web form, and has a width of about 400 mm to about 2,000 mm and a thickness of about 0.1 mm to about 0.6 mm. The width and thickness may be changed as appropriate based on such considerations as the size of the printing press, the size of the printing plate and the desires of the user.

The aluminum plate is appropriately subjected to substrate surface treatments to be described later.

[Anodized Film]

The anodized film 14 refers to an anodized aluminum film that is generally formed at a surface of the aluminum plate 12 by anodizing treatment and has the micropores 16 which are substantially vertical to the film surface and are individually distributed in a uniform manner. The micropores 16 extend along the thickness direction of the anodized film 14 from the surface of the anodized film opposite to the aluminum plate 12 toward the aluminum plate 12 side.

Each micropore 16 in the anodized film 14 has the large-diameter portion 18 which extends to a depth of 5 to 60 nm from the anodized film surface (depth A: see FIG. 1), and the dendritic small-diameter portion 20 which communicates with the bottom of the large-diameter portion 18, and branches off and further extends to a depth of 900 to 2,000 nm from the communication position (communication position C: see FIG. 1).

The large-diameter portion 18 and the small-diameter portion 20 are described below in detail.

(Large-Diameter Portion)

The large-diameter portions 18 have an average diameter (average aperture size) of 10 to 100 nm at the surface of the anodized film. At an average diameter within the foregoing range, the lithographic printing plate obtained using the lithographic printing plate support has a long press life and excellent deinking ability after suspended printing, and the presensitized plate obtained using the support has excellent on-press developability. In terms of longer press life of the lithographic printing plate obtained using the lithographic printing plate support, the average diameter is preferably from 10 to 50 nm, more preferably from 15 to 50 nm and even more preferably from 20 to 50 nm.

At an average diameter of less than 10 nm, a sufficient anchor effect is not obtained, nor is the press life of the lithographic printing plate improved. At an average diameter in excess of 100 nm, the roughened surface is damaged whereby the properties such as press life and deinking ability after suspended printing cannot be improved.

The average diameter of the large-diameter portions 18 is determined as follows: The surface of the anodized film 14 is taken by FE-SEM at a magnification of 150,000× to obtain four images, and in the resulting four images, the diameter of the micropores (large-diameter portions) within an area of 400×600 $nm^2$ is measured and the average of the measurements is calculated.

The equivalent circle diameter is used if the aperture of the large-diameter portion 18 is not circular. The "equivalent circle diameter" refers to a diameter of a circle assuming that the shape of an aperture is the circle having the same projected area as that of the aperture.

The bottom of each large-diameter portion 18 is at a depth of 5 to 60 nm from the surface of the anodized film (hereinafter this depth is also referred to as "depth A"). In other words, each large-diameter portion 18 is a pore portion which extends from the surface of the anodized film in the depth direction (thickness direction of the anodized film) to a depth of 5 to 60 nm. The depth is preferably from 10 nm to 50 nm from the viewpoint that the lithographic printing plate obtained using the lithographic printing plate support has a longer press life and more excellent deinking ability after suspended printing and the presensitized plate obtained using the support has more excellent on-press developability.

At a depth of less than 5 nm, a sufficient anchor effect is not obtained, nor is the press life of the lithographic printing plate improved. At a depth in excess of 60 nm, the lithographic printing plate has poor deinking ability after suspended printing and the presensitized plate has poor on-press developability.

The depth is determined by taking a cross-sectional image of the anodized film 14 at a magnification of 150,000×, measuring the depth of at least 25 large-diameter portions, and calculating the average of the measurements.

The ratio of the depth A of the large-sized portions 18 to the average diameter of the large-sized portions 18 at the surface of the anodized film (large-sized portion diameter) (depth A/large-sized portion diameter) is from 0.1 to 4.0. The ratio of the depth A to the large-sized portion diameter is preferably at least 0.3 but less than 3.0, and more preferably at least 0.3 but less than 2.5 from the viewpoint that the lithographic printing plate obtained using the lithographic printing plate support has a longer press life and more excellent deinking ability after suspended printing and that the presensitized plate obtained using the support has more excellent on-press developability.

At a ratio of the depth A to the large-sized portion diameter of less than 0.1, the press life of the lithographic printing plate is not improved. At a ratio of the depth A to the large-sized portion diameter in excess of 4.0, the lithographic printing plate has poor deinking ability after suspended printing and the presensitized plate has poor on-press developability.

The shape of the large-diameter portions 18 is not particularly limited. Exemplary shapes include a substantially straight tubular shape (substantially columnar shape), an inverted cone shape (tapered shape) in which the diameter decreases from the surface of the anodized film toward the aluminum plate 12 and a substantially conical shape (inversely tapered shape) in which the diameter increases from the surface of the anodized film toward the aluminum plate 12. The large-diameter portions 18 are preferably in a substantially straight tubular shape or an inversely tapered shape.

When the large-diameter portions 18 are in a substantially straight tubular shape, the large-diameter portions 18 may have a difference of about 1 nm to about 5 nm between the internal diameter and the aperture diameter at the surface of the anodized film 16.

Figure 2:
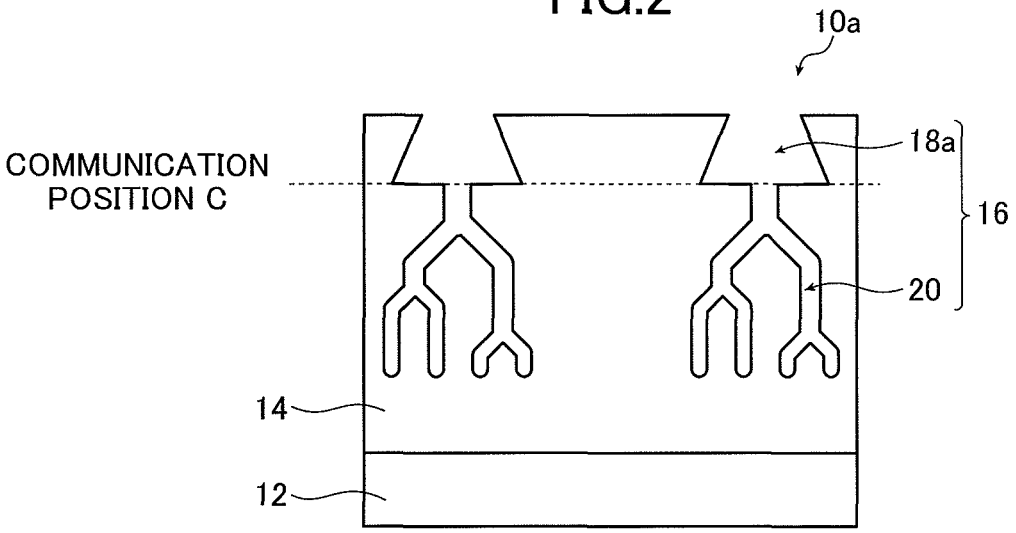
FIG. 2 is a schematic cross-sectional view showing another embodiment of the lithographic printing plate support according to the first aspect of the invention.

The case in which the large-diameter portion is in a substantially conical shape (inversely tapered shape) in which the diameter increases from the surface of the anodized film toward the aluminum plate 12 is shown in FIG. 2.

The diameter (internal diameter) of large-diameter portions 18*a* in a lithographic printing plate support 10*a* gradually increases from the surface of the anodized film toward the aluminum plate side. The shape of the large-diameter portions 18*a* is not particularly limited as long as the diameter condition is met and a substantially conical shape and a substantially bell shape are preferred. The large-diameter portions 18*a* having the foregoing structure enable the resulting lithographic printing plate to have excellent properties in terms of press life, and deinking ability in continued printing and after suspended printing.

The difference between the average diameter of the large-diameter portions 18*a* at the surface of the anodized film (surface layer average diameter) and the average diameter of the large-diameter portions 18*a* at the communication position C with the small-diameter portions 20 (bottom average diameter) is preferably at least 1 nm. At a difference within the foregoing range, the resulting lithographic printing plate has excellent properties in terms of press life, and deinking ability in continued printing and after suspended printing. In particular, the difference is preferably at least 1 nm and more preferably 10 to 30 nm because the press life is more excellent.

The bottom shape of the large-diameter portions 18 is not particularly limited and may be curved (convex) or flat.

(Small-Diameter Portion)

As shown in FIG. 1, each of the small-diameter portions 20 is a dendritic pore portion which communicates with the bottom of the corresponding large-diameter portion 18, and branches off and further extends from the communication position C in the depth direction (i.e., in the thickness direction). One small-diameter portion 20 usually communicates with one large-diameter portion 18 but two or more small-diameter portions 20 may communicate with the bottom of one large-diameter portion 18.

The small-diameter portions 20 have an average diameter at the communication position C (small-diameter portion diameter) of more than 0 but less than 20 nm. The small-diameter portion diameter is preferably up to 15 nm, more preferably up to 13 nm and most preferably from 5 to 10 nm in terms of the deinking ability after suspended printing and on-press developability.

At an average diameter of 20 nm or more, the lithographic printing plate obtained using the lithographic printing plate support according to the first aspect of the invention has poor deinking ability after suspended printing and the presensitized plate has poor on-press developability.

The average diameter of the small-diameter portions 20 is determined as follows: The surface of the anodized film 14 is taken by FE-SEM at a magnification of 150,000× to obtain four images, and in the resulting four images, the diameter of the micropores (small-diameter portions) within an area of 400×600 $nm^2$ is measured and the average of the measurements is calculated. When the depth of the large-diameter portions is large, the average diameter of the small-diameter portions may be determined by optionally cutting out the upper region of the anodized film 14 including the large-diameter portions, for example, by argon gas and observing the surface of the anodized film 14 by FE-SEM.

The equivalent circle diameter is used if the shape of the small-diameter portions 20 on the image is not circular. The "equivalent circle diameter" refers to a diameter of a circle assuming that the shape of an aperture is the circle having the same projected area as that of the aperture.

The bottom of each small-diameter portion 20 is at a distance of 900 to 2,000 nm in the depth direction from the communication position C with the corresponding large-diameter portion 18. In other words, the small-diameter portions 20 are pore portions each of which further extends in the depth direction (thickness direction) from the communication position C with the corresponding large-diameter portion 18 and the small-diameter portions 20 have a depth of 900 to 2,000 nm. The bottom of each small-diameter portion 20 is preferably at a depth of 900 to 1,500 nm from the communication position C in terms of more excellent scratch resistance of the lithographic printing plate support.

At a depth of less than 900 nm, the lithographic printing plate support has poor scratch resistance. A depth in excess of 2,000 nm requires a prolonged treatment time and reduces the productivity and economic efficiency.

The depth is determined by taking a cross-sectional image of the anodized film 14 at a magnification of 50,000×, measuring the depth of at least 25 small-diameter portions, and calculating the average of the measurements.

The ratio of the communication position average diameter of the small-diameter portions 20 (small-diameter portion diameter) and the average diameter of the large-diameter portions 18 at the surface of the anodized film (large-diameter portion diameter) (small-diameter portion diameter/large-diameter portion diameter) is up to 0.85. The lower limit of the ratio is more than 0, and the ratio is preferably from 0.02 to 0.85 and more preferably from 0.10 to 0.70. At an average diameter ratio within the foregoing range, the lithographic printing plate has a longer press life and more excellent deinking ability after suspended printing and the presensitized plate has more excellent on-press developability.

At an average diameter ratio in excess of 0.85, a good balance cannot be struck between the press life and the deinking ability after suspended printing/on-press developability.

As shown in FIG. 1, the small-diameter portions 20 have a branched (dendritic) shape along the depth direction (thickness direction of the anodized film 14). In other words, the small-diameter portions 20 have one or more branching points along the depth direction. The small-diameter portions 20 having such a shape increases the resistance to permeation into the micropores of the components of the photosensitive layer formed on top of the anodized film, resulting in a further improvement of the on-press developability and long-term stability.

The number of branching points included in the small-diameter portion 20 is not particularly limited and is appropriately adjusted. There are three branching points in FIG. 1.

The small-diameter portion 20 in FIG. 1 branches off into two portions but may branch off into any number of portions. For example, the small-diameter portion 20 may branch off into three portions.

The distance between two branching points in the depth direction or thickness direction of the anodized film is not particularly limited but may be appropriately adjusted.

The internal diameter of the small-diameter portions 20 is not particularly limited in the depth direction of the anodized film and may be substantially the same as, or smaller or larger than the communication position diameter. The internal diameter of the small-diameter portions 20 may have a difference of about 1 nm to about 5 nm along the thickness direction of the anodized film 16.

The density of the small-diameter portions in the cross section of the anodized film 14 at the communication position C is preferably 100 to 3,000 pcs/$\mu m^2$. At a density within the foregoing range, the press life and the deinking ability after suspended printing are further improved. The density is more preferably from 300 to 800 pcs/$\mu m^2$ in terms of more beneficial effects.

The small-diameter portion 20 is a pore portion which branches off and extends from the communication position toward the aluminum plate as described above, and the density of the small-diameter portions in the cross section (transverse section) of the anodized film increases toward the aluminum plate side. More specifically, the density of the small-diameter portions in the cross section of the anodized film at the central position in the depth direction of the small-diameter portions (density B) is larger than that of the small-diameter portions in the cross section of the anodized film at the communication position C (density A), and the density B is preferably 300 to 9,000 pcs/$\mu m^2$. At a density B within the foregoing range, the on-press developability and the long-term stability are more excellent. The density B is more preferably 500 to 3,000 pcs/$\mu m^2$. The "central position in the depth direction of the small-diameter portions" as used herein refers to a position which is in the center of the total depth of a small-diameter portion (corresponding to the central position P in FIG. 1).

The thickness of the anodized film between the bottom of each small-diameter portion 20 and the surface of the aluminum plate 12 which corresponds to the thickness X in FIG. 1A is not particularly limited and is preferably at least 20 nm. The portion corresponding to the thickness X in the anodized film is also called "barrier layer." A thickness X within the above-defined range enables the lithographic printing plate obtained to have high resistance to dotted scumming. In particular, the thickness X is preferably at least 22 nm and more preferably at least 24 nm because the foregoing effects are more beneficial. The upper limit is not particularly limited and the thickness X is preferably up to 35 nm in terms of the uniform film formation and formation rate.

(Preferred Embodiment of Small-Diameter Portion)

Figure 3:
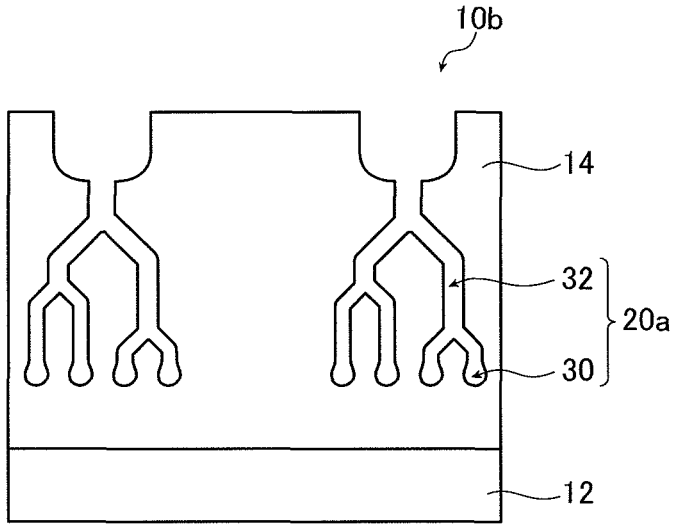
FIG. 3 is a schematic cross-sectional view showing yet another embodiment of the lithographic printing plate support according to the first aspect of the invention.

A preferred embodiment of the small-diameter portion is a small-diameter portion 20*a* as shown in FIG. 3 which has an enlarged-diameter portion 30 at one end thereof. In FIG. 3, the portion making up the small-diameter portion 20*a* except the enlarged-diameter portion 30 is referred to as a main pore portion 32. The main pore portion 32 is connected to the enlarged-diameter portion 30 along the thickness direction of the anodized film 14 to form the small-diameter portion 20*a*. The small-diameter portions having the structure described above enable the lithographic printing plate obtained using the lithographic printing plate support to have more excellent resistance to dotted scumming.

The enlarged-diameter portion 30 is at one end of the small-diameter portion 20*a*. In other words, the enlarged-diameter portion 30 is a pore portion which communicates with one end of the main pore portion 32, extends toward the aluminum plate 12 side and has the maximum diameter larger than the maximum value of the internal diameter of the main pore portion 32. For example, the enlarged-diameter portion 30 may be a substantially bell-shaped pore portion (inversely tapered pore portion) in which the pore diameter enlarges from the lower end of the main pore portion 32 toward the aluminum plate 12 side.

The enlarged-diameter portions 30 preferably have an average maximum diameter of at least 6 nm and more preferably 8 to 30 nm.

The average difference between the maximum diameter of the enlarged-diameter portions 30 and the maximum value of the internal diameter of the main pore portions 32 is preferably at least 3 nm and more preferably 6 to 25 nm.

As described above, the main pore portion 32 is a pore portion which dendritically extends along the depth direction (thickness direction) of the anodized film.

Of the total depth of the small-diameter portion 20*a* from the communication position C to its bottom, the depth of the main pore portion 32 usually accounts for 40 to 98% and that of the enlarged-diameter portion 30 accounts for the remaining percentage.

The coating weight of the anodized film 14 is not particularly limited and is preferably from 2.3 to 5.5 g/m$^2$ and more preferably from 2.3 to 4.0 g/m$^2$ in terms of more excellent scratch resistance of the lithographic printing plate support.

The above-described lithographic printing support having an image recording layer to be described later formed on a surface thereof can be used as a presensitized plate.

[Method of Manufacturing Lithographic Printing Plate Support]

The method of manufacturing the lithographic printing plate support according to the first aspect of the invention is described below. The method of manufacturing the lithographic printing plate support according to the first aspect of the invention is not particularly limited and a manufacturing method in which the following steps are performed in order is preferred.

(Surface roughening treatment step) Step of surface roughening treatment on an aluminum plate;

(First anodizing treatment step) Step of anodizing the aluminum plate having undergone surface roughening treatment;

(Pore-widening treatment step) Step of enlarging the diameter of micropores in an anodized film by bringing the aluminum plate having the anodized film obtained in the first anodizing treatment step into contact with an aqueous acid or alkali solution.

(Second anodizing treatment step) Step of anodizing the aluminum plate obtained in the pore-widening treatment step;

(Third anodizing treatment step) Step of anodizing the aluminum plate obtained in the second anodizing treatment step;

(Hydrophilizing treatment step) Step of hydrophilizing the aluminum plate obtained in the third anodizing treatment step.

The respective steps are described below in detail. The surface roughening treatment step, the pore-widening step, the third anodizing treatment step and the hydrophilizing treatment step are not essential steps.

FIG. 4 is a schematic cross-sectional view showing the substrate and the anodized film in order of steps from the first anodizing treatment step to the third anodizing treatment step.

[Surface Roughening Treatment Step]

The surface roughening treatment step is a step in which the surface of the aluminum plate is subjected to surface roughening treatment including electrochemical graining treatment. This step is preferably performed before the first anodizing treatment step to be described later but may not be performed if the aluminum plate already has a preferred surface shape.

The surface roughening treatment may include solely electrochemical graining treatment, or electrochemical graining treatment, mechanical graining treatment and/or chemical graining treatment in combination.

In cases where mechanical graining treatment is combined with electrochemical graining treatment, mechanical graining treatment is preferably followed by electrochemical graining treatment.

In the practice of the invention, electrochemical graining treatment is preferably carried out in an aqueous solution of nitric acid or hydrochloric acid.

Mechanical graining treatment is generally performed in order that the surface of the aluminum plate may have a surface roughness $R_a$ of 0.35 to 1.0 μm.

In the invention, mechanical graining treatment is not particularly limited for its conditions and can be performed according to the method described in, for example, JP 50-40047 B. Mechanical graining treatment can be carried out by brush graining using a suspension of pumice or a transfer system.

Chemical graining treatment is also not particularly limited but may be carried out by any known method.

Mechanical graining treatment is preferably followed by chemical etching treatment described below.

The purpose of chemical etching treatment following mechanical graining treatment is to smooth edges of irregularities at the surface of the aluminum plate to prevent ink from catching on the edges during printing, to improve the scumming resistance of the lithographic printing plate, and to remove abrasive particles or other unnecessary substances remaining on the surface.

Chemical etching processes including etching using an acid and etching using an alkali are known in the art and an exemplary method which is particularly excellent in terms of etching efficiency includes chemical etching treatment using an alkali solution. This treatment is hereinafter referred to as "alkali, etching treatment."

Alkaline agents that may be used in the alkali solution are not particularly limited and illustrative examples of suitable alkaline agents include sodium hydroxide, potassium hydroxide, sodium metasilicate, sodium carbonate, sodium aluminate, and sodium gluconate.

The alkaline agents may contain aluminum ions. The alkali solution has a concentration of preferably at least 0.01 wt % and more preferably at least 3 wt %, but preferably not more than 30 wt % and more preferably not more than 25 wt %.

The alkali solution has a temperature of preferably room temperature or higher, and more preferably at least 30° C., but preferably not more than 80° C., and more preferably not more than 75° C.

The amount of material removed from the aluminum plate (also referred to below as the "etching amount") is preferably at least 0.1 g/m$^2$ and more preferably at least 1 g/m$^2$, but preferably not more than 20 g/m$^2$ and more preferably not more than 10 g/m$^2$.

The treatment time is preferably from 2 seconds to 5 minutes depending on the etching amount and more preferably from 2 to 10 seconds in terms of improving the productivity.

In cases where mechanical graining treatment is followed by alkali etching treatment in the invention, chemical etching treatment using an acid solution at a low temperature (hereinafter also referred to as "desmutting treatment") is preferably performed to remove substances produced by alkali etching treatment.

Acids that may be used in the acid solution are not particularly limited and illustrative examples thereof include sulfuric acid, nitric acid and hydrochloric acid. The acid solution preferably has a concentration of 1 to 50 wt %. The acid solution preferably has a temperature of 20 to 80° C. When the concentration and temperature of the acid solution fall within the above-defined ranges, a lithographic printing plate obtained using the lithographic printing plate support according to the first aspect of the invention has a more improved resistance to dotted scumming.

In the practice of the invention, the surface roughening treatment is a treatment in which electrochemical graining treatment is carried out after mechanical graining treatment and chemical etching treatment are carried out as desired, but also in cases where electrochemical graining treatment is carried out without performing mechanical graining treatment, electrochemical graining treatment may be preceded by chemical etching treatment using an aqueous alkali solution such as sodium hydroxide. In this way, impurities which are present in the vicinity of the surface of the aluminum plate can be removed.

Electrochemical graining treatment easily forms fine pits at the surface of the aluminum plate and is therefore suitable to prepare a lithographic printing plate having excellent printability.

Electrochemical graining treatment is carried out in an aqueous solution containing nitric acid or hydrochloric acid as its main ingredient using direct or alternating current.

Electrochemical graining treatment is preferably followed by chemical etching treatment described below. Smut and intermetallic compounds are present at the surface of the aluminum plate having undergone electrochemical graining treatment. In chemical etching treatment following electrochemical graining treatment, it is preferable for chemical etching using an alkali solution (alkali etching treatment) to be first carried out in order to particularly remove smut with high efficiency. The conditions in chemical etching using an alkali solution preferably include a treatment temperature of 20 to 80° C. and a treatment time of 1 to 60 seconds. It is desirable for the alkali solution to contain aluminum ions.

In order to remove substances generated by chemical etching treatment using an alkali solution following electrochemical graining treatment, it is further preferable to carry out chemical etching treatment using an acid solution at a low temperature (desmutting treatment).

Even in cases where electrochemical graining treatment is not followed by alkali etching treatment, desmutting treatment is preferably carried out to remove smut efficiently.

In the practice of the invention, chemical etching treatment is not particularly limited and may be carried out by immersion, showering, coating or other process.

[First Anodizing Treatment Step]

Figure 4A:
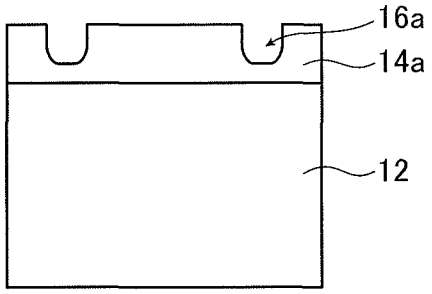
FIG. 4 is a schematic cross-sectional view showing a substrate and an anodized film in the order of steps in a method of manufacturing the lithographic printing plate support according to the first aspect of the invention.

The first anodizing treatment step is a step in which an anodized aluminum film having micropores which extend in the depth direction (thickness direction) of the film is formed at the surface of the aluminum plate by performing anodizing treatment on the aluminum plate having undergone the above-described surface roughening treatment. As shown in FIG. 4A, as a result of the first anodizing treatment, an anodized aluminum film 14*a* bearing micropores 16*a* is formed at a surface of the aluminum plate 12.

The first anodizing treatment may be performed by a conventionally known method in the art but the manufacturing conditions are appropriately set so that the foregoing micropores 16 may be finally formed.

More specifically, the micropores 16*a* formed in the first anodizing treatment step usually have an average diameter (average aperture size) of about 5 to about 40 nm and preferably 7 to 20 nm. At an average aperture size within the foregoing range, the micropores 16 having the foregoing specified shapes are easily formed and the resulting lithographic printing plate and presensitized plate have more excellent properties.

The micropores 16*a* usually have a depth of about 10 nm or more but less than about 100 nm, and preferably 20 to 60 nm. At a depth within the foregoing range, the micropores 16 having the foregoing specified shapes are easily formed and the resulting lithographic printing plate and presensitized plate have more excellent properties.

The density of the micropores 16*a* is not particularly limited and is preferably 50 to 4,000 pcs/$\mu m^2$, and more preferably 100 to 3,000 pcs/$\mu m^2$. At a micropore density within the foregoing range, the lithographic printing plate obtained has a long press life and excellent deinking ability after suspended printing and the presensitized plate has excellent on-press developability.

The anodized film obtained by the first anodizing treatment step preferably has a thickness of 35 to 120 nm and more preferably 40 to 90 nm. At a film thickness within the foregoing range, the lithographic printing plate using the lithographic printing plate support obtained after the foregoing steps has a long press life and excellent deinking ability after suspended printing, and the presensitized plate has excellent on-press developability.

In addition, the anodized film obtained by the first anodizing treatment step preferably has a coating weight of 0.1 to 0.3 g/$m^2$ and more preferably 0.12 to 0.25 g/$m^2$. At a coating weight within the foregoing range, the lithographic printing plate using the lithographic printing plate support obtained after the foregoing steps has a long press life and excellent deinking ability after suspended printing, and the presensitized plate has excellent on-press developability.

In the first anodizing treatment step, aqueous solutions of acids such as sulfuric acid, phosphoric acid and oxalic acid may be mainly used for the electrolytic solution. An aqueous solution or non-aqueous solution containing chromic acid, sulfamic acid, benzenesulfonic acid or a combination of two or more thereof may optionally be used. The anodized film can be formed at the surface of the aluminum plate by passing direct current or alternating current through the aluminum plate in the foregoing electrolytic solution.

The electrolytic solution may contain aluminum ions. The content of the aluminum ions is not particularly limited and is preferably from 1 to 10 g/L.

The anodizing treatment conditions are appropriately set depending on the electrolytic solution employed. However, the following conditions are generally suitable: an electrolyte concentration of from 1 to 80 wt %, a solution temperature of from 5 to 70° C., a current density of from 0.5 to 60 A/$dm^2$, a voltage of from 1 to 100 V, and an electrolysis time of from 1 to 100 seconds. An electrolyte concentration of from 5 to 20 wt %, a solution temperature of from 10 to 60° C., a current density of from 5 to 50 A/$dm^2$, a voltage of from 5 to 50 V, and an electrolysis time of from 5 to 60 seconds are preferred.

Of these anodizing treatment methods, the method described in GB 1,412,768 B which involves anodizing in sulfuric acid at a high current density is preferred.

[Pore-Widening Treatment Step]

Figure 4B:
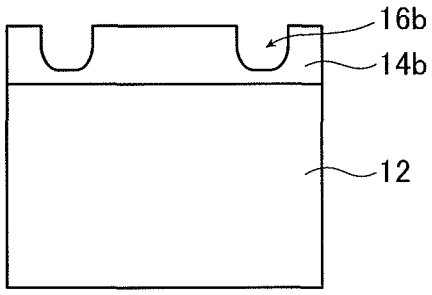

The pore-widening treatment step is a step for enlarging the diameter (pore size) of the micropores present in the anodized film formed by the above-described first anodizing treatment step (pore size-enlarging treatment). As shown in FIG. 4B, the pore-widening treatment enlarges the diameter of the micropores 16*a* to form an anodized film 14*b* having micropores 16*b* with a larger average diameter.

The pore-widening treatment increases the average diameter of the micropores 16*b* to a range of 10 nm to 100 nm. The micropores 16*b* correspond to the above-described large-diameter portions 18.

The depth of the micropores 16*b* from the film surface is preferably adjusted by this treatment so as to be approximately the same as the depth A.

Pore-widening treatment is performed by contacting the aluminum plate obtained by the above-described first anodizing treatment step with an aqueous acid or alkali solution. Examples of the contacting method include, but are not limited to, immersion and spraying. Of these, immersion is preferred.

When the pore-widening treatment step is to be performed with an aqueous alkali solution, it is preferable to use an aqueous solution of at least one alkali selected from the group consisting of sodium hydroxide, potassium hydroxide and lithium hydroxide. The aqueous alkali solution preferably has a concentration of 0.1 to 5 wt %.

The aluminum plate is suitably contacted with the aqueous alkali solution at 10° C. to 70° C. and preferably 20° C. to 50° C. for 1 to 300 seconds and preferably 1 to 50 seconds after the aqueous alkali solution is adjusted to a pH of 11 to 13.

The alkaline treatment solution may contain metal salts of polyvalent weak acids such as carbonates, borates and phosphates.

When the pore-widening treatment step is to be performed with an aqueous acid solution, it is preferable to use an aqueous solution of an inorganic acid such as sulfuric acid, phosphoric acid, nitric acid or hydrochloric acid, or a mixture thereof. The aqueous acid solution preferably has a concentration of 1 to 80 wt % and more preferably 5 to 50 wt %.

The aluminum plate is suitably contacted with the aqueous acid solution at 5° C. to 70° C. and preferably 10° C. to 60° C. for 1 to 300 seconds and preferably 1 to 150 seconds.

The aqueous alkali or acid solution may contain aluminum ions. The content of the aluminum ions is not particularly limited and is preferably from 1 to 10 g/L.

[Second Anodizing Treatment Step]

Figure 4C:
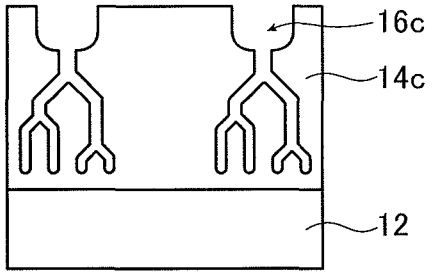

The second anodizing treatment step is a step in which micropores which further extend in the depth direction (thickness direction) of the film are formed by performing anodizing treatment on the aluminum plate having undergone the above-described pore-widening treatment. As shown in FIG. 4C, an anodized film 14*c* bearing micropores 16*c* and extending in the depth direction of the film is formed by the second anodizing treatment step.

The second anodizing treatment step forms new dendritic pores which communicate with the bottoms of the micropores 16*b* with the increased average diameter, have a smaller communication position average diameter than the average diameter of the micropores 16*b* corresponding to the large-diameter portions 18 and, branch off and extend from the communication positions in the depth direction. The pores correspond to the above-described small-diameter portions 20.

In the second anodizing treatment step, the treatment is performed so that the newly formed pores have an average diameter of more than 0 but less than 20 nm and a depth from the communication positions with the large-diameter portions 20 within the foregoing specified range. The electrolytic solution used for the treatment is the same as used in the first anodizing treatment step and the treatment conditions are set as appropriate for the materials used.

Any known materials may be employed in the electrolytic solution used in the second anodizing treatment step.

The conditions of the second anodizing treatment step are not particularly limited as long as the dendritic pores are formed and an exemplary process involves processing as the current density is gradually decreased. In this processing, the scanning waveform shows a simple decrease pattern. The initial current density in this process varies with the type of electrolytic solution used and is often from about 10 A/dm$^2$ to about 30 A/dm$^2$.

The current density can be gradually decreased without particular limitation on its degree and is preferably decreased gradually to such an extent that the current density reduces to about 25 to 95% (preferably about 30 to 60%) of the initial value.

The scanning time varies with the type of electrolytic solution used and is preferably about 0.1 second to about 30 seconds.

The anodized film obtained by the second anodizing treatment step usually has a thickness of 900 to 2,000 nm and preferably 900 to 1,500 nm. At a film thickness within the foregoing range, the lithographic printing plate using the lithographic printing plate support obtained after the foregoing steps has a long press life and excellent deinking ability after suspended printing, and the presensitized plate has excellent on-press developability.

The anodized film obtained by the second anodizing treatment step usually has a coating weight of 2.2 to 5.4 g/m$^2$ and preferably 2.2 to 4.0 g/m$^2$. At a coating weight within the foregoing range, the lithographic printing plate using the lithographic printing plate support obtained after the foregoing steps has a long press life and excellent deinking ability after suspended printing, and the presensitized plate has excellent on-press developability.

The ratio between the thickness of the anodized film obtained by the first anodizing treatment step (first film thickness) and that of the anodized film obtained by the second anodizing treatment step (second film thickness) (first film thickness/second film thickness) is preferably from 0.01 to 0.15 and more preferably from 0.02 to 0.10. At a film thickness ratio within the above-defined range, the lithographic printing plate support has excellent scratch resistance.

In order to obtain the shape of the small-diameter portions 20*a* described above, the voltage applied may be increased stepwise or continuously or the temperature of the electrolytic solution may be decreased just before the end of the treatment in the second anodizing treatment step. This treatment enables the pores formed to have a larger diameter thereby obtaining such a shape as in the small-diameter portions 20*a* described above.

The thickness of the anodized film between the bottoms of the resulting small-diameter portions and the aluminum plate tends to increase by increasing the voltage applied in the second anodizing treatment step. In cases where the anodized film between the bottoms of the small-diameter portions and the aluminum plate has a predetermined thickness as a result of the foregoing treatment, the third anodizing treatment step to be described later may not be performed.

[Third Anodizing Treatment Step]

Figure 4D:
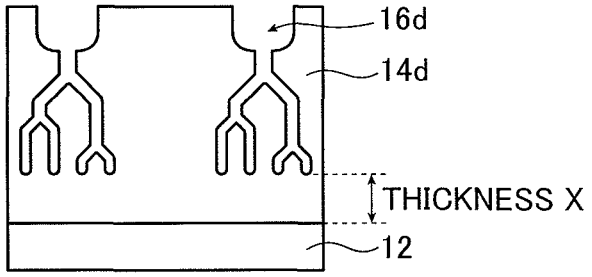

The third anodizing treatment step is a step in which the aluminum plate having undergone the second anodizing treatment is further anodized to mainly increase the thickness of the anodized film located between the bottoms of the small-diameter portions and the aluminum plate (thickness of the barrier layer). As shown in FIG. 4D, the thickness X reaches a predetermined value as a result of the third anodizing treatment step.

In cases where the micropores already have desired shapes at the end of the second anodizing treatment step, the third anodizing treatment step may not be performed as described above.

The conditions of the anodizing treatment in the third anodizing treatment step are set as appropriate for the electrolytic solution used. The treatment is usually performed at a higher voltage than that applied in the second anodizing treatment step or with an electrolytic solution having a lower temperature than that of the electrolytic solution used in the second anodizing treatment step.

The type of electrolytic solution used is not particularly limited and any of the above-described electrolytic solutions may be used. By using, for example, a boric acid-containing aqueous solution as the electrolytic solution, the thickness X can be efficiently increased without changing the shape of the small-diameter portions obtained in the second anodizing treatment step.

The anodized film obtained by the third anodizing treatment step usually has a coating weight of 0.13 to 0.65 g/m$^2$ and preferably 0.26 to 0.52 g/m$^2$. At a coating weight within the foregoing range, the lithographic printing plate using the lithographic printing plate support obtained after the foregoing steps has a long press life, excellent deinking ability after suspended printing and excellent resistance to dotted scumming, and the presensitized plate has excellent on-press developability.

The micropores may further extend on the aluminum plate side as a result of the third anodizing treatment step.

[Hydrophilizing Treatment Step]

The method of manufacturing the lithographic printing plate support according to the first aspect of the invention may have a hydrophilizing treatment step in which the aluminum plate is hydrophilized after the above-described third anodizing treatment step. Hydrophilizing treatment may be performed by any known method disclosed in paragraphs [0109] to [0114] of JP 2005-254638 A.

It is preferable to perform hydrophilizing treatment by a method in which the aluminum plate is immersed in an aqueous solution of an alkali metal silicate such as sodium silicate or potassium silicate, or is coated with a hydrophilic vinyl polymer or a hydrophilic compound so as to form a hydrophilic undercoat.

Hydrophilizing treatment with an aqueous solution of an alkali metal silicate such as sodium silicate or potassium silicate can be carried out according to the processes and procedures described in U.S. Pat. No. 2,714,066 and U.S. Pat. No. 3,181,461.

[Second Aspect]

The lithographic printing plate support according to the second aspect of the invention includes an aluminum plate and an anodized film formed thereon, each of micropores in the anodized film being of such a shape that a large-diameter portion having a larger average diameter communicates with a small-diameter portion having a smaller average diameter along the depth direction (i.e., the thickness direction of the film). Particularly in the invention, although the press life has been deemed to have a trade-off relation with the deinking ability after suspended, printing or the on-press developability, these properties can be simultaneously achieved at a higher level while suppressing the dotted scumming and the generation of white spots (the resistances to these defects are hereinafter referred to as "resistance to dotted scumming" and resistance to white spot formation", respectively) by controlling the depth of the large-diameter portions having a larger average diameter in the micropores and controlling the distance from the bottoms of the small-diameter portions the anodized film to the aluminum plate.

Figure 9A:
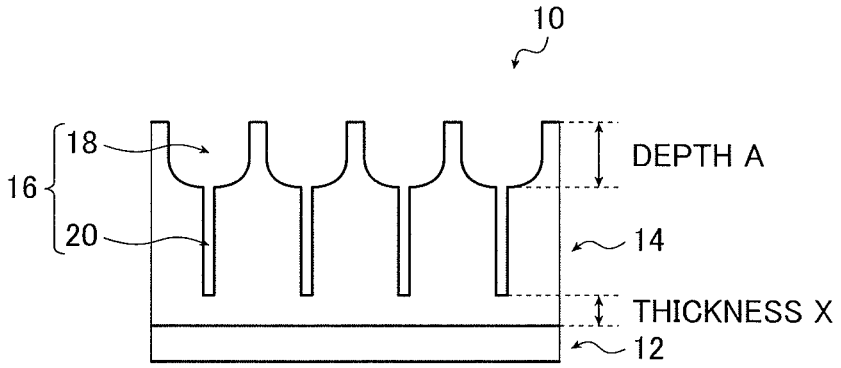
FIG. 9 is a schematic cross-sectional view showing an embodiment of the lithographic printing plate support according to the second aspect of the invention.

FIG. 9A is a schematic cross-sectional view showing an embodiment of the lithographic printing plate support according to the second aspect of the invention.

A lithographic printing plate support 10 shown in FIG. 9A is of a laminated structure in which an aluminum plate 12 and an anodized aluminum film 14 are stacked in this order. The anodized film 14 has micropores 16 extending from its surface toward the aluminum plate 12 side, and each micropore 16 has a large-diameter portion 18 and a small-diameter portion 20. The term "micropore" is commonly used to denote a pore in the anodized film and does not define the size of the pore.

The aluminum plate 12 and the anodized film 14 are first described in detail.

[Aluminum Plate]

The aluminum plate 12 for use in the foregoing lithographic printing plate support according to the first aspect of the invention is used for the aluminum plate 12 (aluminum support) in the invention.

[Anodized Film]

The anodized film 14 refers to an anodized aluminum film that is generally formed at a surface of the aluminum plate 12 by anodizing treatment and has the micropores 16 which are substantially vertical to the film surface and are individually distributed in a uniform manner. The micropores 16 extend along the thickness direction of the anodized film 14 from the surface of the anodized film opposite to the aluminum plate 12 toward the aluminum plate 12 side.

Each micropore 16 in the anodized film 14 has the large-diameter portion 18 which extends to a depth of 5 to 60 nm from the anodized film surface (depth A: see FIG. 9A), and the small-diameter portion 20 which communicates with the bottom of the large-diameter portion 18 and further extends to a depth of 900 to 2,000 nm from the communication position.

The large-diameter portion 18 and the small-diameter portion 20 are described below in detail.

(Large-Diameter Portion)

The large-diameter portions 18 have an average diameter (average aperture size) of 10 to 60 nm at the surface of, the anodized film. At an average diameter within the foregoing range, the lithographic printing plate obtained using the lithographic printing plate support has a long press life, excellent deinking ability after suspended printing, excellent resistance to dotted scumming and excellent resistance to white spot formation, and the presensitized plate obtained using the support has excellent on-press developability. In terms of longer press life of the lithographic printing plate obtained using the lithographic printing plate support, the average diameter is preferably from 10 to 50 nm, more preferably from 15 to 50 nm and even more preferably from 20 to 50 nm.

At an average diameter of less than 10 nm, a sufficient anchor effect is not obtained, nor is the press life of the lithographic printing plate improved. At an average diameter in excess of 60 nm, the roughened surface is damaged whereby the properties such as press life and deinking ability after suspended printing cannot be improved.

The average diameter of the large-diameter portions 18 is determined as follows: The surface of the anodized film 14 is taken by FE-SEM at a magnification of 150,000× to obtain four images, and in the resulting four images, the diameter of the micropores (large-diameter portions) within an area of 400×600 nm$^2$ is measured and the average of the measurements is calculated.

The equivalent circle diameter is used if the aperture of the large-diameter portion 18 is not circular. The "equivalent circle diameter" refers to a diameter of a circle assuming that the shape of an aperture is the circle having the same projected area as that of the aperture.

The bottom of each large-diameter portion 18 is at a depth of 5 to 60 nm from the surface of the anodized film (hereinafter this depth is also referred to as "depth A"). In other words, each large-diameter portion 18 is a pore portion which extends from the surface of the anodized film in the depth direction (thickness direction) to a depth of 5 to 60 nm. The depth is preferably from 10 nm to 50 nm from the viewpoint that the lithographic printing plate obtained using the lithographic printing plate support has a longer press life and more excellent deinking ability after suspended printing, resistance to dotted scumming and resistance to white spot formation, and the presensitized plate obtained using the support has more excellent on-press developability.

At a depth of less than 5 nm, a sufficient anchor effect is not obtained, nor is the press life of the lithographic printing plate improved. At a depth in excess of 60 nm, the lithographic printing plate has poor deinking ability after suspended printing and the presensitized plate has poor on-press developability.

The depth is determined by taking a cross-sectional image of the anodized film 14 at a magnification of 150,000×, measuring the depth of at least 25 large-diameter portions, and calculating the average of the measurements.

The ratio of the depth A of the large-sized portions 18 to their bottoms to the average diameter of the large-sized portions 18 (depth A/average diameter) is from 0.1 to 4.0. The ratio of the depth A to the large-sized portion average diameter is preferably at least 0.3 but less than 3.0, and more preferably at least 0.3 but less than 2.5 from the viewpoint that the lithographic printing plate obtained using the lithographic printing plate support has a longer press life and more excellent deinking ability after suspended printing and that the presensitized plate obtained using the support has more excellent on-press developability.

At a ratio of the depth A to the average diameter of less than 0.1, the press life of the lithographic printing plate is not improved. At a ratio of the depth A to the average diameter in excess of 4:0, the lithographic printing plate has poor deinking ability after suspended printing and the presensitized plate has poor on-press developability.

The shape of the large-diameter portions 18 is not particularly limited. Exemplary shapes include a substantially straight tubular shape (substantially columnar shape), and a conical shape in which the diameter decreases in the depth direction (thickness direction), and a substantially straight tubular shape is preferred. The bottom shape of the large-diameter portions 18 is not particularly limited and may be curved (convex) or flat.

The internal diameter of the large-diameter portions 18 is not particularly limited and is usually substantially equal to or smaller than the diameter of the apertures. There may be usually a difference of about 1 nm to about 10 nm between the internal diameter of the large-diameter portions 18 and the aperture diameter of the large-diameter portions 18.

(Small-Diameter Portion)

As shown in FIG. 9A, each of the small-diameter portions 20 is a pore portion which communicates with the bottom of the corresponding large-diameter portion 18 and further extends from the communication position in the depth direction (i.e., in the thickness direction). One small-diameter portion 20 usually communicates with one large-diameter portion 18 but two or more small-diameter portions 20 may communicate with the bottom of one large-diameter portion 18.

The small-diameter portions 20 have a communication position average diameter of more than 0 but less than 20 nm. The communication position average diameter is preferably up to 15 nm, more preferably up to 13 nm and most preferably from 5 to 10 nm in terms of the deinking ability after suspended printing and on-press developability.

At an average diameter of 20 nm or more, the lithographic printing plate obtained using the lithographic printing plate support according to the second aspect of the invention has poor deinking ability after suspended printing and the presensitized plate has poor on-press developability.

The average diameter of the small-diameter portions 20 is determined as follows: The surface of the anodized film 14 is taken by FE-SEM at a magnification of 150,000× to obtain four images, and in the resulting four images, the diameter of the micropores (small-diameter portions) within an area of 400×600 $nm^2$ is measured and the average of the measurements is calculated. When the depth of the large-diameter portions is large, the average diameter of the small-diameter portions may be determined by optionally cutting out the upper region of the anodized film 14 including the large-diameter portions by argon gas and observing the surface of the anodized film 14 by FE-SEM.

The equivalent circle diameter is used if the small-diameter portion 20 does not have a circular cross-sectional shape. The "equivalent circle diameter" refers to a diameter of a circle assuming that the shape of an aperture is the circle having the same projected area as that of the aperture.

The bottom of each small-diameter portion 20 is at a distance of 900 to 2,000 nm in the depth direction from the communication position with the corresponding large-diameter portion 18 which has the depth A up to the communication position. In other words, the small-diameter portions 20 are pore portions each of which further extends in the depth direction (thickness direction) from the communication position with the corresponding large-diameter portion 18 and the small-diameter portions 20 have a depth of 900 to 2,000 nm. The bottom of each small-diameter portion 20 is preferably at a depth of 900 to 1,500 nm from the communication position in terms of the scratch resistance of the lithographic printing plate support.

At a depth of less than 900 nm, the lithographic printing plate support has poor scratch resistance. A depth in excess of 2,000 nm requires a prolonged treatment time and reduces the productivity and economic efficiency.

The depth is determined by taking a cross-sectional image of the anodized film 14 at a magnification of 50,000×, measuring the depth of at least 25 small-diameter portions, and calculating the average of the measurements.

The ratio of the communication position average diameter of the small-diameter portions 20 (small-diameter portion diameter) and the average diameter of the large-diameter portions 18 at the surface of the anodized film (large-diameter portion diameter) (small-diameter portion diameter/large-diameter portion diameter) is up to 0.85. The lower limit of the ratio is more than 0, and the ratio is preferably from 0.02 to 0.85 and more preferably from 0.1 to 0.70. At an average diameter ratio within the foregoing range, the resulting lithographic printing plate has a longer press life and more excellent deinking ability after suspended printing, resistance to dotted scumming and resistance to white spot formation, and the presensitized plate has more excellent on-press developability.

At an average diameter ratio in excess of 0.85, a good balance cannot be struck between the press life and the deinking ability after suspended printing/on-press developability.

The shape of the small-diameter portions 20 is not particularly limited. Exemplary shapes include a substantially straight tubular shape (substantially columnar shape), and a conical shape in which the diameter decreases in the depth direction, and a substantially straight tubular shape is preferred. The bottom shape of the small-diameter portions 20 is not particularly limited and may be curved (convex) or flat.

The internal diameter of the small-diameter portions 20 is not particularly limited and may be usually substantially equal to, or smaller or larger than the communication position diameter. There may be usually a difference of about 1 nm to about 10 nm between the internal diameter of the small-diameter portions 20 and the aperture diameter of the small-diameter portions 20.

The thickness of the anodized film between the bottom of each small-diameter portion 20 and the surface of the aluminum plate 12 which corresponds to the thickness X in FIG. 1A is at least 25 nm. The portion corresponding to the thickness X in the anodized film is also called "barrier layer." A thickness X within the above-defined range enables the lithographic printing plate obtained to have excellent resistance to dotted scumming and excellent resistance to white spot formation. In particular, the thickness X is preferably at least 30 nm and more preferably at least 35 nm because the foregoing effects are more beneficial. The upper limit is not particularly limited and the thickness X is preferably up to 50 nm in terms of the productivity (electricity costs).

At a thickness X of less than 25 nm, the lithographic printing plate obtained has poor resistance to dotted scumming and poor resistance to white spot formation.

(Preferred Embodiment of Small-Diameter Portion)

Figure 9B:
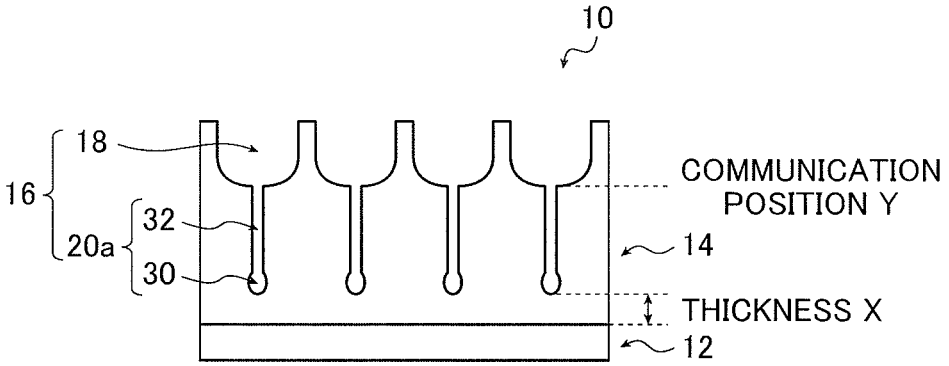

A preferred embodiment of the small-diameter portion is a small-diameter portion 20*a* as shown in FIG. 9B which includes a main pore portion 32 and an enlarged-diameter portion 30 connected together along the thickness direction of an anodized film 16. The small-diameter portions having the structure described above enable the lithographic printing plate obtained using the lithographic printing plate support to have more excellent resistance to dotted scumming and resistance to white spot formation.

The main pore portion 32 is a pore portion which extends from the communication position between the small-diameter portion 20*a* and its corresponding large-diameter portion 18 (hereinafter referred to as "communication position Y") toward the aluminum plate 12 side and is a main part of the small-diameter portion 20*a*.

The main pore portion 32 is usually in a substantially straight tubular shape as shown in FIG. 9B. The internal diameter of the main pore portion 32 may have a difference of about 1 nm to about 5 nm along the thickness direction of the anodized film 16.

The enlarged-diameter portion 30 is a pore portion which communicates with one end of the main pore portion 32, extends toward the aluminum plate 12 side and has the maximum diameter larger than the maximum value of the internal diameter of the main pore portion 32. For example, the enlarged-diameter portion 30 may be an inversely tapered pore portion (substantially conical or bell-shaped pore portion) in which the pore diameter enlarges from the lower end of the main pore portion 32 toward the aluminum plate 12 side.

The enlarged-diameter portions 30 preferably have an average maximum diameter of 5 to 30 nm and more preferably 8 to 25 nm.

The average difference between the maximum diameter of the enlarged-diameter portions 30 and the maximum value of the internal diameter of the main pore portions 32 is preferably 1 to 15 nm and more preferably 3 to 10 nm.

Of the total depth of the small-diameter portion 20*a* from the communication position Y to its bottom, the depth of the main pore portion 32 having a substantially straight tubular shape usually accounts for 75 to 95% and that of the enlarged-diameter portion 30 accounts for the remaining percentage.

The density of the micropores 16 in the anodized film 14 is not particularly limited and the anodized film 14 preferably has 50 to 4,000 micropores/$\mu m^2$; and more preferably 100 to 3,000 micropores/$\mu m^2$ because the resulting lithographic printing plate has a longer press life and excellent deinking ability after suspended printing and the presensitized plate has excellent on-press developability.

The coating weight of the anodized film 14 is not particularly limited and is preferably from 2.3 to 5.5 g/$m^2$ and more preferably from 2.3 to 4.0 g/$m^2$ in terms of excellent scratch resistance of the lithographic printing plate support.

The above-described lithographic printing support having an image recording layer to be described later formed on a surface thereof can be used as a presensitized plate.

[Method of Manufacturing Lithographic Printing Plate Support]

The method of manufacturing the lithographic printing plate support according to the second aspect of the invention is described below.

The method of manufacturing the lithographic printing plate support according to the second aspect of the invention is not particularly limited and a manufacturing method in which the following steps are performed in order is preferred.

(Surface roughening treatment step) Step of surface roughening treatment on an aluminum plate;

(First anodizing treatment step) Step of anodizing the aluminum plate having undergone surface roughening treatment;

(Pore-widening treatment step) Step of enlarging the diameter of micropores in an anodized film by bringing the aluminum plate having the anodized film obtained in the first anodizing treatment step into contact with an aqueous acid or alkali solution.

(Second anodizing treatment step) Step of anodizing the aluminum plate obtained in the pore-widening treatment step;

(Third anodizing treatment step) Step of anodizing the aluminum plate obtained in the second anodizing treatment step;

(Hydrophilizing treatment step) Step of hydrophilizing the aluminum plate obtained in the third anodizing treatment step.

The respective steps are described below in detail. The surface roughening treatment step, the hydrophilizing treatment step and the third anodizing treatment step are not essential steps.

FIG. 10 is a schematic cross-sectional view showing the substrate and the anodized film in order of steps from the first anodizing treatment step to the third anodizing treatment step.

[Surface Roughening Treatment Step]

The surface roughening treatment step is the same as that performed in the foregoing method of manufacturing the lithographic printing plate support according to the first aspect of the invention and the details of the steps are as described above.

[First Anodizing Treatment Step]

Figure 10A:
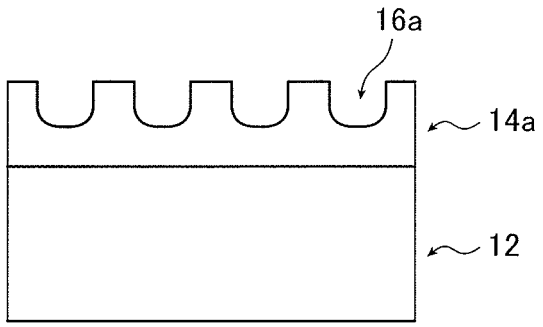
FIG. 10 is a schematic cross-sectional view showing a substrate and an anodized film in the order of steps in the method of manufacturing the lithographic printing plate support according to the second aspect of the invention.

The first anodizing treatment step is a step in which an anodized aluminum film having micropores which extend in the depth direction (thickness direction) of the film is formed at the surface of the aluminum plate by performing anodizing treatment on the aluminum plate having undergone the above-described surface roughening treatment. As shown in FIG. 10A, as a result of the first anodizing treatment step, an anodized aluminum film 14*a* bearing micropores 16*a* is formed at a surface of the aluminum substrate 12.

The first anodizing treatment may be performed by a conventionally known method in the art but the manufacturing conditions are appropriately set so that the foregoing micropores 16 may be finally formed.

More specifically, the average diameter (average aperture size) of the micropores 16*a* formed in the first anodizing treatment step is typically from about 4 nm to about 14 nm and preferably 5 to 10 nm. At an average aperture size within the foregoing range, the micropores 16 having the foregoing specified shapes are easily formed and the resulting lithographic printing plate and presensitized plate have more excellent properties.

The micropores 16*a* usually have a depth of about 10 nm or more but less than about 100 nm, and preferably 20 to 60 nm. At a depth within the foregoing range, the micropores 16 having the foregoing specified shapes are easily formed and the resulting lithographic printing plate and presensitized plate have more excellent properties.

The density of the micropores 16*a* is not particularly limited and is preferably 50 to 4,000 pcs/$\mu m^2$, and more preferably 100 to 3,000 pcs/$\mu m^2$. At a micropore density within the foregoing range, the lithographic printing plate obtained has a long press life and excellent deinking ability after suspended printing and the presensitized plate has excellent on-press developability.

The anodized film obtained by the first anodizing treatment step preferably has a thickness of 35 to 120 nm and more preferably 40 to 90 nm. At a film thickness within the foregoing range, the lithographic printing plate using the lithographic printing plate support obtained after the foregoing steps has a long press life, excellent deinking ability after suspended printing, excellent resistance to dotted scumming, and excellent resistance to white spot formation, and the presensitized plate has excellent on-press developability.

In addition, the anodized film obtained by the first anodizing treatment step preferably has a coating weight of 0.1 to 0.3 g/$m^2$ and more preferably 0.12 to 0.25 g/$m^2$. At a film thickness within the foregoing range, the lithographic printing plate using the lithographic printing plate support obtained after the foregoing steps has a long press life, excellent deinking ability after suspended printing, excellent resistance to dotted scumming, and excellent resistance to white spot formation, and the presensitized plate has excellent on-press developability.

In the first anodizing treatment step, aqueous solutions of acids such as sulfuric acid, phosphoric acid and oxalic acid may be mainly used for the electrolytic solution. An aqueous solution or non-aqueous solution containing chromic acid, sulfamic acid, benzenesulfonic acid or a combination of two or more thereof may optionally be used. The anodized film can be formed at the surface of the aluminum plate by passing direct current or alternating current through the aluminum plate in the foregoing electrolytic solution.

The electrolytic solution may contain aluminum ions. The content of the aluminum ions is not particularly limited and is preferably from 1 to 10 g/L.

The anodizing treatment conditions are appropriately set depending on the electrolytic solution employed. However, the following conditions are generally suitable: an electrolyte concentration of from 1 to 80 wt %, a solution temperature of from 5 to 70° C., a current density of from 0.5 to 60 A/$dm^2$, a voltage of from 1 to 100 V, and an electrolysis time of from 1 to 100 seconds. An electrolyte concentration of from 5 to 20 wt %, a solution temperature of from 10 to 60° C., a current density of from 5 to 50 A/$dm^2$, a voltage of from 5 to 50 V, and an electrolysis time of from 5 to 60 seconds are preferred.

Of these anodizing treatment methods, the method described in GB 1,412,768 B which involves anodizing in sulfuric acid at a high current density is preferred.

[Pore-Widening Treatment Step]

Figure 10B:
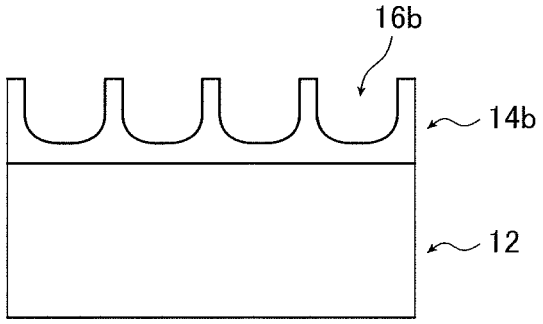
Figure 10C:
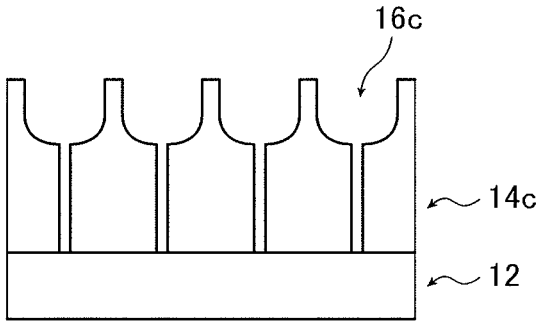

The pore-widening treatment step is a step for enlarging the diameter (pore size) of the micropores present in the anodized film formed by the above-described first anodizing treatment step (pore size-enlarging treatment). As shown in FIG. 10B, the pore-widening treatment enlarges the diameter of the micropores 16*a* to form an anodized film 14*b* having micropores 16*b* with a larger average diameter.

The pore-widening treatment increases the average diameter of the micropores 16*b* to a range of 10 nm to 60 nm and preferably 10 nm to 50 nm. The micropores 16*b* correspond to the above-described large-diameter portions 18.

The depth of the micropores 16*b* from the film surface is preferably adjusted by this treatment so as to be approximately the same as the depth A.

Pore-widening treatment is performed by contacting the aluminum plate obtained by the above-described first anodizing treatment step with an aqueous acid or alkali solution. Examples of the contacting method include, but are not limited to, immersion and spraying. Of these, immersion is preferred.

When the pore-widening treatment step is to be performed with an aqueous alkali solution, it is preferable to use an aqueous solution of at least one alkali selected from the group consisting of sodium hydroxide, potassium hydroxide and lithium hydroxide. The aqueous alkali solution preferably has a concentration of 0.1 to 5 wt %.

The aluminum plate is suitably contacted with the aqueous alkali solution at 10° C. to 70° C. and preferably 20° C. to 50° C. for 1 to 300 seconds and preferably 1 to 50 seconds after the aqueous alkali solution is adjusted to a pH of 11 to 13.

The alkaline treatment solution may contain metal salts of polyvalent weak acids such as carbonates, borates and phosphates.

When the pore-widening treatment step is to be performed with an aqueous acid solution, it is preferable to use an aqueous solution of an inorganic acid such as sulfuric acid, phosphoric acid, nitric acid or hydrochloric acid, or a mixture thereof. The aqueous acid solution preferably has a concentration of 1 to 80 wt % and more preferably 5 to 50 wt %.

The aluminum plate is suitably contacted with the aqueous acid solution at 5° C. to 70° C. and preferably 10° C. to 60° C. for 1 to 300 seconds and preferably 1 to 150 seconds.

The aqueous alkali or acid solution may contain aluminum ions. The content of the aluminum ions is not particularly limited and is preferably from 1 to 10 g/L.

[Second Anodizing Treatment Step]

The second anodizing treatment step is a step in which micropores which further extend in the depth direction (thickness direction) of the film are formed by performing anodizing treatment on the aluminum plate having undergone the above-described pore-widening treatment. As shown in FIG. 100, an anodized film 14*c* bearing micropores 16*c* which extend in the depth direction of the film is formed by the second anodizing treatment step.

The second anodizing treatment step forms new pores which communicate with the bottoms of the micropores 16*b* with the increased average diameter, have a smaller average diameter than that of the micropores 16*b* corresponding to the large-diameter portions 18 and extend from the communication positions in the depth direction. The pores correspond to the above-described small-diameter portions 20.

In the second anodizing treatment step, the treatment is performed so that the newly formed pores have an average diameter of more than 0 but less than 20 nm and a depth from the communication positions with the large-diameter portions 20 within the foregoing specified range. The electrolytic solution used for the treatment is the same as used in the first anodizing treatment step and the treatment conditions are set as appropriate for the materials used.

The anodizing treatment conditions are appropriately set depending on the electrolytic solution employed. However, the following conditions are generally suitable: an electrolyte concentration of from 1 to 80 wt %, a solution temperature of from 5 to 70° C., a current density of from 0.5 to 60 A/dm$^2$, a voltage of from 1 to 100 V, and an electrolysis time of from 1 to 100 seconds. An electrolyte concentration of from 5 to 20 wt %, a solution temperature of from 10 to 60° C., a current density of from 1 to 30 A/dm$^2$, a voltage of from 5 to 50 V, and an electrolysis time of from 5 to 60 seconds are preferred.

The anodized film obtained by the second anodizing treatment step usually has a thickness of 900 to 2,000 nm and preferably 900 to 1,500 nm. At a film thickness within the foregoing range, the lithographic printing plate using the lithographic printing plate support obtained after the foregoing steps has a long press life and excellent deinking ability after suspended printing, and the presensitized plate has excellent on-press developability.

The anodized film obtained by the second anodizing treatment step usually has a coating weight of 2.2 to 5.4 g/m$^2$ and preferably 2.2 to 4.0 g/m$^2$. At a film thickness within the foregoing range, the lithographic printing plate using the lithographic printing plate support obtained after the foregoing steps has a long press life and excellent deinking ability after suspended printing, and the presensitized plate has excellent on-press developability.

The ratio between the thickness of the anodized film obtained by the first anodizing treatment step (first film thickness) and that of the anodized film obtained by the second anodizing treatment step (second film thickness) (first film thickness/second film thickness) is preferably from 0.01 to 0.15 and more preferably from 0.02 to 0.10. At a film thickness ratio within the foregoing range, the lithographic printing plate support has excellent scratch resistance.

In order to obtain the shape of the small-diameter portions 20*a* described above, the voltage applied may be increased stepwise or continuously during the treatment in the second anodizing treatment step. By increasing the applied voltage, the diameter of the pores formed is increased to obtain such a shape as in the small-diameter portions 20*a* described above.

The thickness of the anodized film between the bottoms of the resulting small-diameter portions and the aluminum plate tends to increase by increasing the voltage applied in the second anodizing treatment step. In cases where the anodized film between the bottoms of the small-diameter portions and the aluminum plate has a predetermined thickness as a result of the foregoing treatment, the third anodizing treatment step to be described later may not be performed.

[Third Anodizing Treatment Step]

Figure 10D:
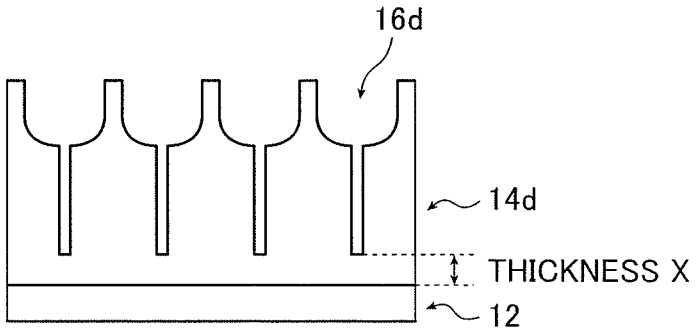

The third anodizing treatment step is a step in which the aluminum plate having undergone the second anodizing treatment is further anodized to mainly increase the thickness of the anodized film located between the bottoms of the small-diameter portions and the aluminum plate (thickness of the barrier layer). As shown in FIG. 10D, the thickness X reaches a predetermined value as a result of the third anodizing treatment step.

In cases where the micropores already have desired shapes at the end of the second anodizing treatment step, the third anodizing treatment step may not be performed as described above.

The anodizing treatment conditions in the third anodizing treatment step are appropriately set depending on the electrolytic solution used but the treatment is usually performed at a higher voltage than that applied in the second anodizing treatment step.

The type of electrolytic solution used is not particularly limited and any of the above-described electrolytic solutions may be used. By using, for example, a boric acid-containing aqueous solution as the electrolytic solution, the thickness X can be efficiently increased without changing the shape of the small-diameter portions obtained in the second anodizing treatment step.

The anodized film obtained by the third anodizing treatment step usually has a coating weight of 0.13 to 0.65 g/m$^2$ and preferably 0.26 to 0.52 g/m$^2$. At a film thickness within the foregoing range, the lithographic printing plate using the lithographic printing plate support obtained after the foregoing steps has a long press life, excellent deinking ability after suspended printing, excellent resistance to dotted scumming, and excellent resistance to white spot formation, and the presensitized plate has excellent on-press developability.

The micropores may further extend in the thickness direction of the anodized film as a result of the third anodizing treatment step.

[Hydrophilizing Treatment Step]

The method of manufacturing the lithographic printing plate support according to the second aspect of the invention may have a hydrophilizing treatment step in which the aluminum plate is hydrophilized after the above-described third anodizing treatment step.

The hydrophilizing treatment step is the same as that performed in the foregoing method of manufacturing the lithographic printing plate support according to the first aspect of the invention and the details are as described above.

On the other hand, the lithographic printing plate supports according to the first and second aspects of the invention are preferably ones obtained by subjecting the foregoing aluminum plates to the treatments shown in the following Aspect A or B in this order and Aspect A is most preferably used in terms of the press life. Rinsing with water is desirably carried out between the respective treatments. However, in cases where a solution of the same composition is used in the consecutively carried out two steps (treatments), rinsing with water may be omitted.

(Aspect A)

(2) Chemical etching treatment in an aqueous alkali solution (first alkali etching treatment);

(3) Chemical etching treatment in an aqueous acid solution (first desmutting treatment);

(4) Electrochemical graining treatment in a nitric acid-based aqueous solution (first electrochemical graining treatment);

(5) Chemical etching treatment in an aqueous alkali solution (second alkali etching treatment);

(6) Chemical etching treatment in an aqueous acid solution (second desmutting treatment);

(7) Electrochemical graining treatment in a hydrochloric acid-based aqueous solution (second electrochemical graining treatment);

(8) Chemical etching treatment in an aqueous alkali solution (third alkali etching treatment);

(9) Chemical etching treatment in an aqueous acid solution (third desmutting treatment);

(10) Anodizing treatments (first anodizing treatment, pore-widening treatment, second anodizing treatment, third anodizing treatment); and

(11) Hydrophilizing treatment.

(Aspect B)

(2) Chemical etching treatment in an aqueous alkali solution (first alkali etching treatment);

(3) Chemical etching treatment in an aqueous acid solution (first desmutting treatment);

(12) Electrochemical graining treatment in a hydrochloric acid-based aqueous solution;

(5) Chemical etching treatment in an aqueous alkali solution (second alkali etching treatment);

(6) Chemical etching treatment in an aqueous acid solution (second desmutting treatment);

(10) Anodizing treatments (first anodizing treatment, pore-widening treatment, second anodizing treatment, third anodizing treatment); and

(11) Hydrophilizing treatment.

The treatment (2) in Aspects A and B may be optionally preceded by (1) mechanical graining treatment. The treatment (1) is preferably not included in both the aspects in terms of the press life or the like.

Mechanical graining treatment, electrochemical graining treatment, chemical etching treatment, anodizing treatment and hydrophilizing treatment in (1) to (12) described above may be carried out by the same treatment methods and conditions as those described above, but the treatment methods and conditions to be described, below are preferably used to carry out such treatments.

Mechanical graining treatment is preferably performed using a rotating nylon brush roll having a bristle diameter of 0.2 to 1.61 mm and a slurry supplied to the surface of the aluminum plate.

Known abrasives may be used and illustrative examples that may be preferably used include silica sand, quartz, aluminum hydroxide and a mixture thereof.

The slurry preferably has a specific gravity of 1.05 to 1.3. Use may be made of a technique that involves spraying of the slurry, a technique that involves the use of a wire brush, or a technique in which the surface shape of a textured mill roll is transferred to the aluminum plate.

The aqueous alkali solution that may be used in chemical etching treatment in the aqueous alkali solution has a concentration of preferably 1 to 30 wt % and may contain aluminum and alloying ingredients present in the aluminum alloy in an amount of 0 to 10 wt %.

An aqueous solution composed mainly of sodium hydroxide is preferably used for the aqueous alkali solution. Chemical etching is preferably carried out at a solution temperature of room temperature to 95° C. for a period of 1 to 120 seconds.

After the end of etching treatment, removal of the treatment solution with nip rollers and rinsing by spraying with water are preferably carried out in order to prevent the treatment solution from being carried into the subsequent step.

In the first alkali etching treatment, the aluminum plate is dissolved in an amount of preferably 0.5 to 30 g/m$^2$, more preferably 1.0 to 20 g/m$^2$, and even more preferably 3.0 to 15 g/m$^2$.

In the second alkali etching treatment, the aluminum plate is dissolved in an amount of preferably 0.001 to 30 g/m$^2$, more preferably 0.1 to 4 g/m$^2$, and even more preferably 0.2 to 1.5 g/m$^2$.

In the third alkali etching treatment, the aluminum plate is dissolved in an amount of preferably 0.001 to 30 g/m$^2$, more preferably 0.01 to 0.8 g/m$^2$, and even more preferably 0.02 to 0.3 g/m$^2$.

In chemical etching treatment in an aqueous acid solution (first to third desmutting treatments), phosphoric acid, nitric acid, sulfuric acid, chromic acid, hydrochloric acid or a mixed acid containing two or more thereof may be advantageously used.

The aqueous acid solution preferably has a concentration of 0.5 to 60 wt %.

Aluminum and alloying ingredients present in the aluminum alloy may dissolve in the aqueous acid solution in an amount of 0 to 5 wt %.

Chemical etching is preferably carried out at a solution temperature of room temperature to 95° C. for a treatment time of 1 to 120 seconds. After the end of desmutting treatment, removal of the treatment solution with nip rollers and rinsing by spraying with water are preferably carried out in order to prevent the treatment solution from being carried into the subsequent step.

The aqueous solution that may be used in electrochemical graining treatment is now described.

An aqueous solution which is used in conventional electrochemical graining treatment involving the use of direct current or alternating current may be employed for the nitric acid-based aqueous solution used in the first electrochemical graining treatment. The aqueous solution to be used may be prepared by adding to an aqueous solution having a nitric acid concentration of 1 to 100 g/L at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation.

Metals which are present in the aluminum alloy, such as iron, copper, manganese, nickel, titanium, magnesium and silicon may also be dissolved in the nitric acid-based aqueous solution.

More specifically, use is preferably made of a solution to which aluminum chloride or aluminum nitrate is added so that a 0.5 to 2 wt % aqueous solution of nitric acid may contain 3 to 50 g/L of aluminum ions.

The temperature is preferably from 10 to 90° C. and more preferably from, 40 to 80° C.

An aqueous solution which is used in conventional electrochemical graining treatment involving the use of direct current or alternating current may be employed for the hydrochloric acid-based aqueous solution used in the second electrochemical graining treatment. The aqueous solution to be used may be prepared by adding to an aqueous solution having a hydrochloric acid concentration of 1 to 100 g/L at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation.

Metals which are present in the aluminum alloy, such as iron, copper, manganese, nickel, titanium, magnesium and silicon may also be dissolved in the hydrochloric acid-based aqueous solution.

More specifically, use is preferably made of a solution to which aluminum chloride or aluminum nitrate is added so that a 0.5 to 2 wt % aqueous solution of hydrochloric acid may contain 3 to 50 g/L of aluminum ions.

The temperature is preferably from 10 to 60° C. and more preferably from 20 to 50° C. Hypochlorous acid may be added to the aqueous solution.

On the other hand, an aqueous solution which is used in conventional electrochemical graining treatment involving the use of direct current or alternating current may be employed for the hydrochloric acid-based aqueous solution used in electrochemical graining treatment in the aqueous hydrochloric acid solution in Aspect B. The aqueous solution to be used may be prepared by adding 0 to 30 g/L of sulfuric acid to an aqueous solution having a hydrochloric acid concentration of 1 to 100 g/L. The aqueous solution may be prepared by adding to this solution at least one nitrate compound containing nitrate ions, such as aluminum nitrate, sodium nitrate or ammonium nitrate, or at least one chloride compound containing chloride ions, such as aluminum chloride, sodium chloride or ammonium chloride in a range of 1 g/L to saturation.

Metals which are present in the aluminum alloy, such as iron, copper, manganese, nickel, titanium, magnesium and silicon may also be dissolved in the hydrochloric acid-based aqueous solution.

More specifically, use is preferably made of a solution to which aluminum chloride or aluminum nitrate is added so that a 0.5 to 2 wt % aqueous solution of nitric acid may contain 3 to 50 g/L of aluminum ions.

The temperature is preferably from 10 to 60° C. and more preferably from 20 to 50° C. Hypochlorous acid may be added to the aqueous solution.

A sinusoidal, square, trapezoidal or triangular waveform may be used as the waveform of the alternating current in electrochemical graining treatment. The frequency is preferably from 0.1 to 250 Hz.

Figure 5:
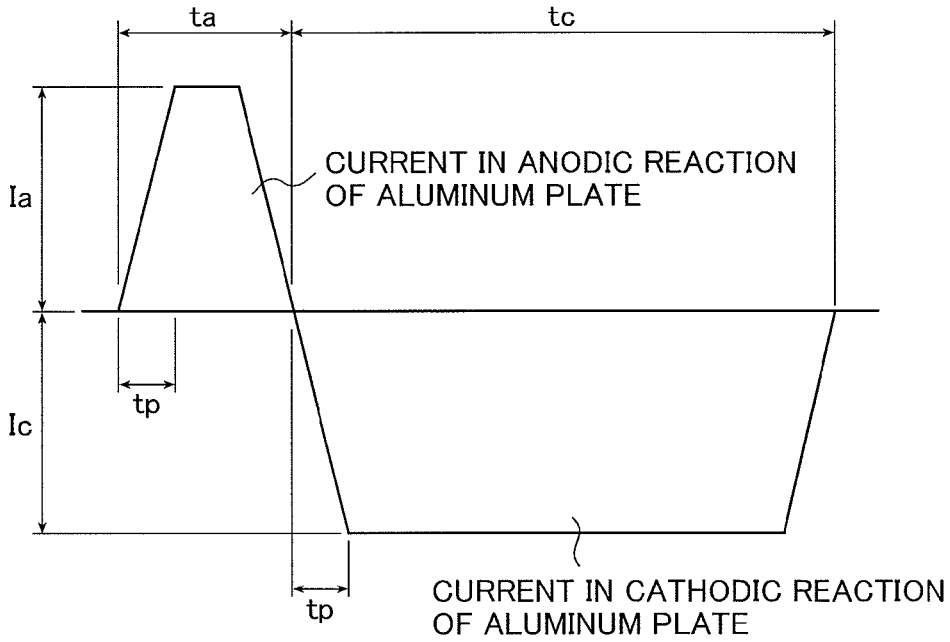
FIG. 5 is a graph showing an example of an alternating current waveform that may be used to carry out electrochemical graining treatment in methods of manufacturing the lithographic printing plate supports according to the first and second aspects of the invention.

FIG. 5 is a graph showing an example of an alternating current waveform that may be used to carry out electrochemical graining treatment in the methods of manufacturing the lithographic printing plate supports according to the first and second aspects of the invention.

In FIG. 5, "ta" represents the anodic reaction time, "tc" the cathodic reaction time, "tp" the time required for the current to reach a peak from zero, "Ia" the peak current on the anode cycle side, and "Ic" the peak current on the cathode cycle side. In the trapezoidal waveform, it is preferable for the time tp until the current reaches a peak from zero to be from 1 to 10 ms. At a time tp of less than 1 ms under the influence of impedance in the power supply circuit, a large power supply voltage is required at the leading edge of the current pulse, thus increasing the power supply equipment costs. At a time tp of more than 10 ms, the aluminum plate tends to be affected by trace ingredients in the electrolytic solution, making it difficult to carry out uniform graining. One cycle of alternating current that may be used in electrochemical graining treatment preferably satisfies the following conditions: the ratio of the cathodic reaction time tc to the anodic reaction time ta in the aluminum plate (tc/ta) is from 1 to 20; the ratio of the amount of electricity Qc when the aluminum plate serves as a cathode to amount of electricity Qa when it serves as an anode (Qc/Qa) is from 0.3 to 20; and the anodic reaction time ta is from 5 to 1,000 ms. The ratio tc/ta is more preferably from 2.5 to 15. The ratio Qc/Qa is more preferably from 2.5 to 15. The current density at the current peak in the trapezoidal waveform is preferably from 10 to 200 A/dm$^2$ on both of the anode cycle side (Ia) and the cathode cycle side (Ic). The ratio Ic/Ia is preferably in a range of 0.3 to 20. The total amount of electricity furnished for the anodic reaction on the aluminum plate up until completion of electrochemical graining treatment is preferably from 25 to 1,000 C/dm$^2$.

In the practice of the invention, any known electrolytic cell employed for surface treatment, including vertical, flat and radial type electrolytic cells, may be used to perform electrochemical graining treatment using alternating current. A radial type electrolytic cell such as the one described in JP 5-195300 A is especially preferred.

Figure 6:
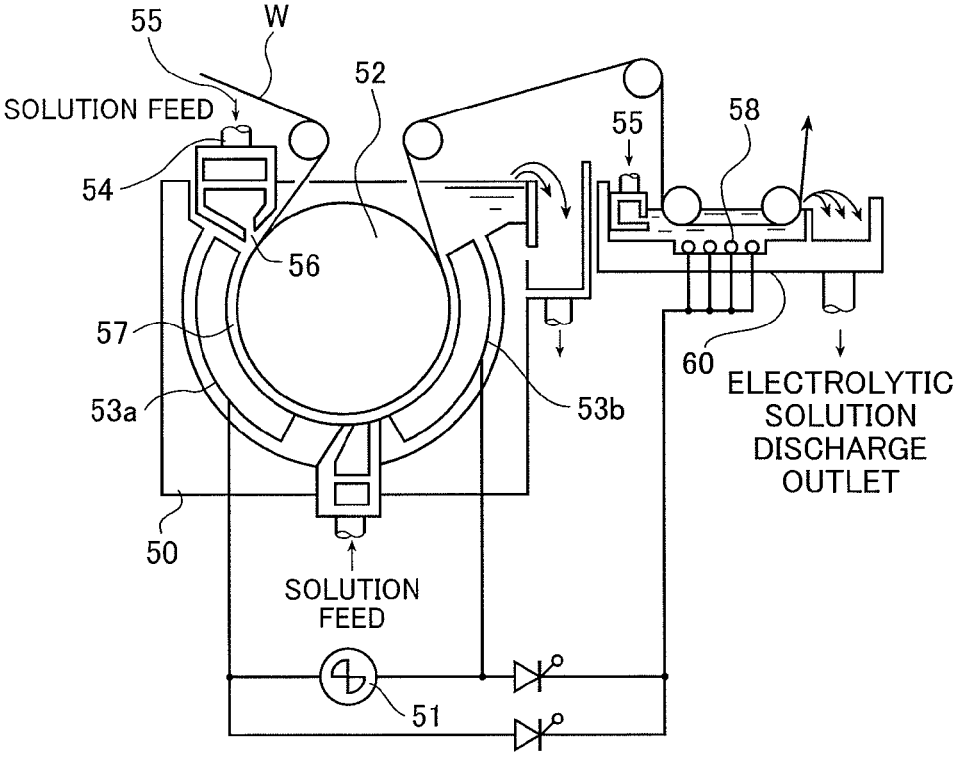
FIG. 6 is a side view of a radial electrolytic cell that may be used in electrochemical graining treatment with alternating current in the methods of manufacturing the lithographic printing plate supports according to the first and second aspects of the invention.

An apparatus shown in FIG. 6 may be used for electrochemical graining treatment using alternating current.

FIG. 6 is a side view of a radial electrolytic cell that may be used in electrochemical graining treatment with alternating current in the methods of manufacturing the lithographic printing plate supports according to the first and second aspects of the invention.

FIG. 6 shows a main electrolytic cell 50, an AC power supply 51, a radial drum roller 52, main electrodes 53*a* and 53*b*, a solution feed, inlet 54, an electrolytic solution 55, a slit 56, an electrolytic solution channel 57, auxiliary anodes 58, an auxiliary anode cell 60 and an aluminum plate W. When two or more electrolytic cells are used, electrolysis may be performed under the same or different conditions.

The aluminum plate W is wound around the radial drum roller 52 disposed so as to be immersed in the electrolytic solution within the main electrolytic cell 50 and is electrolyzed by the main electrodes 53*a* and 53*b* connected to the AC power supply 51 as it travels. The electrolytic solution 55 is fed from the solution feed inlet 54 through the slit 56 to the electrolytic solution channel 57 between the radial drum roller 52 and the main electrodes 53*a* and 53*b*. The aluminum plate W treated in the main electrolytic cell 50 is then electrolyzed in the auxiliary anode cell 60. In the auxiliary anode cell 60, the auxiliary anodes 58 are disposed in a face-to-face relationship with the aluminum plate W so that the electrolytic solution 55 flows through the space between the auxiliary anodes 58 and the aluminum plate W.

On the other hand, electrochemical graining treatments (first and second electrochemical graining treatments) may be performed by a method in which the aluminum plate is electrochemically grained by applying direct current between the aluminum plate and the electrodes opposed thereto.

<Drying Step>

After the lithographic printing plate support is obtained by the above-described steps, a treatment for drying the surface of the support (drying step) is preferably performed before providing an image recording layer to be described later thereon.

Drying is preferably performed after the support having undergone the last surface treatment is rinsed with water and the water removed with nip rollers. Specific conditions are not particularly limited but the surface of the lithographic printing plate support is preferably dried by hot air at 50° C. to 200° C. or natural air.

[Presensitized Plate]

The presensitized plates according to the first and second aspects of the invention can be obtained by forming an image recording layer such as a photosensitive layer or a thermosensitive layer to be illustrated below on the lithographic printing plate supports according to the first and second aspects of the invention. The type of the image recording layer is not particularly limited but conventional positive type, conventional negative type, photopolymer type, thermal positive type, thermal negative type and on-press developable non-treatment type as described in paragraphs [0042] to [0198] of JP 2003-1956 A are preferably used.

A preferred image recording layer is described below in detail.

[Image Recording Layer]

An example of the image recording layer that may be preferably used in the presensitized plates according to the first and second aspects of the invention includes one which can be removed by printing ink and/or fountain solution. More specifically, the image recording layer is preferably one which includes an infrared absorber, a polymerization initiator and a polymerizable compound and is capable of recording by exposure to infrared light.

In the presensitized plates according to the first and second aspects of the invention, irradiation with infrared light cures exposed portions of the image recording layer to form hydrophobic (lipophilic) regions, while at the start of printing, unexposed portions are promptly removed from the support by fountain solution, ink, or an emulsion of ink and fountain solution.

The constituents of the image recording layer are described below.

(Infrared Absorber)

In cases where an image is formed on the presensitized plates according to the first and second aspects of the invention using a laser emitting infrared light at 760 to 1,200 nm as a light source, an infrared absorber is usually used.

The infrared absorber has the function of converting absorbed infrared light into heat and the function of transferring electrons and energy to the polymerization initiator (radical generator) to be described below by excitation with infrared light.

The infrared absorber that may be used in the invention is a dye or pigment having an absorption maximum in a wavelength range of 760 to 1,200 nm.

Dyes which may be used include commercial dyes and known dyes that are mentioned in the technical literature, such as Senryo Binran [Handbook of Dyes] (The Society of Synthetic Organic Chemistry, Japan, 1970).

Illustrative examples of suitable dyes include azo dyes, metal complex azo dyes, pyrazolone azo dyes, naphthoquinone dyes, anthraquinone dyes, phthalocyanine dyes, carbonium dyes, quinoneimine dyes, methine dyes, cyanine dyes, squarylium dyes, pyrylium salts and metal-thiolate complexes. For example, dyes disclosed in paragraphs [0096] to [0107] of JP 2009-255434 A can be advantageously used.

On the other hand, pigments described, for example, in paragraphs [0108] to [0112] of JP 2009-255434 A may be used.

(Polymerization Initiator)

Exemplary polymerization initiators which may be used are compounds that generate a radical under light or heat energy or both, and initiate or promote the polymerization of a compound having a polymerizable unsaturated group. In the invention, compounds that generate a radical under the action of heat (thermal radical generator) are preferably used.

Known thermal polymerization initiators, compounds having a bond with small bond dissociation energy and photopolymerization initiators may be used as the polymerization initiator.

For example, polymerization initiators described in paragraphs [0115] to [0141] of JP 2009-255434 A may be used.

Onium salts may be used for the polymerization initiator, and oxime ester compounds, diazonium salts, iodonium salts and sulfonium salts are preferred in terms of reactivity and stability.

These polymerization initiators may be added in an amount of 0.1 to 50 wt %, preferably 0.5 to 30 wt % and most preferably 1 to 20 wt % with respect to the total solids making up the image recording layer. An excellent sensitivity and a high resistance to scumming in non-image areas during printing are achieved at a polymerization initiator content within the above-defined range.

(Polymerizable Compound)

Polymerizable compounds are addition polymerizable compounds having at least one ethylenically unsaturated double bond, and are selected from compounds having at least one, and preferably two or more, terminal ethylenically unsaturated bonds. In the invention, use can be made of any addition polymerizable compound known in the prior art, without particular limitation.

For example, polymerizable compounds described in paragraphs [0142] to [0163] of JP 2009-255434 A may be used.

Urethane-type addition polymerizable compounds prepared using an addition reaction between an isocyanate group and a hydroxyl group are also suitable. Specific examples include the vinylurethane compounds having two or more polymerizable vinyl groups per molecule that are obtained by adding a hydroxyl group-bearing vinyl monomer of the general formula (A) below to the polyisocyanate compounds having two or more isocyanate groups per molecule mentioned in JP 48-41708 B.

$$CH_2{=}C(R^4)COOCH_2CH(R^5)OH \quad (A)$$

(wherein $R^4$ and $R^5$ are each independently H or $CH_3$.)

The polymerizable compound is used in an amount of preferably 5 to 80 wt %, and more preferably 25 to 75 wt % with respect to the nonvolatile ingredients in the image recording layer. These addition polymerizable compounds may be used singly or in combination of two or more thereof.

(Binder Polymer)

In the practice of the invention, use may be made of a binder polymer in the image recording layer in order to improve the film forming properties of the image recording layer.

Conventionally known binder polymers may be used without any particular limitation and polymers having film forming properties are preferred. Examples of such binder polymers include acrylic resins, polyvinyl acetal resins, polyurethane resins, polyurea resins, polyimide resins, polyamide resins, epoxy resins, methacrylic resins, polystyrene resins, novolac phenolic resins, polyester resins, synthetic rubbers and natural rubbers.

Crosslinkability may be imparted to the binder polymer to enhance the film strength in image areas. To impart crosslinkability to the binder polymer, a crosslinkable functional group such as an ethylenically unsaturated bond may be introduced into the polymer main chain or side chain. The crosslinkable functional groups may be introduced by copolymerization.

Binder polymers disclosed in paragraphs [0165] to [0172] of JP 2009-255434 A may also be used.

The content of the binder polymer is from 5 to 90 wt %, preferably from 5 to 80 wt % and more preferably from 10 to 70 wt % based on all the solid ingredients of the image recording layer. A high strength in image areas and good image forming properties are achieved at a binder polymer content within the above-defined range.

The polymerizable compound and the binder polymer are preferably used at a weight ratio of 0.5/1 to 4/1.

(Surfactant)

A surfactant is preferably used in the image recording layer in order to promote the on-press developability at the start of printing and improve the coated surface state.

Exemplary surfactants include nonionic surfactants, anionic surfactants, cationic surfactants, amphoteric surfactants and fluorochemical surfactants.

For example, surfactants disclosed in paragraphs [0175] to [0179] of JP 2009-255434 A may be used.

Use may be made of a single surfactant or of a combination of two or more surfactants.

The content of the surfactant is preferably from 0.001 to 10 wt %, and more preferably from 0.01 to 5 wt % with respect to the total solids in the image recording layer.

Various other compounds than those mentioned above may optionally be added to the image recording layer. For example, compounds disclosed in paragraphs [0181] to [0190] of JP 2009-255434 A such as colorants, printing-out agents, polymerization inhibitors, higher fatty acid derivatives, plasticizers, inorganic fine particles and low-molecular-weight hydrophilic compounds may be used.

An embodiment other than that described above is also possible in which a photopolymer-type photosensitive composition containing an addition-polymerizable compound, a photopolymerization initiator and a polymer binder is used to prepare the image recording layer.

Preferred addition-polymerizable compounds include compounds containing an ethylenically unsaturated bond which are addition-polymerizable. Ethylenically unsaturated bond-containing compounds are compounds which have a terminal ethylenically unsaturated bond.

Any of various photopolymerization initiators or a combination system of two or more thereof may be appropriately selected depending on the wavelength of the light source used and employed.

[Formation of Image Recording Layer]

The image recording layer is formed by dispersing or dissolving the necessary ingredients described above in a solvent to prepare a coating liquid and applying the thus prepared coating liquid to the support. Examples of the solvent that may be used include, but are not limited to, ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate and water.

These solvents may be used alone or as mixtures of two or more thereof. The coating liquid has a solids concentration of preferably 1 to 50 wt %.

The image recording layer coating weight (solids content) on the support obtained after coating and drying varies depending on the intended application, although an amount of 0.3 to 3.0 g/m$^2$ is generally preferred. At an image recording layer coating weight within this range, a good sensitivity and good image recording layer film properties are obtained.

Examples of suitable methods of coating include bar coating, spin coating, spray coating, curtain coating, dip coating, air knife coating, blade coating and roll coating.

[Undercoat]

In the presensitized plates according to the first and second aspects of the invention, it is desirable to provide an undercoat between the image recording layer and the lithographic printing plate support.

The undercoat preferably contains a polymer having a substrate adsorbable group, a polymerizable group and a hydrophilic group.

An example of the polymer having a substrate adsorbable group, a polymerizable group and a hydrophilic group includes an undercoating polymer resin obtained by copolymerizing an adsorbable group-bearing monomer, a hydrophilic group-bearing monomer and a polymerizable reactive group (crosslinkable group)-bearing, monomer.

Monomers described in paragraphs [0197] to [0210] of JP 2009-255434 A may be used for the undercoating polymer resin.

Various known methods may be used to apply the undercoat-forming coating liquid containing the constituents of the undercoat to the support. Examples of suitable methods of coating include bar coating, spin coating, spray coating, curtain coating, dip coating, air knife coating, blade coating and roll coating.

The coating weight (solids content) of the undercoat is preferably from 0.1 to 100 mg/m$^2$ and more preferably from 1 to 50 mg/m$^2$.

[Protective Layer]

In the presensitized plates according to the first and second aspects of the invention, a protective layer may optionally be formed on the image recording layer to prevent scuffing and other damage to the image recording layer, to serve as an oxygen barrier, and to prevent ablation during exposure to a high-intensity laser.

The protective layer has heretofore been variously studied and is described in detail in, for example, U.S. Pat. No. 3,458,311 and JP 55-49729 B.

Exemplary materials that may be used for the protective layer include those described in paragraphs [0213] to [0227] of JP 2009-255434 A (e.g., water-soluble polymer compounds and inorganic layered compounds).

The thus prepared protective layer-forming coating liquid is applied onto the image recording layer provided on the support and dried to form the protective layer. The coating solvent may be selected as appropriate in connection with the binder, but distilled water and purified water are preferably used in cases where a water-soluble polymer is employed. Examples of the coating method used to form the protective layer include, but are not limited to, blade coating, air knife coating, gravure coating, roll coating, spray coating, dip coating and bar coating.

The coating weight after drying of the protective layer is preferably from 0.01 to 10 g/m$^2$, more preferably from 0.02 to 3 g/m$^2$, and most preferably from 0.02 to 1 g/m$^2$.

The presensitized plate according to the first aspect of the invention which has the image recording layer as described above exhibits excellent deinking ability after suspended printing and a long press life in the lithographic printing plate formed therefrom and exhibits improved on-press developability in the case of an on-press development type.

The presensitized plate according to the second aspect of the invention which has the image recording layer as described above exhibits excellent deinking ability after suspended printing, a long press life, excellent resistance to dotted scumming and excellent resistance to white spot formation in the lithographic printing plate formed therefrom and exhibits improved on-press developability in the case of an on-press development type.

EXAMPLES

[First Aspect]

The first aspect of the invention is described below in detail by way of examples concerning the first aspect. However, the first aspect of the invention should not be construed as being limited to the following examples.

[Manufacture of Lithographic Printing Plate Support]

Aluminum alloy plates of material type 1S with a thickness of 0.3 mm were subjected to the treatments (a) to (n) to manufacture lithographic printing plate supports. Rinsing treatment was carried out among all the treatment steps and the water after rinsing treatment was removed with nip rollers.

(a) Mechanical Graining Treatment (Brush Graining)

Figure 7:
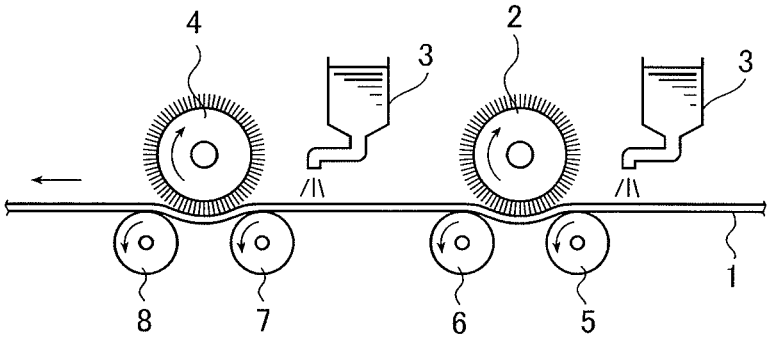
FIG. 7 is a side view illustrating the concept of a brush graining step that may be used to carry out mechanical graining treatment in the manufacture of the lithographic printing plate supports according to the first and second aspects of the invention.

Mechanical graining treatment was performed with rotating bristle bundle brushes of an apparatus as shown in FIG. 7 while feeding an abrasive slurry in the form of a suspension of pumice having a specific gravity of 1.1 g/cm$^3$ to the surface of the aluminum plate. FIG. 7 shows an aluminum plate 1, roller-type brushes (bristle bundle brushes in Examples) 2 and 4, an abrasive slurry 3, and support rollers 5, 6, 7 and 8.

Mechanical graining treatment was carried out using an abrasive having a median diameter of 30 μm while rotating four brushes at 250 rpm. The bristle bundle brushes were made of nylon 6/10 and had a bristle diameter of 0.3 mm and a bristle length of 50 mm. Each brush was constructed of a 300 mm diameter stainless steel cylinder in which holes had been formed and bristles densely set. Two support rollers (200 mm diameter) were provided below each bristle bundle brush and spaced 300 mm apart. The bundle bristle brushes were pressed against the aluminum plate until the load on the driving motor that rotates the brushes was greater by 10 kW than before the bundle bristle brushes were pressed against the plate. The direction in which the brushes were rotated was the same as the direction in which the aluminum alloy plate was moved.

(b) Alkali Etching Treatment

Etching treatment was performed by using a spray line to spray the aluminum plate obtained as described above with an aqueous solution having a sodium hydroxide concentration of 26 wt %, an aluminum ion concentration of 6.5 wt %, and a temperature of 70° C. The plate was then rinsed by spraying with water. The amount of dissolved aluminum was 10 g/m$^2$.

(c) Desmutting Treatment in Aqueous Acid Solution

Next, desmutting treatment was carried out in an aqueous nitric acid solution. The nitric acid used in the subsequent electrochemical graining treatment step was used for the aqueous nitric acid solution in desmutting treatment. The solution temperature was 35° C. Desmutting treatment was carried out by spraying the plate with the desmutting solution for 3 seconds.

(d) Electrochemical Graining Treatment

Electrochemical graining treatment was consecutively carried out by nitric acid electrolysis using a 60 Hz AC voltage. Aluminum nitrate was added to an aqueous solution containing 10.4 g/L of nitric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 5 and electrochemical graining treatment was performed for a period of time tp until the current reached a peak from zero of 0.8 ms, at a duty ratio of 1:1, using an alternating current having a trapezoidal waveform, and a carbon electrode as the counter electrode. A ferrite was used for the auxiliary anodes. An electrolytic cell of the type shown in FIG. 6 was used. The current density at the current peak was 30 A/dm$^2$. Of the current that flows from the power supply, 5% was diverted to the auxiliary anodes. The amount of electricity (C/dm$^2$), which is the total amount of electricity when the aluminum plate serves as an anode, was 185 C/dm$^2$. The plate was then rinsed by spraying with water.

(e) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.5 g/m$^2$.

(f) Desmutting Treatment in Aqueous Acid Solution

Next, desmutting treatment was performed in an aqueous sulfuric acid solution. The aqueous sulfuric acid solution used in desmutting treatment was a solution having a sulfuric acid concentration of 170 g/L and an aluminum ion concentration of 5 g/L. The solution temperature was 60° C. Desmutting treatment was performed by spraying the plate with the desmutting solution for 3 seconds.

(g) Electrochemical Graining Treatment

Electrochemical graining treatment was consecutively carried out by hydrochloric acid electrolysis using a 60 Hz AC voltage. Aluminum chloride was added to an aqueous solution containing 6.2 g/L of hydrochloric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 5 and electrochemical graining treatment was performed for a period of time tp until the current reached a peak from zero of 0.8 ms, at a duty ratio of 1:1, using an alternating current having a trapezoidal waveform, and a carbon electrode as the counter electrode. A ferrite was used for the auxiliary anodes. An electrolytic cell of the type shown in FIG. 6 was used. The current density at the current peak was 25 A/dm$^2$. The amount of electricity (C/dm$^2$) in hydrochloric acid electrolysis, which is the total amount of electricity when the aluminum plate serves as an anode, was 63 C/dm$^2$. The plate was then rinsed by spraying with water.

(h) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.1 g/m$^2$.

(i) Desmutting Treatment in Aqueous Acid Solution

Next, desmutting treatment was performed in an aqueous sulfuric acid solution. More specifically, an aqueous sulfuric acid solution for use in the anodizing treatment step (aqueous solution containing 170 g/L of sulfuric acid and 5 g/L of aluminum ions dissolved therein) was used to perform desmutting treatment at a solution temperature of 35° C. for 4 seconds. Desmutting treatment was performed by spraying the plate with the desmutting solution for 3 seconds.

(j) First Anodizing Treatment

Figure 8:
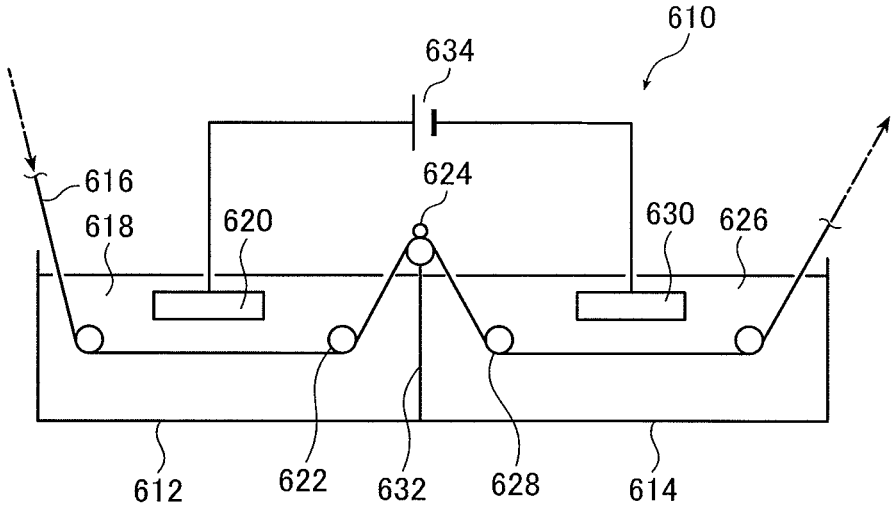
FIG. 8 is a schematic view of an anodizing apparatus that may be used to carry out anodizing treatment in the manufacture of the lithographic printing plate supports according to the first and second aspects of the invention.

The first anodizing treatment was performed by DC electrolysis using an anodizing apparatus of the structure as shown in FIG. 8. The anodizing treatment was performed under the conditions shown in Table 1 to form the anodized film with a specified film thickness. The electrolytic solution used is an aqueous solution containing the ingredients shown in Table 1.

In an anodizing apparatus 610, an aluminum plate 616 is transported as shown by arrows in FIG. 8. The aluminum plate 616 is positively (+) charged by a power supply electrode 620 in a power supply cell 612 containing an electrolytic solution 618. The aluminum plate 616 is then transported upward by a roller 622 disposed in the power supply cell 612, turned downward on a nip roller 624 and transported toward an electrolytic cell 614 containing an electrolytic solution 626 to be turned to a horizontal direction by a roller 628. Then, the aluminum plate 616 is negatively (−) charged by an electrolytic electrode 630 to form an anodized film on the plate surface. The aluminum plate 616 emerging from the electrolytic cell 614 is then transported to the section for the subsequent step. In the anodizing apparatus 610, the roller 622, the nip roller 624 and the roller 628 constitute direction changing means, and the aluminum plate 616 is transported through the power supply cell 612 and the electrolytic cell 614 in a mountain shape and a reversed U shape by means of these rollers 622, 624 and 628. The power supply electrode 620 and the electrolytic electrode 630 are connected to a DC power supply 634.

(k) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 1. The plate was then rinsed by spraying with water.

This treatment was not performed in Examples A-1 to 6, A-13 to 14 and A-17 to 19 and Comparative Examples A-1 and A-3 to 9.

(1) Second Anodizing Treatment

The second anodizing treatment was performed by DC electrolysis using an anodizing apparatus of the structure as shown in FIG. 8. The anodizing treatment was performed under the conditions shown in Table 1 to form the anodized film with a specified film thickness.

The electrolytic solution used is an aqueous solution containing the ingredients shown in Table 1.

(m) Third Anodizing Treatment

The third anodizing treatment was performed by DC electrolysis using an anodizing apparatus of the structure as shown in FIG. 8. The anodizing treatment was performed under the conditions shown in Table 1 to form the anodized film with a specified film thickness. The electrolytic solution used is an aqueous solution containing the ingredients shown in Table 1.

This treatment was performed in Examples A-4 to 20 and Comparative Examples A-1 to 9.

(n) Silicate Treatment

In order to ensure the hydrophilicity in non-image areas, silicate treatment was performed by dipping the plate into an aqueous solution containing 2.5 wt % of No. 3 sodium silicate at 50° C. for 7 seconds. The amount of deposited silicon was 8.5 mg/m$^2$. The plate was then rinsed by spraying with water.

The average diameter at the anodized film surface of the large-diameter portions in the micropore-bearing anodized film obtained after the second anodizing treatment step (or the third anodizing treatment step) (large-diameter portion diameter), the communication position average diameter of the small-diameter portions (small-diameter portion diameter), the depths of the large-diameter portions and small-diameter portions, the thickness of the anodized film between the bottoms of the small-diameter portions and the surface of the aluminum plate (thickness of the barrier layer), the shapes of the large-diameter portions and small-diameter portions, the density of the small-diameter portions and the ratio of the small-diameter portion diameter to the large-diameter portion diameter are all shown in Table 2.

The average diameters of the micropores (average diameter of the large-diameter portions and that of the small-diameter portions) were determined as follows: The anodized film showing the aperture surfaces of the large-diameter portions and those of the small-diameter portions was taken by FE-SEM at a magnification of 150,000× to obtain four images, and in the resulting four images, the diameter of the micropores, that is, the diameter of the large-diameter portions and that of the small-diameter portions were measured within an area of 400×600 nm$^2$ and the average of the measurements was calculated. When it was difficult to measure the diameter of the small-diameter portions because of the large depth of the large-diameter portions, the upper portion of the anodized film was cut out to determine the various diameters.

The depths of the micropores, that is, the depth of the large-diameter portions and that of the small-diameter portions were determined as follows: The cross-sectional surface of the support (anodized film) was taken by FE-SEM at a magnification of 150,000× to observe the depth of the large-diameter portions and a magnification of 50,000× to observe the depth of the small-diameter portions, and in the resulting images, the depth of arbitrarily selected 25 micropores were measured for each of the large-diameter portions and small-diameter portions and the average of the measurements was calculated.

The electrolytic solution used in each step is an aqueous solution containing the ingredients shown in Table 1. In Table 1, hyphen (-) indicates that the treatment concerned was not performed. In Table 1, "Conc." refers to a concentration (g/L) of each ingredient shown in the column of "Solution."

In Table 2, "Communicating portion density" refers to a density of small-diameter portions in the cross section of the anodized film at the communication position C between the small-diameter portions and the large-diameter portions. "Central portion density" refers to a density of the small-diameter portions in the cross-section of the anodized film cut at the central position (corresponding to the central position P in FIG. 1) in the depth direction of the small-diameter portions (in the thickness direction of the anodized film). "Shape" in the column of Large-diameter portion refers to the shape of the large-diameter portions. The substantially straight tubular shape is denoted by "straight tubular" and cases where the pore diameter increases from the surface of the anodized film toward the aluminum plate side (substantially conical shape) are denoted by "conical." "Shape" in the column of Small-diameter portion refers to the shape of the small-diameter portions. Cases where the small-diameter portions have branching points are denoted by "dendritic" and cases where the small-diameter portions have no branching point but are in a substantially straight tubular shape are denoted by "straight tubular."

In cases where the large-diameter portions are conical, the average diameter of the large-diameter portions at the surface of the anodized film (large-diameter portion diameter) corresponds to the surface layer average diameter.

TABLE 1

| | First anodizing treatment | | | | | | Pore-widening treatment | | | | |
|---|---|---|---|---|---|---|---|---|---|---|---|
| | Solution type | Solution | Conc. (g/l) | Temp. (° C.) | Current density (A/dm$^2$) | Film thickness (nm) | Solution type | Solution | Conc. (wt %) | Temp. (° C.) | Time (s) |
| EX A-1 | Sulfuric acid | $H_2SO_4$/Al | 170/7 | 43 | 30 | 55 | — | — | — | — | — |
| EX A-2 | Sulfuric acid | $H_2SO_4$/Al | 170/7 | 43 | 30 | 55 | — | — | — | — | — |
| EX A-3 | Sulfuric acid | $H_2SO_4$/Al | 170/7 | 43 | 30 | 55 | — | — | — | — | — |
| EX A-4 | Sulfuric acid | $H_2SO_4$/Al | 170/7 | 43 | 30 | 55 | — | — | — | — | — |
| EX A-5 | Sulfuric acid | $H_2SO_4$/Al | 170/7 | 43 | 30 | 55 | — | — | — | — | — |
| EX A-6 | Sulfuric acid | $H_2SO_4$/Al | 170/7 | 43 | 30 | 55 | — | — | — | — | — |
| EX A-7 | Sulfuric acid | $H_2SO_4$/Al | 170/7 | 43 | 30 | 55 | Sodium hydroxide | NaOH/Al | 5/0.5 | 35 | 6 |
| EX A-8 | Sulfuric acid | $H_2SO_4$/Al | 170/7 | 43 | 30 | 55 | Sodium hydroxide | NaOH/Al | 5/0.5 | 35 | 6 |

TABLE 1-continued

| | | | | | | | | | | | |
|---|---|---|---|---|---|---|---|---|---|---|---|
| EX A-9 | Sulfuric acid | $H_2SO_4$/Al | 170/7 | 43 | 30 | 55 | Sodium hydroxide | NaOH/Al | 5/0.5 | 35 | 6 |
| EX A-10 | Sulfuric acid | $H_2SO_4$/Al | 170/7 | 43 | 30 | 55 | Sodium hydroxide | NaOH/Al | 5/0.5 | 35 | 6 |
| EX A-11 | Sulfuric acid | $H_2SO_4$/Al | 170/7 | 43 | 30 | 55 | Sodium hydroxide | NaOH/Al | 5/0.5 | 35 | 6 |
| EX A-12 | Sulfuric acid | $H_2SO_4$/Al | 170/7 | 43 | 30 | 55 | Sodium hydroxide | NaOH/Al | 5/0.5 | 35 | 6 |
| EX A-13 | Sulfuric acid | $H_2SO_4$/Al | 170/7 | 43 | 30 | 10 | — | — | — | — | — |
| EX A-14 | Sulfuric acid | $H_2SO_4$/Al | 170/7 | 43 | 30 | 61 | — | — | — | — | — |
| EX A-15 | Phosphoric acid | $H_3SO_4$/Al | 10/7 | 10 | 2 | 55 | Sodium hydroxide | NaOH/Al | 5/0.5 | 35 | 12 |
| EX A-16 | Phosphoric acid | $H_3SO_4$/Al | 10/7 | 10 | 10 | 55 | Sodium hydroxide | NaOH/Al | 5/0.5 | 35 | 12 |
| EX A-17 | Sulfuric acid | $H_2SO_4$/Al | 170/7 | 43 | 30 | 55 | — | — | — | — | — |
| EX A-18 | Sulfuric acid | $H_2SO_4$/Al | 170/7 | 32 | 55 | 55 | — | — | — | — | — |
| EX A-19 | Phosphoric acid | $H_3SO_4$/Al | 10/7 | 10 | 15 | 55 | — | — | — | — | — |
| EX A-20 | Phosphoric acid | $H_3SO_4$/Al | 10/7 | 10 | 10 | 55 | Sodium hydroxide | NaOH/Al | 5/0.5 | 35 | 20 |
| CE A-1 | Sulfuric acid | $H_2SO_4$/Al | 250/7 | 43 | 30 | 55 | — | — | — | — | — |
| CE A-2 | Phosphoric acid | $H_3SO_4$/Al | 10/7 | 10 | 10 | 55 | Sodium hydroxide | NaOH/Al | 5/0.5 | 35 | 24 |
| CE A-3 | Sulfuric acid | $H_2SO_4$/Al | 170/7 | 32 | 55 | 8 | — | — | — | — | — |
| CE A-4 | Sulfuric acid | $H_2SO_4$/Al | 170/7 | 32 | 90 | 90 | — | — | — | — | — |
| CE A-5 | Sulfuric acid | $H_2SO_4$/Al | 170/7 | 32 | 55 | 170 | — | — | — | — | — |
| CE A-6 | Phosphoric acid | $H_3SO_4$/Al | 10/7 | 5 | 2 | 15 | — | — | — | — | — |
| CE A-7 | Sulfuric acid | $H_2SO_4$/Al | 170/7 | 43 | 30 | 55 | — | — | — | — | — |
| CE A-8 | Sulfuric acid | $H_2SO_4$/Al | 170/7 | 43 | 30 | 55 | — | — | — | — | — |
| CE A-9 | Sulfuric acid | $H_2SO_4$/Al | 250/7 | 32 | 55 | 55 | — | — | — | — | — |
| CE A-10 | Sulfuric acid | $H_2SO_4$ | 170 | 30 | 5 | 308 | 10-second immersion at 30° C. in a solution of 0.1M sodium hydrogen carbonate and 0.1M sodium carbonate adjusted with NaOH to a pH of 13 | | | | |
| CE A-11 | Phosphoric acid | $H_3SO_4$ | 50 | 30 | 1 | 346 | — | — | — | — | — |
| CE A-12 | Oxalic acid | $(COOH)_2$ | 100 | 30 | 1 | 308 | — | — | — | — | — |
| CE A-13 | Sulfuric acid | $H_2SO_4$ | 300 | 60 | 5 | 385 | — | — | — | — | — |
| CE A-14 | Sulfuric acid | $H_2SO_4$ | 50 | 10 | 20 | 385 | — | — | — | — | — |

| | Second anodizing treatment | | | | | | | | |
|---|---|---|---|---|---|---|---|---|---|
| | Solution type | Solution | Conc. (g/l) | Temp. (° C.) | Initial current density ($A/dm^2$) | Final current density ($A/dm^2$) | Scanning time (s) | Scanning waveform | Film thickness (nm) |
| EX A-1 | Sulfuric acid | $H_2SO_4$/Al | 170/7 | 50 | 20 | 15 | 19 | Monotonic decrease | 800 |
| EX A-2 | Sulfuric acid | $H_2SO_4$/Al | 170/7 | 60 | 20 | 15 | 19 | Monotonic decrease | 800 |
| EX A-3 | Sulfuric acid | $H_2SO_4$/Al | 170/7 | 70 | 20 | 5 | 19 | Monotonic decrease | 800 |
| EX A-4 | Sulfuric acid | $H_2SO_4$/Al | 240/7 | 50 | 20 | 19 | 19 | Monotonic decrease | 800 |
| EX A-5 | Sulfuric acid | $H_2SO_4$/Al | 240/7 | 50 | 20 | 10 | 19 | Monotonic decrease | 800 |
| EX A-6 | Sulfuric acid | $H_2SO_4$/Al | 240/7 | 50 | 20 | 5 | 19 | Monotonic decrease | 800 |
| EX A-7 | Sulfuric acid | $H_2SO_4$/Al | 170/7 | 40 | 20 | 19 | 19 | Monotonic decrease | 800 |
| EX A-8 | Sulfuric acid | $H_2SO_4$/Al | 170/7 | 40 | 20 | 10 | 19 | Monotonic decrease | 800 |
| EX A-9 | Sulfuric acid | $H_2SO_4$/Al | 170/7 | 40 | 20 | 5 | 19 | Monotonic decrease | 800 |
| EX A-10 | Sulfuric acid | $H_2SO_4$/Al | 240/7 | 50 | 20 | 19 | 19 | Monotonic decrease | 800 |

TABLE 1-continued

| | | | | | | | | | |
|---|---|---|---|---|---|---|---|---|---|
| EX A-11 | Sulfuric acid | $H_2SO_4$/Al | 240/7 | 50 | 20 | 10 | 19 | Monotonic decrease | 800 |
| EX A-12 | Sulfuric acid | $H_2SO_4$/Al | 240/7 | 50 | 20 | 5 | 19 | Monotonic decrease | 900 |
| EX A-13 | Sulfuric acid | $H_2SO_4$/Al | 240/7 | 50 | 20 | 10 | 19 | Monotonic decrease | 800 |
| EX A-14 | Sulfuric acid | $H_2SO_4$/Al | 240/7 | 50 | 20 | 10 | 19 | Monotonic decrease | 800 |
| EX A-15 | Sulfuric acid | $H_2SO_4$/Al | 240/7 | 50 | 20 | 10 | 19 | Monotonic decrease | 800 |
| EX A-16 | Sulfuric acid | $H_2SO_4$/Al | 240/7 | 50 | 20 | 10 | 19 | Monotonic decrease | 800 |
| EX A-17 | Sulfuric acid | $H_2SO_4$/Al | 500/7 | 70 | 20 | 10 | 19 | Monotonic decrease | 800 |
| EX A-18 | Sulfuric acid | $H_2SO_4$/Al | 170/7 | 60 | 20 | 10 | 39 | Monotonic decrease | 1900 |
| EX A-19 | Sulfuric acid | $H_2SO_4$/Al | 170/7 | 60 | 20 | 15 | 19 | Monotonic decrease | 800 |
| EX A-20 | Sulfuric acid | $H_2SO_4$/Al | 170/7 | 60 | 20 | 15 | 19 | Monotonic decrease | 800 |
| CE A-1 | Sulfuric acid | $H_2SO_4$/Al | 170/7 | 50 | 20 | 15 | 19 | Monotonic decrease | 800 |
| CE A-2 | Sulfuric acid | $H_2SO_4$/Al | 170/7 | 50 | 20 | 15 | 19 | Monotonic decrease | 800 |
| CE A-3 | Sulfuric acid | $H_2SO_4$/Al | 170/7 | 50 | 20 | 15 | 19 | Monotonic decrease | 800 |
| CE A-4 | Sulfuric acid | $H_2SO_4$/Al | 170/7 | 50 | 20 | 15 | 19 | Monotonic decrease | 800 |
| CE A-5 | Sulfuric acid | $H_2SO_4$/Al | 170/7 | 50 | 20 | 15 | 19 | Monotonic decrease | 800 |
| CE A-6 | Sulfuric acid | $H_2SO_4$/Al | 170/7 | 50 | 20 | 15 | 19 | Monotonic decrease | 800 |
| CE A-7 | Sulfuric acid | $H_2SO_4$/Al | 30/7 | 50 | 20 | 15 | 19 | Monotonic decrease | 800 |
| CE A-8 | Sulfuric acid | $H_2SO_4$/Al | 170/7 | 50 | 20 | 15 | 15 | Monotonic decrease | 700 |
| CE A-9 | Sulfuric acid | $H_2SO_4$/Al | 170/7 | 60 | 20 | 15 | 19 | Monotonic decrease | 800 |
| CE A-10 | Sulfuric acid | $H_2SO_4$ | 170 | 30 | 5 | 5 | — | — | 846 |
| CE A-11 | Sulfuric acid | $H_2SO_4$ | 170 | 30 | 1 | 1 | — | — | 654 |
| CE A-12 | Sulfuric acid | $H_2SO_4$ | 170 | 30 | 5 | 5 | — | — | 692 |
| CE A-13 | Sulfuric acid | $H_2SO_4$ | 170 | 30 | 5 | 5 | — | — | 654 |
| CE A-14 | Sulfuric acid | $H_2SO_4$ | 170 | 30 | 5 | 5 | — | — | 654 |

| | Third anodizing treatment | | | | | |
|---|---|---|---|---|---|---|
| | Solution type | Solution | Conc. (g/l) | Temp. (° C.) | Current density (A/dm$^2$) | Film thickness (nm) |
| EX A-1 | — | — | — | — | — | — |
| EX A-2 | — | — | — | — | — | — |
| EX A-3 | — | — | — | — | — | — |
| EX A-4 | Sulfuric acid | $H_2SO_4$/Al | 170/7 | 43 | 20 | 100 |
| EX A-5 | Sulfuric acid | $H_2SO_4$/Al | 170/7 | 43 | 20 | 100 |
| EX A-6 | Sulfuric acid | $H_2SO_4$/Al | 170/7 | 43 | 20 | 100 |
| EX A-7 | Sulfuric acid | $H_2SO_4$/Al | 170/7 | 43 | 20 | 100 |
| EX A-8 | Sulfuric acid | $H_2SO_4$/Al | 170/7 | 43 | 20 | 100 |
| EX A-9 | Sulfuric acid | $H_2SO_4$/Al | 170/7 | 43 | 20 | 100 |
| EX A-10 | Sulfuric acid | $H_2SO_4$/Al | 170/7 | 43 | 20 | 100 |
| EX A-11 | Sulfuric acid | $H_2SO_4$/Al | 170/7 | 43 | 20 | 100 |
| EX A-12 | Sulfuric acid | $H_2SO_4$/Al | 170/7 | 43 | 20 | 100 |
| EX A-13 | Sulfuric acid | $H_2SO_4$/Al | 170/7 | 43 | 20 | 100 |
| EX A-14 | Sulfuric acid | $H_2SO_4$/Al | 170/7 | 43 | 20 | 100 |

TABLE 1-continued

| | | | | | | |
|---|---|---|---|---|---|---|
| EX A-15 | Sulfuric acid | $H_2SO_4$/Al | 170/7 | 43 | 20 | 100 |
| EX A-16 | Sulfuric acid | $H_2SO_4$/Al | 170/7 | 43 | 20 | 100 |
| EX A-17 | Sulfuric acid | $H_2SO_4$/Al | 170/7 | 43 | 20 | 100 |
| EX A-18 | Sulfuric acid | $H_2SO_4$/Al | 170/7 | 43 | 20 | 100 |
| EX A-19 | Sulfuric acid | $H_2SO_4$/Al | 170/7 | 43 | 20 | 100 |
| EX A-20 | Sulfuric acid | $H_2SO_4$/Al | 170/7 | 43 | 20 | 100 |
| CE A-1 | Sulfuric acid | $H_2SO_4$/Al | 170/7 | 43 | 20 | 100 |
| CE A-2 | Sulfuric acid | $H_2SO_4$/Al | 170/7 | 43 | 20 | 100 |
| CE A-3 | Sulfuric acid | $H_2SO_4$/Al | 170/7 | 43 | 20 | 100 |
| CE A-4 | Sulfuric acid | $H_2SO_4$/Al | 170/7 | 43 | 20 | 100 |
| CE A-5 | Sulfuric acid | $H_2SO_4$/Al | 170/7 | 43 | 20 | 100 |
| CE A-6 | Sulfuric acid | $H_2SO_4$/Al | 170/7 | 43 | 20 | 100 |
| CE A-7 | Sulfuric acid | $H_2SO_4$/Al | 170/7 | 43 | 20 | 100 |
| CE A-8 | Sulfuric acid | $H_2SO_4$/Al | 170/7 | 43 | 20 | 100 |
| CE A-9 | Sulfuric acid | $H_2SO_4$/Al | 170/7 | 43 | 20 | 100 |
| CE A-10 | — | — | — | — | — | — |
| CE A-11 | — | — | — | — | — | — |
| CE A-12 | — | — | — | — | — | — |
| CE A-13 | — | — | — | — | — | — |
| CE A-14 | — | — | — | — | — | — |

TABLE 2

| | Micropore | | | | | | | | | | |
|---|---|---|---|---|---|---|---|---|---|---|---|
| | Large-diameter portion | | | | Small-diameter portion | | | | | | Ratio of small- |
| | Average diameter (nm) | Depth (nm) | Depth/ average diameter | Shape | Average diameter (nm) | Depth (nm) | Commu-nicating portion density (pcs/$\mu m^2$) | Central portion density (pcs/$\mu m^2$) | Shape | Barrier layer thickness (nm) | diameter portion/ large-diameter Portion |
| EX A-1 | 16 | 45 | 2.81 | Conical | 13 | 900 | 500 | 600 | Dendritic | 18 | 0.81 |
| EX A-2 | 16 | 45 | 2.81 | Conical | 12 | 900 | 500 | 700 | Dendritic | 16 | 0.75 |
| EX A-3 | 17 | 45 | 2.65 | Conical | 11 | 900 | 500 | 800 | Dendritic | 14 | 0.65 |
| EX A-4 | 13 | 45 | 3.46 | Conical | 10 | 900 | 500 | 900 | Dendritic | 22 | 0.77 |
| EX A-5 | 13 | 45 | 3.46 | Conical | 10 | 900 | 500 | 900 | Dendritic | 22 | 0.77 |
| EX A-6 | 13 | 45 | 3.46 | Conical | 10 | 900 | 500 | 900 | Dendritic | 22 | 0.77 |
| EX A-7 | 25 | 45 | 1.80 | Straight tubular | 12 | 900 | 500 | 600 | Dendritic | 22 | 0.48 |
| EX A-8 | 25 | 45 | 1.80 | Straight tubular | 12 | 900 | 500 | 600 | Dendritic | 22 | 0.48 |
| EX A-9 | 25 | 45 | 1.80 | Straight tubular | 12 | 900 | 500 | 600 | Dendritic | 22 | 0.48 |
| EX A-10 | 25 | 45 | 1.80 | Straight tubular | 10 | 900 | 500 | 900 | Dendritic | 22 | 0.40 |
| EX A-11 | 25 | 45 | 1.80 | Straight tubular | 10 | 900 | 500 | 900 | Dendritic | 22 | 0.40 |
| EX A-12 | 25 | 45 | 1.80 | Straight tubular | 10 | 900 | 500 | 900 | Dendritic | 22 | 0.40 |
| EX A-13 | 12 | 5 | 0.42 | Conical | 10 | 900 | 800 | 900 | Dendritic | 22 | 0.83 |
| EX A-14 | 15 | 55 | 3.67 | Conical | 10 | 900 | 500 | 900 | Dendritic | 22 | 0.67 |
| EX A-15 | 90 | 45 | 0.50 | Straight tubular | 10 | 900 | 200 | 900 | Dendritic | 22 | 0.11 |
| EX A-16 | 50 | 45 | 0.90 | Straight tubular | 10 | 900 | 200 | 900 | Dendritic | 22 | 0.20 |
| EX A-17 | 16 | 45 | 2.81 | Conical | 5 | 900 | 500 | 1800 | Dendritic | 22 | 0.31 |
| EX A-18 | 16 | 45 | 2.81 | Conical | 12 | 1900 | 400 | 600 | Dendritic | 22 | 0.75 |
| EX A-19 | 15 | 45 | 3.00 | Conical | 12 | 900 | 200 | 600 | Dendritic | 22 | 0.80 |
| EX A-20 | 90 | 45 | 0.50 | Straight tubular | 12 | 900 | 200 | 600 | Dendritic | 22 | 0.13 |
| CE A-1 | 9 | 45 | 5.00 | Conical | 12 | 900 | 500 | 600 | Dendritic | 22 | 1.33 |
| CE A-2 | 105 | 45 | 0.43 | Straight tubular | 12 | 900 | 500 | 600 | Dendritic | 22 | 0.11 |
| CE A-3 | 7 | 3 | 0.43 | Conical | 12 | 900 | 500 | 600 | Dendritic | 22 | 1.71 |
| CE A-4 | 16 | 70 | 4.38 | Conical | 12 | 900 | 500 | 600 | Dendritic | 22 | 0.75 |
| CE A-5 | 16 | 155 | 9.69 | Conical | 12 | 900 | 500 | 600 | Dendritic | 22 | 0.75 |
| CE A-6 | 65 | 5 | 0.08 | Conical | 12 | 900 | 200 | 600 | Dendritic | 22 | 0.18 |

TABLE 2-continued

| | Micropore | | | | | | | | | | |
|---|---|---|---|---|---|---|---|---|---|---|---|
| | Large-diameter portion | | | | Small-diameter portion | | | | | | Ratio of small- |
| | Average diameter (nm) | Depth (nm) | Depth/ average diameter | Shape | Average diameter (nm) | Depth (nm) | Communicating portion density (pcs/μm$^2$) | Central portion density (pcs/μm$^2$) | Shape | Barrier layer thickness (nm) | diameter portion/ large-diameter Portion |
| CE A-7 | 16 | 45 | 2.81 | Conical | 21 | 900 | 500 | 520 | Dendritic | 22 | 1.31 |
| CE A-8 | 16 | 45 | 2.81 | Conical | 12 | 750 | 500 | 600 | Dendritic | 22 | 0.75 |
| CE A-9 | 13 | 45 | 3.46 | Conical | 12 | 900 | 550 | 600 | Dendritic | 22 | 0.92 |
| CE A-10 | 17 | 268 | 15.76 | Straight tubular | 8 | 836 | 3500 | 3500 | Straight tubular | 12 | 0.47 |
| CE A-11 | 40 | 301 | 7.53 | Straight tubular | 5 | 649 | 800 | 800 | Straight tubular | 55 | 0.13 |
| CE A-12 | 20 | 268 | 13.40 | Straight tubular | 8 | 682 | 900 | 900 | Straight tubular | 45 | 0.40 |
| CE A-13 | 16 | 380 | 23.75 | Straight tubular | 8 | 644 | 5000 | 5000 | Straight tubular | 5 | 0.50 |
| CE A-14 | 15 | 345 | 23.00 | Straight tubular | 8 | 644 | 25 | 25 | Straight tubular | 40 | 0.53 |

In Examples A-1 to 20, micropores having specified average diameters and depths were formed in the anodized aluminum film.

The manufacturing conditions in Comparative Examples A-10 to 14 are the same as those in Examples A-1 to 5 described in paragraph [0136] of JP 11-291657 A. In Comparative Examples A-10 to 14, micropores each having a small-diameter portion in a substantially straight tubular shape were formed.

[Manufacture of Presensitized Plate]

An undercoat-forming coating liquid of the composition indicated below was applied onto each lithographic printing plate support manufactured as described above to a coating weight after drying of 28 mg/m$^2$ to thereby form an undercoat.

<Undercoat-Forming Coating Liquid>

| | |
|---|---|
| Undercoating compound (1) of the structure shown below | 0.18 g |
| Hydroxyethylimino diacetic acid | 0.10 g |
| Methanol | 55.24 g |
| Water | 6.15 g |

Undercoating compound (1)

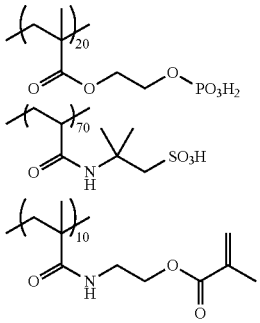

Then, an image recording layer-forming coating liquid was applied onto the thus formed undercoat by bar coating and dried in an oven at 100° C. for 60 seconds to form an image recording layer having a coating weight after drying of 1.3 g/m$^2$.

The image recording layer-forming coating liquid was obtained by mixing with stirring the photosensitive liquid and microgel liquid shown below just before use in application.

<Photosensitive Liquid>

| | |
|---|---|
| Binder polymer (1) [its structure is shown below] | 0.24 g |
| Infrared absorber (1) [its structure is shown below] | 0.030 g |
| Radical polymerization initiator (1) [its structure is shown below] | 0.162 g |
| Polymerizable compound, tris(acryloyloxyethyl)isocyanurate (NK ester A-9300 available from Shin-Nakamura Chemical Corporation) | 0.192 g |
| Low-molecular-weight hydrophilic compound, tris(2-hydroxyethyl)isocyanurate | 0.062 g |
| Low-molecular-weight hydrophilic compound (1) [its structure is shown below] | 0.052 g |
| Sensitizer Phosphonium compound (1) [its structure is shown below] | 0.055 g |
| Sensitizer Benzyl-dimethyl-octyl ammonium · $PF_6$ salt | 0.018 g |
| Betaine derivative (C-1) [its structure is shown below] | 0.010 g |
| Fluorosurfactant (1) (weight-average molecular weight: 10,000) [its structure is shown below] | 0.008 g |
| Methyl ethyl ketone | 1.091 g |
| 1-Methoxy-2-propanol | 8.609 g |

<Microgel Liquid>

| | |
|---|---|
| Microgel (1) | 2.640 g |
| Distilled water | 2.425 g |

The binder polymer (1), the infrared absorber (1), the radical polymerization initiator (1), the phosphonium compound (1), the low-molecular-weight hydrophilic compound (1), the betaine compound (C-1) and the fluorosurfactant (1) have the structures represented by the following formulas:

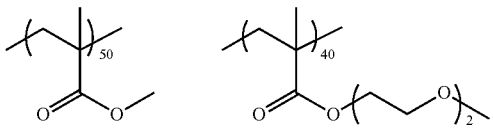

-continued

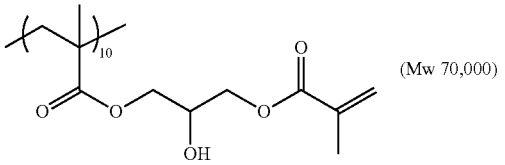

Binder polymer (1)

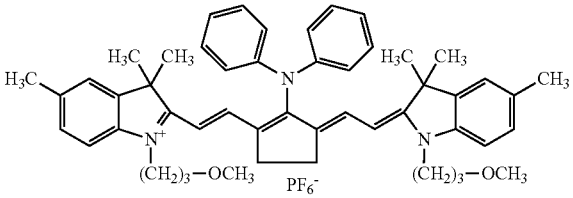

Infrared absorber (1)

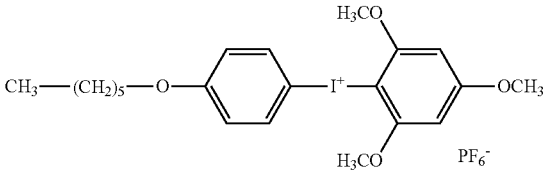

Polymerization initiator (1)

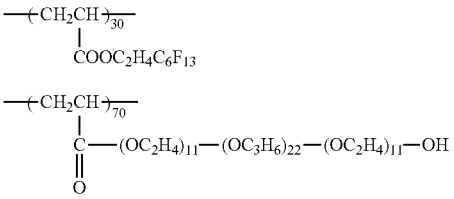

Fluorosurfactant (1)

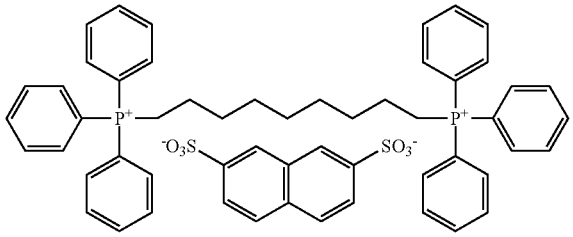

Phosphonium compound (1)

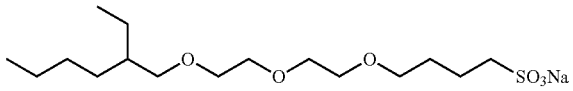

Low-molecular-weight hydrophilic compound (1)

(C-1)

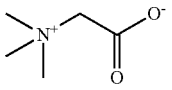

The microgel (1) was synthesized by the following procedure.

<Synthesis of Microgel (1)>

For the oil phase component, 10 g of an adduct of trimethylolpropane with xylene diisocyanate (Takenate D-110N available from Mitsui Takeda Chemicals Inc.), 3.15 g of pentaerythritol triacrylate (SR444 available from Nippon Kayaku Co., Ltd.) and 0.1 g of Pionin A-41C (available from Takemoto Oil & Fat Co., Ltd.) were dissolved in 17 g of ethyl acetate. For the aqueous phase component, 40 g of a 4 wt % aqueous solution of PVA-205 was prepared. The oil phase component and the aqueous phase component were mixed and emulsified in a homogenizer at 12,000 rpm for 10 minutes. The resulting emulsion was added to 25 g of distilled water and the mixture was stirred at room temperature for 30 minutes, then at 50° C. for 3 hours. The thus obtained microgel liquid was diluted with distilled water so as to have a solids concentration of 15 wt % and used as the microgel (1). The average particle size of the microgel as measured by a light scattering method was 0.2 μm.

Then, a protective layer-forming coating liquid of the composition indicated below was applied onto the thus formed image recording layer by bar coating and dried in an oven at 120° C. for 60 seconds to form a protective layer having a coating weight after drying of 0.15 g/m$^2$, thereby obtaining a presensitized plate.

<Protective Layer-Forming Coating Liquid>

| | |
|---|---|
| Dispersion of an inorganic layered compound (1) | 1.5 g |
| 6 wt % Aqueous solution of polyvinyl alcohol (CKS50; modified with sulfonic acid; degree of saponification: at least 99 mol %; degree of polymerization: 300; available from Nippon Synthetic Chemical Industry Co., Ltd.) | 0.55 g |
| 6 wt % Aqueous solution of polyvinyl alcohol (PVA-405; degree of saponification: 81.5 mol %; degree of polymerization: 500; available from Kuraray Co., Ltd.) | 0.03 g |
| 1 wt % Aqueous solution of surfactant (EMALEX 710 available from Nihon Emulsion Co., Ltd.) | 8.60 g |
| Ion exchanged water | 6.0 g |

The dispersion of the inorganic layered compound (1) was prepared by the following procedure.

(Preparation of Dispersion of Inorganic Layered Compound (1))

To 193.6 g of ion-exchanged water was added 6.4 g of synthetic mica Somasif ME-100 (available from Co-Op Chemical Co., Ltd.) and the mixture was dispersed in a homogenizer to an average particle size as measured by a laser scattering method of 3 μm. The resulting dispersed particles had an aspect ratio of at least 100.

[Evaluation of Presensitized Plate]

(On-Press Developability)

The resulting presensitized plate was exposed by Luxel PLATESETTER T-6000III from FUJIFILM Corporation equipped with an infrared semiconductor laser an external drum rotation speed of 1,000 rpm, a laser power of 70% and a resolution of 2,400 dpi. The exposed image was set to contain a solid image and a 50% halftone chart of a 20 μm-dot FM screen.

The resulting presensitized plate after exposure was mounted without a development process on the plate cylinder of a Lithrone 26 press available from Komori Corporation. A fountain solution Ecolity-2 (FUJIFILM Corporation)/tap water at a volume ratio of 2/98 and Values-G (N) black ink (Dainippon Ink & Chemicals, Inc.) were used. The fountain solution and the ink were supplied by the standard automatic printing start-up procedure on the Lithrone 26 to perform on-press development, and 100 impressions were printed on Tokubishi art paper (76.5 kg) at a printing speed of 10,000 impressions per hour.

The on-press developability was evaluated as the number of sheets of printing paper required to reach the state in which no ink is transferred to halftone non-image areas after the completion of the on-press development of the unexposed areas of the 50% halftone chart on the printing press. The on-press developability was rated "very good" when the number of wasted sheets was up to 20, "good" when the number of wasted sheets was from 21 to 30, "fair" when the number of wasted sheets was from 31 to 40, and "poor" when the number of wasted sheets was 41 or more. The results are shown in Table 3. The on-press developability is preferably not rated "poor" for practical use.

(Deinking Ability after Suspended Printing)

Once good impressions were obtained after the end of the on-press development, printing was suspended and the printing plate was left to stand on the printing press for 1 hour in a room at a temperature of 25° C. and a humidity of 50%. Then, printing was resumed and the deinking ability after suspended printing was evaluated as the number of sheets of printing paper required to obtain a good unstained impression. The deinking ability after suspended printing was rated "very good" when the number of wasted sheets was up to 75, "good" when the number of wasted sheets was 76 to 200, "fair" when the number of wasted sheets was 201 to 300 and "poor" when the number of wasted sheets was 301 or more. The results are shown in Table 3. The deinking ability after suspended printing is preferably not rated "poor" for practical use.

(Press Life)

On-press development was performed on the same type of printing press by the same procedure as above and printing was further continued. The press life was evaluated by the number of impressions at the time when the decrease in density of a solid image became visually recognizable. The press life was rated "extremely poor" when the number of impressions was less than 10,000, "very poor" when the number of impressions was at least 10,000 but less than 15,000, "poor" when the number of impressions was at least 15,000 but less than 20,000, "good" when the number of impressions was at least 20,000 but less than 25,000, "very good" when the number of impressions was at least 25,000 but less than 30,000, and "excellent" when the number of impressions was 30,000 or more. The results are shown in Table 3.

The press life is preferably not rated "extremely poor", "very poor" and "poor" for practical use.

(Scratch Resistance)

The surface of the resulting lithographic printing plate support was subjected to a scratch test to evaluate the scratch resistance of the lithographic printing plate support.

The scratch test was performed using a continuous loading scratching intensity tester (SB-53 manufactured by Shinto Scientific Co., Ltd.) while moving a sapphire needle with a diameter of 0.4 mm at a moving velocity of 10 cm/s at a load of 100 g.

As a result, the support in which scratches due to the needle did not reach the surface of the aluminum alloy plate (base) was rated "good" as having excellent scratch resistance and the support in which scratches reached the plate surface was rated "poor." The lithographic printing plate support exhibiting excellent scratch resistance at a load of 100 g can suppress the transfer of scratches to the image recording layer when the presensitized plate prepared therefrom is mounted on the plate cylinder or superposed on another, thus reducing scumming in non-image areas.

TABLE 3

| | Press life | Deinking ability after suspended printing | On-press develop-ability | Scratch resistance |
|---|---|---|---|---|
| EX A-1 | Excellent | Good | Good | Good |
| EX A-2 | Excellent | Very good | Very good | Good |
| EX A-3 | Excellent | Very good | Very good | Good |
| EX A-4 | Excellent | Very good | Very good | Good |
| EX A-5 | Excellent | Very good | Very good | Good |
| EX A-6 | Excellent | Very good | Very good | Good |
| EX A-7 | Excellent | Good | Good | Good |
| EX A-8 | Excellent | Good | Good | Good |
| EX A-9 | Excellent | Good | Good | Good |
| EX A-10 | Excellent | Very good | Very good | Good |
| EX A-11 | Excellent | Very good | Very good | Good |
| EX A-12 | Excellent | Very good | Very good | Good |
| EX A-13 | Good | Good | Good | Good |
| EX A-14 | Excellent | Very good | Very good | Good |
| EX A-15 | Good | Very good | Very good | Good |
| EX A-16 | Good | Very good | Very good | Good |
| EX A-17 | Excellent | Very good | Very good | Good |
| EX A-18 | Excellent | Very good | Very good | Good |
| EX A-19 | Good | Very good | Very good | Good |
| EX A-20 | Good | Very good | Very good | Good |
| CE A-1 | Poor | Good | Good | Good |
| CE A-2 | Good | Poor | Good | Good |
| CE A-3 | Extremely poor | Poor | Poor | Good |
| CE A-4 | Excellent | Poor | Poor | Good |
| CE A-5 | Excellent | Poor | Poor | Good |
| CE A-6 | Very poor | Good | Good | Good |
| CE A-7 | Excellent | Poor | Poor | Good |
| CE A-8 | Very good | Fair | Very good | Poor |
| CE A-9 | Very poor | Poor | Fair | Good |
| CE A-10 | Excellent | Poor | Poor | Poor |
| CE A-11 | Excellent | Poor | Poor | Poor |
| CE A-12 | Excellent | Poor | Poor | Poor |
| CE A-13 | Excellent | Poor | Poor | Poor |
| CE A-14 | Excellent | Poor | Poor | Poor |

Table 3 revealed that in the lithographic printing plates and presensitized plates in Examples A-1 to 20 obtained using the lithographic printing plate supports each having an anodized aluminum film in which micropores having specified average diameters and depths were formed, the press life, deinking ability after suspended printing, on-press developability and scratch resistance were excellent.

The large-diameter portions making up the micropores obtained in Examples A-1 to 6, A-13 to 14 and A-17 to 19 had such a substantially conical shape that the diameter increases from the surface of the anodized film toward the aluminum plate side (i.e., the bottom average diameter was larger than the surface layer average diameter). In these examples, the difference between the bottom average diameter and the surface layer average diameter was about 25 nm.

The large-diameter portions making up the micropores obtained in Examples A-7 to 12, A-15 to 16 and A-20 had a substantially straight tubular shape.

In Examples A-1 to 20, the small-diameter portions had a dendritic shape. In Examples A-4 to 20, the small-diameter portions each had a substantially straight tubular main pore portion and a substantially conical enlarged-diameter portion as shown in FIG. 3. The maximum diameter of the enlarged-diameter portions was larger by about 1 nm to about 8 nm than that of the main pore portions. In addition, the main pore portions accounted for about 90% of the total depth of the small-diameter portions.

On the other hand, the results obtained in Comparative Examples A-1 to 14 which do not meet the average diameters and the depths according to the first aspect of the invention were all inferior to those in Examples A-1 to 20.

Particularly in Comparative Examples A-10 to 14 in which Examples A-1 to 5 specifically disclosed in JP 11-291657 A were performed, the deinking ability after suspended printing, on-press developability and scratch resistance were poor.

(Resistance to Dotted Scumming)

The resulting presensitized plate was conditioned with a slip sheet at 25° C. and 70% RH for 1 hour, wrapped with aluminum kraft paper and heated in an oven set at 60° C. for 10 days.

Then, the temperature was decreased to room temperature. On-press development was performed on the same type of printing press by the same procedure as above and 500 impressions were made. The 500th impression was visually checked and the number per 80 $cm^2$ of print stains with a size of at least 20 μm was counted. The results are shown in Table 3.

The resistance to dotted scumming was rated "very poor" when the number of stains was 250 or more, "poor" when the number of stains was at least 150 but less than 250, and "good" when the number of stains was less than 150.

The resistance to dotted scumming is preferably not rated "very poor" and "poor" for practical use.

The presensitized plates obtained in Examples A-4 to 20 were used to evaluate the resistance to dotted scumming. The presensitized plates in Examples A-4 to 20 were rated "good."

On the other hand, the presensitized plates obtained in Comparative Examples A-10 and A-13 were used to evaluate the resistance to dotted scumming, and were rated "poor" in Comparative Example A-10 and "very poor" in Comparative Example A-13.

[Second Aspect]

The second aspect of the invention is described below in detail by way of examples concerning the second aspect. However, the second aspect of the invention should not be construed as being limited to the following examples.

[Manufacture of Lithographic Printing Plate Support]

Aluminum alloy plates of material type 1S with a thickness of 0.3 mm were subjected to one of the treatments (A) to (F) which is shown in Table 4 to thereby manufacture lithographic printing plate supports. Rinsing treatment was performed among all the treatment steps and the water remaining after rinsing treatment was removed with nip rollers.

[Treatment (A)]

(A-a) Mechanical Graining Treatment (Brush Graining)

Mechanical graining treatment was performed with rotating bristle bundle brushes of an apparatus as shown in FIG. 7 while feeding an abrasive slurry in the form of a suspension of pumice having a specific gravity of 1.1 g/$cm^3$ to the surface of the aluminum plate. FIG. 5 shows an aluminum plate 1, roller-type brushes (bristle bundle brushes in Examples) 2 and 4, an abrasive slurry 3, and support rollers 5, 6, 7 and 8.

Mechanical graining treatment was carried out using an abrasive having a median diameter of 30 μm while rotating four brushes at 250 rpm. The bristle bundle brushes were made of nylon 6/10 and had a bristle diameter of 0.3 mm and a bristle length of 50 mm. Each brush was constructed of a 300 mm diameter stainless steel cylinder in which holes had been formed and bristles densely set. Two support rollers (200 mm diameter) were provided below each bristle bundle brush and spaced 300 mm apart. The bundle bristle brushes were pressed against the aluminum plate until the load on the driving motor that rotates the brushes was greater by 10 kW than before the bundle bristle brushes were pressed against the plate. The direction in which the brushes were rotated was the same as the direction in which the aluminum plate was moved.

(A-b) Alkali Etching Treatment

Etching treatment was performed by using a spray line to spray the aluminum plate obtained as described above with an aqueous solution having a sodium hydroxide concentration of 26 wt %, an aluminum ion concentration of 6.5 wt %, and a temperature of 70° C. The plate was then rinsed by spraying with water. The amount of dissolved aluminum was 10 g/$m^2$.

(A-c) Desmutting Treatment in Aqueous Acid Solution

Next, desmutting treatment was performed in an aqueous nitric acid solution. The nitric acid wastewater from the subsequent electrochemical graining treatment step was used for the aqueous nitric acid solution in desmutting treatment. The solution temperature was 35° C. Desmutting treatment was performed by spraying the plate with the desmutting solution for 3 seconds.

(A-d) Electrochemical Graining Treatment

Electrochemical graining treatment was consecutively carried out by nitric acid electrolysis using a 60 Hz AC voltage. Aluminum nitrate was added to an aqueous solution containing 10.4 g/L of nitric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 5 and electrochemical graining treatment was performed for a period of time tp until the current reached a peak from zero of 0.8 ms, at a duty ratio of 1:1, using an alternating current having a trapezoidal waveform, and a carbon electrode as the counter electrode. A ferrite was used for the auxiliary anodes. An electrolytic cell of the type shown in FIG. 6 was used. The current density at the current peak was 30 A/$dm^2$. Of the current that flows from the power supply, 5% was diverted to the auxiliary anodes. The amount of electricity (C/$dm^2$), which is the total amount of electricity when the aluminum plate serves as an anode, was 185 C/$dm^2$. The plate was then rinsed by spraying with water.

(A-e) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.5 g/$m^2$.

(A-f) Desmutting Treatment in Aqueous Acid Solution

Next, desmutting treatment was performed in an aqueous sulfuric acid solution. The aqueous sulfuric acid solution used in desmutting treatment was a solution having a sulfuric acid concentration of 170 g/L and an aluminum ion concentration of 5 g/L. The solution temperature was 30° C. Desmutting treatment was performed by spraying the plate with the desmutting solution for 3 seconds.

(A-g) Electrochemical Graining Treatment

Electrochemical graining treatment was consecutively carried out by hydrochloric acid electrolysis using a 60 Hz AC voltage. Aluminum chloride was added to an aqueous solution containing 6.2 g/L of hydrochloric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 5 and electrochemical graining treatment was performed for a period of time tp until the current reached a peak from zero of 0.8 ms, at a duty ratio of 1:1, using an alternating current having a trapezoidal waveform, and a carbon electrode as the counter electrode. A ferrite was used for the auxiliary anodes. An electrolytic cell of the type shown in FIG. 6 was used.

The current density at the current peak was 25 A/$dm^2$. The amount of electricity (C/$dm^2$) in hydrochloric acid electrolysis, which is the total amount of electricity when the aluminum plate serves as an anode, was 63 C/$dm^2$. The plate was then rinsed by spraying with water.

(A-h) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.1 g/m$^2$.

(A-i) Desmutting Treatment in Aqueous Acid Solution

Next, desmutting treatment was performed in an aqueous sulfuric acid solution. More specifically, wastewater generated in the anodizing treatment step (aqueous solution containing 170 g/L of sulfuric acid and 5 g/L of aluminum ions dissolved therein) was used to perform desmutting treatment at a solution temperature of 35° C. for 4 seconds. Desmutting treatment was performed by spraying the plate with the desmutting solution for 3 seconds.

(A-j) First Anodizing Treatment

The first anodizing treatment was performed by DC electrolysis using an anodizing apparatus of the structure as shown in FIG. 8. The anodizing treatment was performed under the conditions shown in Table 4 to form the anodized film with a specified film thickness.

(A-k) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 4. The plate was then rinsed by spraying with water.

(A-l) Second Anodizing Treatment

The second anodizing treatment was performed by DC electrolysis using an anodizing apparatus of the structure as shown in FIG. 8. The anodizing treatment was performed under the conditions shown in Table 4 to form the anodized film with a specified film thickness.

(A-m) Third Anodizing Treatment

The third anodizing treatment was performed by DC electrolysis using an anodizing apparatus of the structure as shown in FIG. 8. The anodizing treatment was performed under the conditions shown in Table 4 to form the anodized film with a specified film thickness.

[Treatment (B)]

(B-a) Alkali Etching Treatment

Etching treatment was performed by using a spray line to spray the aluminum plate with an aqueous solution having a sodium hydroxide concentration of 26 wt %, an aluminum ion concentration of 6.5 wt %, and a temperature of 70° C. The plate was then rinsed by spraying with water. The amount of aluminum dissolved from the surface to be subjected to electrochemical graining treatment was 1.0 g/m$^2$.

(B-b) Desmutting Treatment in Aqueous Acid Solution (First Desmutting Treatment)

Next, desmutting treatment was performed in an aqueous acid solution. The aqueous acid solution used in desmutting treatment contained 150 g/L of sulfuric acid. The solution temperature was 30° C. Desmutting treatment was performed by spraying the plate with the desmutting solution for 3 seconds. Then, rinsing treatment was carried out.

(B-c) Electrochemical Graining Treatment in Aqueous Hydrochloric Acid Solution

Next, electrolytic graining treatment was carried out using an alternating current in an electrolytic solution having a hydrochloric acid concentration of 14 g/L, an aluminum ion concentration of 13 g/L and a sulfuric acid concentration of 3 g/L. The electrolytic solution has a temperature of 30° C. Aluminum chloride was added to adjust the aluminum ion concentration.

The alternating current had a sinusoidal waveform whose positive and negative sides were symmetric; the frequency was 50 Hz; the ratio of the anodic reaction time to the cathodic reaction time in one cycle of alternating current was 1/1; and the current density at the current peak in the AC waveform was 75 A/dm$^2$. The total amount of electricity furnished for the anodic reaction on the aluminum plate was 450 C/dm$^2$ and the aluminum plate was electrolyzed four times by respectively applying 125 C/dm$^2$ of electricity at intervals of 4 seconds. A carbon electrode was used as the counter electrode of the aluminum plate. Then, rinsing treatment was carried out.

(B-b) Alkali Etching Treatment

Etching treatment was performed by using a spray line to spray the aluminum plate having undergone electrochemical graining treatment with an aqueous solution having a sodium hydroxide concentration of 5 wt %, an aluminum ion concentration of 0.5 wt %, and a temperature of 35° C. The amount of aluminum dissolved from the surface having undergone electrochemical graining treatment was 0.1 g/m$^2$. Then, rinsing treatment was carried out.

(B-e) Desmutting Treatment in Aqueous Acid Solution

Next, desmutting treatment was performed in an aqueous acid solution. The aqueous acid solution used in desmutting treatment was wastewater generated in the anodizing treatment step (aqueous solution containing 170 g/L of sulfuric acid and 5.0 g/L of aluminum ions dissolved therein). The solution temperature was 30° C. Desmutting treatment was performed by spraying the plate with the desmutting solution for 3 seconds.

(B-f) First Anodizing Treatment

The first anodizing treatment was performed by DC electrolysis using an anodizing apparatus of the structure as shown in FIG. 8. The anodizing treatment was performed under the conditions shown in Table 4 to form the anodized film with a specified film thickness.

(B-g) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 4. The plate was then rinsed by spraying with water.

(B-h) Second Anodizing Treatment

The second anodizing treatment was performed by DC electrolysis using an anodizing apparatus of the structure as shown in FIG. 8. The anodizing treatment was performed under the conditions shown in Table 4 to form the anodized film with a specified film thickness.

(B-i) Third Anodizing Treatment

The third anodizing treatment was performed by DC electrolysis using an anodizing apparatus of the structure as shown in FIG. 8. The anodizing treatment was performed under the conditions shown in Table 4 to form the anodized film with a specified film thickness.

[Treatment (C)]

(C-a) Mechanical Graining Treatment (Brush Graining)

Mechanical graining treatment was performed with rotating bristle bundle brushes of an apparatus as shown in FIG. 7 while feeding an abrasive slurry in the form of a suspension of pumice having a specific gravity of 1.1 g/cm$^3$ to the surface of the aluminum plate.

Mechanical graining treatment was carried out using an abrasive having a median diameter of 30 μm while rotating four brushes at 250 rpm. The bristle bundle brushes were made of nylon 6/10 and had a bristle diameter of 0.3 mm and a bristle length of 50 mm. Each brush was constructed of a 300 mm diameter stainless steel cylinder in which holes had been formed and bristles densely set. Two support rollers (200 mm diameter) were provided below each bristle bundle brush and spaced 300 mm apart. The bundle bristle brushes were pressed against the aluminum plate until the load on the driving motor that rotates the brushes was greater by 10 kW than before the bundle bristle brushes were pressed against the plate. The direction in which the brushes were rotated was the same as the direction in which the aluminum plate was moved.

(C-b) Alkali Etching Treatment

Etching treatment was performed by using a spray line to spray the aluminum plate obtained as described above with an aqueous solution having a sodium hydroxide concentration of 26 wt %, an aluminum ion concentration of 6.5 wt %, and a temperature of 70° C. The plate was then rinsed by spraying with water. The amount of dissolved aluminum was 10 g/m$^2$.

(C-c) Desmutting Treatment in Aqueous Acid Solution

Next, desmutting treatment was performed in an aqueous acid solution. The aqueous acid solution used in desmutting treatment was wastewater generated in the anodizing treatment step (aqueous solution containing 170 g/L of sulfuric acid and 5.0 g/L of aluminum ions dissolved therein). The solution temperature was 30° C. Desmutting treatment was performed by spraying the plate with the desmutting solution for 3 seconds.

(C-d) First Anodizing Treatment

The first anodizing treatment was performed by DC electrolysis using an anodizing apparatus of the structure as shown in FIG. 8. The anodizing treatment was performed under the conditions shown in Table 4 to form the anodized film with a specified film thickness.

(C-e) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 4. The plate was then rinsed by spraying with water.

(C-f) Second Anodizing Treatment

The second anodizing treatment was performed by DC electrolysis using an anodizing apparatus of the structure as shown in FIG. 8. The anodizing treatment was performed under the conditions shown in Table 4 to form the anodized film with a specified film thickness.

(C-g) Third Anodizing Treatment

The third anodizing treatment was performed by DC electrolysis using an anodizing apparatus of the structure as shown in FIG. 8. The anodizing treatment was performed under the conditions shown in Table 4 to form the anodized film with a specified film thickness.

[Treatment (D)]

(D-a) Mechanical Graining Treatment (Brush Graining)

Mechanical graining treatment was performed with rotating bristle bundle brushes of an apparatus as shown in FIG. 7 while feeding an abrasive slurry in the form of a suspension of pumice having a specific gravity of 1.1 g/cm$^3$ to the surface of the aluminum plate.

Mechanical graining treatment was carried out using an abrasive having a median diameter of 30 μm while rotating four brushes at 250 rpm. The bristle bundle brushes were made of nylon 6/10 and had a bristle diameter of 0.3 mm and a bristle length of 50 mm. Each brush was constructed of a 300 mm diameter stainless steel cylinder in which holes had been formed and bristles densely set. Two support rollers (200 mm diameter) were provided below each bristle bundle brush and spaced 300 mm apart. The bundle bristle brushes were pressed against the aluminum plate until the load on the driving motor that rotates the brushes was greater by 10 kW than before the bundle bristle brushes were pressed against the plate. The direction in which the brushes were rotated was the same as the direction in which the aluminum alloy plate was moved.

(D-b) Alkali Etching Treatment

Etching treatment was performed by using a spray line to spray the aluminum plate obtained as described above with an aqueous solution having a sodium hydroxide concentration of 26 wt %, an aluminum ion concentration of 6.5 wt %, and a temperature of 70° C. The plate was then rinsed by spraying with water. The amount of dissolved aluminum was 10 g/m$^2$.

(D-c) Desmutting Treatment in Aqueous Acid Solution

Next, desmutting treatment was performed in an aqueous nitric acid solution. The nitric acid wastewater from the subsequent electrochemical graining treatment step was used for the aqueous nitric acid solution in desmutting treatment. The solution temperature was 35° C. Desmutting treatment was performed by spraying the plate with the desmutting solution for 3 seconds.

(D-d) Electrochemical Graining Treatment

Electrochemical graining treatment was consecutively carried out by nitric acid electrolysis using a 60 Hz AC voltage. Aluminum nitrate was added to an aqueous solution containing 10.4 g/L of nitric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 5 and electrochemical graining treatment was performed for a period of time tp until the current reached a peak from zero of 0.8 ms, at a duty ratio of 1:1, using an alternating current having a trapezoidal waveform, and a carbon electrode as the counter electrode. A ferrite was used for the auxiliary anodes. An electrolytic cell of the type shown in FIG. 6 was used. The current density at the current peak was 30 A/dm$^2$. Of the current that flows from the power supply, 5% was diverted to the auxiliary anodes. The amount of electricity (C/dm$^2$), which is the total amount of electricity when the aluminum plate serves as an anode, was 185 C/dm$^2$. The plate was then rinsed by spraying with water.

(D-e) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.5 g/m$^2$.

(D-f) Desmutting Treatment in Aqueous Acid Solution

Next, desmutting treatment was performed in an aqueous sulfuric acid solution. The aqueous sulfuric acid solution used in desmutting treatment was a solution having a sulfuric acid concentration of 170 g/L and an aluminum ion concentration of 5 g/L. The solution temperature was 30° C. Desmutting treatment was performed by spraying the plate with the desmutting solution for 3 seconds.

(D-g) First Anodizing Treatment

The first anodizing treatment was performed by DC electrolysis using an anodizing apparatus of the structure as shown in FIG. 8. The anodizing, treatment was performed under the conditions shown in Table 4 to form the anodized film with a specified film thickness.

(D-h) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 4. The plate was then rinsed by spraying with water.

(D-i) Second Anodizing Treatment

The second anodizing treatment was performed by DC electrolysis using an anodizing apparatus of the structure as shown in FIG. 8. The anodizing treatment was performed under the conditions shown in Table 4 to form the anodized film with a specified film thickness.

(D-j) Third Anodizing Treatment

The third anodizing treatment was performed by DC electrolysis using an anodizing apparatus of the structure as shown in FIG. 8. The anodizing treatment was performed under the conditions shown in Table 4 to form the anodized film with a specified film thickness.

[Treatment (E)]

(E-a) Alkali Etching Treatment

Etching treatment was performed by using a spray line to spray the aluminum plate with an aqueous solution having a sodium hydroxide concentration of 26 wt %, an aluminum ion concentration of 6.5 wt %, and a temperature of 70° C. The plate was then rinsed by spraying with water. The amount of aluminum dissolved from the surface to be subjected to electrochemical graining treatment was 5 g/m$^2$.

(E-b) Desmutting Treatment in Aqueous Acid Solution

Next, desmutting treatment was performed in an aqueous nitric acid solution. The nitric acid wastewater from the subsequent electrochemical graining treatment step was used for the aqueous nitric acid solution in desmutting treatment. The solution temperature was 35° C. Desmutting treatment was performed by spraying the plate with the desmutting solution for 3 seconds.

(E-c) Electrochemical Graining Treatment

Electrochemical graining treatment was consecutively carried out by nitric acid electrolysis using a 60 Hz AC voltage. Aluminum nitrate was added to an aqueous solution containing 10.4 g/L of nitric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 5 and electrochemical graining treatment was performed for a period of time tp until the current reached a peak from zero of 0.8 ms, at a duty ratio of 1:1, using an alternating current having a trapezoidal waveform, and a carbon electrode as the counter electrode. A ferrite was used for the auxiliary anodes. An electrolytic cell of the type shown in FIG. 6 was used. The current density at the current peak was 30 A/dm$^2$. Of the current that flows from the power supply, 5% was diverted to the auxiliary anodes. The amount of electricity (C/dm$^2$), which is the total amount of electricity when the aluminum plate serves as an anode, was 250 C/dm$^2$. The plate was then rinsed by spraying with water.

(E-d) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.2 g/m$^2$.

(E-e) Desmutting Treatment in Aqueous Acid Solution

Next, wastewater generated in the anodizing treatment step (aqueous solution containing 170 g/L of sulfuric acid and 5 g/L of aluminum ions dissolved therein) was used to perform desmutting treatment at a solution temperature of 35° C. for 4 seconds. Desmutting treatment was performed in the aqueous sulfuric acid solution. Desmutting treatment was performed by spraying the plate with the desmutting solution for 3 seconds.

(E-f) First Anodizing Treatment

The first anodizing treatment was performed by DC electrolysis using an anodizing apparatus of the structure as shown in FIG. 8. The anodizing treatment was performed under the conditions shown in Table 4 to form the anodized film with a specified film thickness.

(E-g) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 4. The plate was then rinsed by spraying with water.

(E-h) Second Anodizing Treatment

The second anodizing treatment was performed by DC electrolysis using an anodizing apparatus of the structure as shown in FIG. 8. The anodizing treatment was performed under the conditions shown in Table 4 to form the anodized film with a specified film thickness.

(E-i) Third Anodizing Treatment

The third anodizing treatment was performed by DC electrolysis using an anodizing apparatus of the structure as shown in FIG. 8. The anodizing treatment was performed under the conditions shown in Table 4 to form the anodized film with a specified film thickness.

[Treatment (F)]

(F-a) Alkali Etching Treatment

Etching treatment was performed by using a spray line to spray the aluminum plate with an aqueous solution having a sodium hydroxide concentration of 26 wt %, an aluminum ion concentration of 6.5 wt %, and a temperature of 70° C. The plate was then rinsed by spraying with water. The amount of aluminum dissolved from the surface to be subjected to electrochemical graining treatment was 5 g/m$^2$.

(F-b) Desmutting Treatment in Aqueous Acid Solution

Next, desmutting treatment was performed in an aqueous nitric acid solution. The nitric acid wastewater from the subsequent electrochemical graining treatment step was used for the aqueous nitric acid solution in desmutting treatment. The solution temperature was 35° C. Desmutting treatment was performed by spraying the plate with the desmutting solution for 3 seconds.

(F-c) Electrochemical Graining Treatment

Electrochemical graining treatment was consecutively carried out by nitric acid electrolysis using a 60 Hz AC voltage. Aluminum nitrate was added to an aqueous solution containing 10.4; g/L of nitric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 5 and electrochemical graining treatment was performed for a period of time tp until the current reached a peak from zero of 0.8 ms, at a duty ratio of 1:1, using an alternating current having a trapezoidal waveform, and a carbon electrode as the counter electrode. A ferrite was used for the auxiliary anodes. An electrolytic cell of the type shown in FIG. 6 was used. The current density at the current peak was 30 A/dm$^2$. Of the current that flows from the power supply, 5% was diverted to the auxiliary anodes. The amount of electricity (C/dm$^2$), which is the total amount of electricity when the aluminum plate serves as an anode, was 250 C/dm$^2$. The plate was then rinsed by spraying with water.

(F-d) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.2 g/m$^2$.

(F-g) Desmutting Treatment in Aqueous Acid Solution

Next, desmutting treatment was performed in an aqueous sulfuric acid solution. The aqueous sulfuric acid solution used in desmutting treatment was a solution having a sulfuric acid concentration of 170 g/L and an aluminum ion concentration of 5 g/L. The solution temperature was 30° C. Desmutting treatment was performed by spraying the plate with the desmutting solution for 3 seconds.

(F-h) Electrochemical Graining Treatment

Electrochemical graining treatment was consecutively carried out by hydrochloric acid electrolysis using a 60 Hz AC voltage. Aluminum chloride was added to an aqueous solution containing 6.2 g/L of hydrochloric acid at a temperature of 35° C. to prepare an electrolytic solution having an adjusted aluminum ion concentration of 4.5 g/L, and the electrolytic solution was used in electrochemical graining treatment. The alternating current waveform was as shown in FIG. 5 and electrochemical graining treatment was performed for a period of time tp until the current reached a peak from zero of 0.8 ms, at a duty ratio of 1:1, using an alternating current having a trapezoidal waveform, and a carbon electrode as the counter electrode. A ferrite was used for the auxiliary anodes. An electrolytic cell of the type shown in FIG. 6 was used. The current density at the current peak was 25 A/dm$^2$. The amount of electricity (C/dm$^2$) in hydrochloric acid electrolysis, which is the total amount of electricity when the aluminum plate serves as an anode, was 63 C/dm$^2$. The plate was then rinsed by spraying with water.

(F-i) Alkali Etching Treatment

Etching treatment was performed by using a spray line to spray the aluminum plate obtained as described above with an aqueous solution having a sodium hydroxide concentration of 5 wt %, an aluminum ion concentration of 0.5 wt %, and a temperature of 50° C. The plate was then rinsed by spraying with water. The amount of dissolved aluminum was 0.1 g/m$^1$.

(F-j) Desmutting Treatment in Aqueous Acid Solution

Next, desmutting treatment was performed in an aqueous sulfuric acid solution. More specifically, wastewater generated in the anodizing treatment step (aqueous solution containing 170 g/L of sulfuric acid and 5 g/L of aluminum ions dissolved therein) was used to perform desmutting treatment at a solution temperature of 35° C. for 4 seconds. Desmutting treatment was performed by spraying the plate with the desmutting solution for 3 seconds.

(F-k) First Anodizing Treatment

The first anodizing treatment was performed by DC electrolysis using an anodizing apparatus of the structure as shown in FIG. 8. The anodizing treatment was performed under the conditions shown in Table 4 to form the anodized film with a specified film thickness.

(F-l) Pore-Widening Treatment

Pore-widening treatment was performed by immersing the anodized aluminum plate in an aqueous solution having a sodium hydroxide concentration of 5 wt %, an aluminum ion concentration of 0.5 wt %, and a temperature of 35° C. under the conditions shown in Table 4. The plate was then rinsed by spraying with water.

(F-m) Second Anodizing Treatment

The second anodizing treatment was performed by DC electrolysis using an anodizing apparatus of the structure as shown in FIG. 8. The anodizing treatment was performed under the conditions shown in Table 4 to form the anodized film with a specified film thickness.

(F-n) Third Anodizing Treatment

The third anodizing treatment was performed by DC electrolysis using an anodizing apparatus of the structure as shown in FIG. 8. The anodizing treatment was performed under the conditions shown in Table 4 to form the anodized film with a specified film thickness.

The average diameter at the anodized film surface of the large-diameter portions in the micropore-bearing anodized film obtained after the third anodizing treatment step, the communication position average diameter of the small-diameter portions, the depths of the large-diameter portions and small-diameter portions, the pit density (micropore density), and the thickness of the anodized film between the bottoms of the small-diameter portions and the surface of the aluminum plate are all shown in Table 5.

The average diameters of the micropores (average diameter of the large-diameter portions and that of the small-diameter portions) were determined as follows: The anodized film showing the aperture surfaces of the large-diameter portions and those of the small-diameter portions was taken by FE-SEM at a magnification of 150,000× to obtain four images, and in the resulting four images, the diameter of the micropores, that is, the diameter of the large-diameter portions and that of the small-diameter portions were measured within an area of 400×600 nm$^2$ and the average of the measurements was calculated. When it was difficult to measure the diameter of the small-diameter portions because of the large depth of the large-diameter portions and when the enlarged-diameter portion of each of the small-diameter portions was to be measured, the upper portion of the anodized film was cut out to determine the various diameters.

The depths of the micropores, that is, the depth of the large-diameter portions and that of the small-diameter portions were determined as follows: The cross-sectional surface of the support (anodized film) was taken by FE-SEM at a magnification of 150,000× to observe the depth of the large-diameter portions and a magnification of 50,000× to observe the depth of the small-diameter portions, and in the resulting images, the depth of arbitrarily selected 25 micropores were measured for each of the large diameter portions and small-diameter portions and the average of the measurements was calculated.

In Table 4, The AD amount in the column of First anodizing treatment and that in the column of Second anodizing treatment represent the coating weights obtained in the respective treatments. The electrolytic solution used is an aqueous solution containing the ingredients shown in Table 4.

TABLE 4

| | Treatment condition | First anodizing treatment | | | | | | | | Pore-widening treatment | |
|---|---|---|---|---|---|---|---|---|---|---|---|
| | | Solution type | Solution | Conc. (g/l) | Temp. (° C.) | Current density (A/dm$^2$) | Pore depth (nm) | Film thickness (nm) | AD amount (g/m$^2$) | Solution type | Solution |
| EX B-1 | A | Sulfuric acid | $H_2SO_4$/Al | 170/7 | 43 | 30 | 36 | 61 | 0.16 | Sodium hydroxide | NaOH/Al |

TABLE 4-continued

| | | | | | | | | | | | |
|---|---|---|---|---|---|---|---|---|---|---|---|
| EX B-2 | A | Sulfuric acid | $H_2SO_4$/Al | 170/7 | 43 | 30 | 27 | 52 | 0.13 | Sodium hydroxide | NaOH/Al |
| EX B-3 | A | Sulfuric acid | $H_2SO_4$/Al | 170/7 | 43 | 30 | 32 | 57 | 0.15 | Sodium hydroxide | NaOH/Al |
| EX B-4 | A | Sulfuric acid | $H_2SO_4$/Al | 170/7 | 43 | 50 | 63 | 88 | 0.23 | Sodium hydroxide | NaOH/Al |
| EX B-5 | A | Sulfuric acid | $H_2SO_4$/Al | 170/7 | 43 | 50 | 70 | 95 | 0.25 | Sodium hydroxide | NaOH/Al |
| EX B-6 | A | Sulfuric acid | $H_2SO_4$/Al | 170/7 | 43 | 30 | 13 | 38 | 0.10 | Sodium hydroxide | NaOH/Al |
| EX B-7 | A | Sulfuric acid | $H_2SO_4$/Al | 170/7 | 43 | 30 | 21 | 46 | 0.12 | Sodium hydroxide | NaOH/Al |
| EX B-8 | A | Sulfuric acid | $H_2SO_4$/Al | 170/7 | 43 | 30 | 56 | 81 | 0.21 | Sodium hydroxide | NaOH/Al |
| EX B-9 | A | Sulfuric acid | $H_2SO_4$/Al | 170/7 | 43 | 50 | 91 | 116 | 0.30 | Sodium hydroxide | NaOH/Al |
| EX B-10 | A | Sulfuric acid | $H_2SO_4$/Al | 170/7 | 43 | 50 | 41 | 66 | 0.17 | Sodium hydroxide | NaOH/Al |
| EX B-11 | A | Sulfuric acid | $H_2SO_4$/Al | 170/7 | 43 | 50 | 46 | 71 | 0.18 | Sodium hydroxide | NaOH/Al |
| EX B-12 | A | Sulfuric acid | $H_2SO_4$/Al | 170/7 | 43 | 30 | 37 | 62 | 0.16 | Sodium hydroxide | NaOH/Al |
| EX B-13 | A | Sulfuric acid | $H_2SO_4$/Al | 170/7 | 43 | 30 | 47 | 72 | 0.19 | Sodium hydroxide | NaOH/Al |
| EX B-14 | A | Sulfuric acid | $H_2SO_4$/Al | 170/7 | 43 | 60 | 51 | 76 | 0.20 | Sodium hydroxide | NaOH/Al |
| EX B-15 | A | Sulfuric acid | $H_2SO_4$/Al | 170/7 | 43 | 50 | 46 | 71 | 0.18 | Sodium hydroxide | NaOH/Al |
| EX B-16 | A | Sulfuric acid | $H_2SO_4$/Al | 170/7 | 43 | 10 | 26 | 51 | 0.13 | Sodium hydroxide | NaOH/Al |
| EX B-17 | A | Sulfuric acid | $H_2SO_4$/Al | 170/7 | 43 | 5 | 21 | 46 | 0.12 | Sodium hydroxide | NaOH/Al |
| EX B-18 | A | Sulfuric acid | $H_2SO_4$/Al | 170/7 | 43 | 30 | 36 | 61 | 0.16 | Sodium hydroxide | NaOH/Al |
| EX B-19 | A | Sulfuric acid | $H_2SO_4$/Al | 170/7 | 43 | 30 | 36 | 61 | 0.16 | Sodium hydroxide | NaOH/Al |
| EX B-20 | A | Sulfuric acid | $H_2SO_4$/Al | 170/7 | 43 | 30 | 36 | 61 | 0.16 | Sodium hydroxide | NaOH/Al |
| EX B-21 | A | Sulfuric acid | $H_2SO_4$/Al | 170/7 | 43 | 30 | 36 | 61 | 0.16 | Sodium hydroxide | NaOH/Al |
| EX B-22 | A | Sulfuric acid | $H_2SO_4$/Al | 170/7 | 43 | 30 | 36 | 61 | 0.16 | Sodium hydroxide | NaOH/Al |
| EX B-23 | A | Sulfuric acid | $H_2SO_4$/Al | 170/7 | 43 | 30 | 27 | 52 | 0.13 | Sodium hydroxide | NaOH/Al |
| EX B-24 | B | Sulfuric acid | $H_2SO_4$/Al | 170/7 | 43 | 30 | 27 | 52 | 0.13 | Sodium hydroxide | NaOH/Al |
| EX B-25 | C | Sulfuric acid | $H_2SO_4$/Al | 170/7 | 43 | 30 | 27 | 52 | 0.13 | Sodium hydroxide | NaOH/Al |
| EX B-26 | D | Sulfuric acid | $H_2SO_4$/Al | 170/7 | 43 | 30 | 27 | 52 | 0.13 | Sodium hydroxide | NaOH/Al |
| EX B-27 | E | Sulfuric acid | $H_2SO_4$/Al | 170/7 | 43 | 30 | 27 | 52 | 0.13 | Sodium hydroxide | NaOH/Al |
| EX B-28 | F | Sulfuric acid | $H_2SO_4$/Al | 170/7 | 43 | 30 | 27 | 52 | 0.13 | Sodium hydroxide | NaOH/Al |
| EX B-29 | A | Sulfuric acid | $H_2SO_4$/Al | 170/7 | 43 | 30 | 36 | 61 | 0.16 | Sodium hydroxide | NaOH/Al |
| EX B-30 | A | Sulfuric acid | $H_2SO_4$/Al | 170/7 | 43 | 30 | 36 | 61 | 0.16 | Sodium hydroxide | NaOH/Al |
| EX B-31 | A | Sulfuric acid | $H_2SO_4$/Al | 170/7 | 43 | 30 | 36 | 61 | 0.16 | Sodium hydroxide | NaOH/Al |
| EX B-32 | A | Sulfuric acid | $H_2SO_4$/Al | 170/7 | 43 | 30 | 36 | 61 | 0.16 | Sodium hydroxide | NaOH/Al |
| CE B-1 | A | Sulfuric acid | $H_2SO_4$/Al | 170/7 | 43 | 30 | 21 | 46 | 0.12 | Sodium hydroxide | NaOH/Al |
| CE B-2 | A | Sulfuric acid | $H_2SO_4$/Al | 170/7 | 43 | 30 | 7 | 32 | 0.08 | Sodium hydroxide | NaOH/Al |
| CE B-3 | A | Sulfuric acid | $H_2SO_4$/Al | 170/7 | 43 | 50 | 101 | 126 | 0.33 | Sodium hydroxide | NaOH/Al |
| CE B-4 | A | Sulfuric acid | $H_2SO_4$/Al | 170/7 | 43 | 30 | 152 | 177 | 0.46 | Sodium hydroxide | NaOH/Al |
| CE B-5 | A | Sulfuric acid | $H_2SO_4$/Al | 170/7 | 43 | 30 | 161 | 186 | 0.48 | Sodium hydroxide | NaOH/Al |
| CE B-6 | A | Sulfuric acid | $H_2SO_4$/Al | 170/7 | 43 | 50 | 188 | 213 | 0.55 | Sodium hydroxide | NaOH/Al |
| CE B-7 | A | Sulfuric acid | $H_2SO_4$/Al | 170/7 | 43 | 50 | 50 | 75 | 0.20 | Sodium hydroxide | NaOH/Al |
| CE B-8 | A | Sulfuric acid | $H_2SO_4$/Al | 170/7 | 43 | 30 | 52 | 77 | 0.13 | Sodium hydroxide | NaOH/Al |
| CE B-9 | A | Sulfuric acid | $H_2SO_4$/Al | 170/7 | 43 | 30 | 36 | 61 | 0.16 | Sodium hydroxide | NaOH/Al |

TABLE 4-continued

| | | | | | | | | | | | |
|---|---|---|---|---|---|---|---|---|---|---|---|
| CE B-10 | A | Sulfuric acid | $H_2SO_4$/Al | 170/7 | 43 | 30 | 36 | 61 | 0.16 | Sodium hydroxide | NaOH/Al |
| CE B-11 | A | — | — | — | — | — | — | — | — | — | — |
| CE B-12 | A | Sulfuric acid | $H_2SO_4$ | 170 | 30 | 5 | 298 | 308 | 0.80 | 10-second immersion at 30° C. in a solution of 0.1M sodium hydrogen carbonate and 0.1M sodium carbonate adjusted with NaOH to a pH of 13 | |
| CE B-13 | A | Phosphoric acid | $H_3SO_4$ | 50 | 30 | 1 | 301 | 346 | 0.90 | — | — |
| CE B-14 | A | Oxalic acid | $(COOH)_2$ | 100 | 30 | 1 | 268 | 308 | 0.80 | — | — |
| CE B-15 | A | Sulfuric acid | $H_2SO_4$ | 300 | 60 | 5 | 380 | 385 | 1.00 | — | — |
| CE B-16 | A | Sulfuric acid | $H_2SO_4$ | 50 | 10 | 20 | 345 | 385 | 1.00 | — | — |
| CE B-17 | B | — | — | — | — | — | — | — | — | — | — |
| CE B-18 | C | — | — | — | — | — | — | — | — | — | — |
| CE B-19 | D | — | — | — | — | — | — | — | — | — | — |
| CE B-20 | E | — | — | — | — | — | — | — | — | — | — |
| CE B-21 | F | — | — | — | — | — | — | — | — | — | — |
| CE B-22 | A | Sulfuric acid | $H_2SO_4$/Al | 170/7 | 43 | 30 | 36 | 61 | 0.16 | Sodium hydroxide | NaOH/Al |
| CE B-23 | A | Sulfuric acid | $H_2SO_4$/Al | 170/7 | 43 | 30 | 36 | 61 | 0.16 | Sodium hydroxide | NaOH/Al |
| CE B-24 | A | Sulfuric acid | $H_2SO_4$/Al | 170/7 | 43 | 30 | 36 | 61 | 0.16 | Sodium hydroxide | NaOH/Al |

| | Pore-widening treatment | | | Second anodizing treatment | | | | | | |
|---|---|---|---|---|---|---|---|---|---|---|
| | Conc. (wt %) | Temp. (° C.) | Time (s) | Solution type | Solution | Conc. (g/l) | Temp. (° C.) | Current density ($A/dm^2$) | Film thickness (nm) | AD amount ($g/m^2$) |
| EX B-1 | 5/0.5 | 35 | 6 | Sulfuric acid | $H_2SO_4$/Al | 170/7 | 40 | 20 | 900 | 2.3 |
| EX B-2 | 5/0.5 | 35 | 1 | Sulfuric acid | $H_2SO_4$/Al | 170/7 | 40 | 20 | 900 | 2.3 |
| EX B-3 | 5/0.5 | 35 | 4 | Sulfuric acid | $H_2SO_4$/Al | 170/7 | 40 | 20 | 900 | 2.3 |
| EX B-4 | 5/0.5 | 35 | 16 | Sulfuric acid | $H_2SO_4$/Al | 170/7 | 40 | 20 | 900 | 2.3 |
| EX B-5 | 5/0.5 | 35 | 20 | Sulfuric acid | $H_2SO_4$/Al | 170/7 | 40 | 20 | 900 | 2.3 |
| EX B-6 | 5/0.5 | 35 | 4 | Sulfuric acid | $H_2SO_4$/Al | 170/7 | 40 | 20 | 900 | 2.3 |
| EX B-7 | 5/0.5 | 35 | 6 | Sulfuric acid | $H_2SO_4$/Al | 170/7 | 40 | 20 | 900 | 2.3 |
| EX B-8 | 5/0.5 | 35 | 6 | Sulfuric acid | $H_2SO_4$/Al | 170/7 | 40 | 20 | 900 | 2.3 |
| EX B-9 | 5/0.5 | 35 | 12 | Sulfuric acid | $H_2SO_4$/Al | 170/7 | 40 | 20 | 900 | 2.3 |
| EX B-10 | 5/0.5 | 35 | 12 | Sulfuric acid | $H_2SO_4$/Al | 170/7 | 40 | 20 | 900 | 2.3 |
| EX B-11 | 5/0.5 | 35 | 12 | Sulfuric acid | $H_2SO_4$/Al | 170/7 | 40 | 20 | 900 | 2.3 |
| EX B-12 | 5/0.5 | 35 | 1 | Sulfuric acid | $H_2SO_4$/Al | 170/7 | 40 | 20 | 900 | 2.3 |
| EX B-13 | 5/0.5 | 35 | 1 | Sulfuric acid | $H_2SO_4$/Al | 170/7 | 40 | 20 | 900 | 2.3 |
| EX B-14 | 5/0.5 | 35 | 6 | Sulfuric acid | $H_2SO_4$/Al | 170/7 | 40 | 20 | 900 | 2.3 |
| EX B-15 | 5/0.5 | 35 | 6 | Sulfuric acid | $H_2SO_4$/Al | 170/7 | 40 | 20 | 900 | 2.3 |
| EX B-16 | 5/0.5 | 35 | 6 | Sulfuric acid | $H_2SO_4$/Al | 170/7 | 40 | 20 | 900 | 2.3 |
| EX B-17 | 5/0.5 | 35 | 6 | Sulfuric acid | $H_2SO_4$/Al | 170/7 | 40 | 20 | 900 | 2.3 |
| EX B-18 | 5/0.5 | 35 | 6 | Phosphoric acid | $H_3SO_4$/Al | 5/0 | 30 | 10 | 900 | 2.3 |
| EX B-19 | 5/0.5 | 35 | 6 | Sulfuric acid | $H_2SO_4$/Al | 170/7 | 30 | 50 | 900 | 2.3 |
| EX B-20 | 5/0.5 | 35 | 6 | Sulfuric acid | $H_2SO_4$/Al | 170/7 | 40 | 5 | 900 | 2.3 |
| EX B-21 | 5/0.5 | 35 | 6 | Sulfuric acid | $H_2SO_4$/Al | 170/7 | 40 | 20 | 825 | 2.1 |

TABLE 4-continued

| | | | | | | | | | | |
|---|---|---|---|---|---|---|---|---|---|---|
| EX B-22 | 5/0.5 | 35 | 6 | Sulfuric acid | $H_2SO_4$/Al | 170/7 | 40 | 20 | 1805 | 4.7 |
| EX B-23 | 5/0.5 | 35 | 1 | Sulfuric acid | $H_2SO_4$/Al | 170/7 | 55 | 40 | 900 | 2.6 |
| EX B-24 | 5/0.5 | 35 | 1 | Sulfuric acid | $H_2SO_4$/Al | 170/7 | 40 | 20 | 900 | 2.3 |
| EX B-25 | 5/0.5 | 35 | 1 | Sulfuric acid | $H_2SO_4$/Al | 170/7 | 40 | 20 | 900 | 2.3 |
| EX B-26 | 5/0.5 | 35 | 1 | Sulfuric acid | $H_2SO_4$/Al | 170/7 | 40 | 20 | 900 | 2.3 |
| EX B-27 | 5/0.5 | 35 | 1 | Sulfuric acid | $H_2SO_4$/Al | 170/7 | 40 | 20 | 900 | 2.3 |
| EX B-28 | 5/0.5 | 35 | 1 | Sulfuric acid | $H_2SO_4$/Al | 170/7 | 40 | 20 | 900 | 2.3 |
| EX B-29 | 5/0.5 | 35 | 6 | Sulfuric acid | $H_2SO_4$/Al | 170/7 | 40 | 20 | 900 | 2.3 |
| EX B-30 | 5/0.5 | 35 | 6 | Sulfuric acid | $H_2SO_4$/Al | 170/7 | 40 | 20 | 900 | 2.3 |
| EX B-31 | 5/0.5 | 35 | 6 | Sulfuric acid | $H_2SO_4$/Al | 170/7 | 40 | 20 | 950 | 2.5 |
| EX B-32 | 5/0.5 | 35 | 6 | Sulfuric acid | $H_2SO_4$/Al | 170/7 | 40 | 20 | 800 | 2.1 |
| CE B-1 | 5/0.5 | 35 | 1 | Sulfuric acid | $H_2SO_4$/Al | 170/7 | 40 | 20 | 900 | 2.3 |
| CE B-2 | 5/0.5 | 35 | 2 | Sulfuric acid | $H_2SO_4$/Al | 170/7 | 40 | 20 | 900 | 2.3 |
| CE B-3 | 5/0.5 | 35 | 12 | Sulfuric acid | $H_2SO_4$/Al | 170/7 | 40 | 20 | 900 | 2.3 |
| CE B-4 | 5/0.5 | 35 | 1 | Sulfuric acid | $H_2SO_4$/Al | 170/7 | 40 | 20 | 900 | 2.3 |
| CE B-5 | 5/0.5 | 35 | 6 | Sulfuric acid | $H_2SO_4$/Al | 170/7 | 40 | 20 | 900 | 2.3 |
| CE B-6 | 5/0.5 | 35 | 16 | Sulfuric acid | $H_2SO_4$/Al | 170/7 | 40 | 20 | 900 | 2.3 |
| CE B-7 | 5/0.5 | 35 | 20 | Sulfuric acid | $H_2SO_4$/Al | 170/7 | 40 | 20 | 900 | 2.3 |
| CE B-8 | 5/0.5 | 35 | 1 | Sulfuric acid | $H_2SO_4$/Al | 170/7 | 40 | 20 | 900 | 2.3 |
| CE B-9 | 5/0.5 | 35 | 6 | Phosphoric acid | $H_3SO_4$/Al | 5/0 | 30 | 20 | 900 | 2.3 |
| CE B-10 | 5/0.5 | 35 | 6 | Sulfuric acid | $H_2SO_4$/Al | 170/7 | 40 | 20 | 755 | 2.0 |
| CE B-11 | — | — | — | Sulfuric acid | $H_2SO_4$/Al | 170/7 | 40 | 20 | 1000 | 2.6 |
| CE B-12 | 10-second immersion at 30° C. in a solution of 0.1M sodium hydrogen carbonate and 0.1M sodium carbonate adjusted with NaOH to a pH of 13 | | | Sulfuric acid | $H_2SO_4$ | 170 | 30 | 5 | 846 | 2.2 |
| CE B-13 | — | — | — | Sulfuric acid | $H_2SO_4$ | 170 | 30 | 1 | 654 | 1.7 |
| CE B-14 | — | — | — | Sulfuric acid | $H_2SO_4$ | 170 | 30 | 5 | 692 | 1.8 |
| CE B-15 | — | — | — | Sulfuric acid | $H_2SO_4$ | 170 | 30 | 5 | 654 | 1.7 |
| CE B-16 | — | — | — | Sulfuric acid | $H_2SO_4$ | 170 | 30 | 5 | 654 | 1.7 |
| CE B-17 | — | — | — | Sulfuric acid | $H_2SO_4$/Al | 170/7 | 40 | 20 | 1000 | 2.6 |
| CE B-18 | — | — | — | Sulfuric acid | $H_2SO_4$/Al | 170/7 | 40 | 20 | 1000 | 2.6 |
| CE B-19 | — | — | — | Sulfuric acid | $H_2SO_4$/Al | 170/7 | 40 | 20 | 1000 | 2.6 |
| CE B-20 | — | — | — | Sulfuric acid | $H_2SO_4$/Al | 170/7 | 40 | 20 | 1000 | 2.6 |
| CE B-21 | — | — | — | Sulfuric acid | $H_2SO_4$/Al | 170/7 | 40 | 20 | 1000 | 2.6 |
| CE B-22 | 5/0.5 | 35 | 6 | Sulfuric acid | $H_2SO_4$/Al | 170/7 | 40 | 20 | 1000 | 2.6 |
| CE B-23 | 5/0.5 | 35 | 6 | Sulfuric acid | $H_2SO_4$/Al | 170/7 | 40 | 20 | 900 | 2.3 |
| CE B-24 | 5/0.5 | 35 | 6 | Sulfuric acid | $H_2SO_4$/Al | 170/7 | 40 | 20 | 900 | 2.3 |

TABLE 4-continued

| | Third anodizing treatment | | | | | | |
|---|---|---|---|---|---|---|---|
| | Solution type | Solution | Conc. (g/l) | Temp. (° C.) | Current density ($A/dm^2$) | Film thickness (nm) | AD amount ($g/m^2$) |
| EX B-1 | Sulfuric acid | $H_2SO_4$/Al | 170/7 | 40 | 50 | 100 | 0.26 |
| EX B-2 | Sulfuric acid | $H_2SO_4$/Al | 170/7 | 40 | 50 | 100 | 0.26 |
| EX B-3 | Sulfuric acid | $H_2SO_4$/Al | 170/7 | 40 | 50 | 100 | 0.26 |
| EX B-4 | Sulfuric acid | $H_2SO_4$/Al | 170/7 | 40 | 50 | 100 | 0.26 |
| EX B-5 | Sulfuric acid | $H_2SO_4$/Al | 170/7 | 40 | 50 | 100 | 0.26 |
| EX B-6 | Sulfuric acid | $H_2SO_4$/Al | 170/7 | 40 | 50 | 100 | 0.26 |
| EX B-7 | Sulfuric acid | $H_2SO_4$/Al | 170/7 | 40 | 50 | 100 | 0.26 |
| EX B-8 | Sulfuric acid | $H_2SO_4$/Al | 170/7 | 40 | 50 | 100 | 0.26 |
| EX B-9 | Sulfuric acid | $H_2SO_4$/Al | 170/7 | 40 | 50 | 100 | 0.26 |
| EX B-10 | Sulfuric acid | $H_2SO_4$/Al | 170/7 | 40 | 50 | 100 | 0.26 |
| EX B-11 | Sulfuric acid | $H_2SO_4$/Al | 170/7 | 40 | 50 | 100 | 0.26 |
| EX B-12 | Sulfuric acid | $H_2SO_4$/Al | 170/7 | 40 | 50 | 100 | 0.26 |
| EX B-13 | Sulfuric acid | $H_2SO_4$/Al | 170/7 | 40 | 50 | 100 | 0.26 |
| EX B-14 | Sulfuric acid | $H_2SO_4$/Al | 170/7 | 40 | 50 | 100 | 0.26 |
| EX B-15 | Sulfuric acid | $H_2SO_4$/Al | 170/7 | 40 | 50 | 100 | 0.26 |
| EX B-16 | Sulfuric acid | $H_2SO_4$/Al | 170/7 | 40 | 50 | 100 | 0.26 |
| EX B-17 | Sulfuric acid | $H_2SO_4$/Al | 170/7 | 40 | 50 | 100 | 0.26 |
| EX B-18 | Sulfuric acid | $H_2SO_4$/Al | 170/7 | 40 | 50 | 100 | 0.26 |
| EX B-19 | Sulfuric acid | $H_2SO_4$/Al | 170/7 | 40 | 50 | 100 | 0.26 |
| EX B-20 | Sulfuric acid | $H_2SO_4$/Al | 170/7 | 40 | 50 | 100 | 0.26 |
| EX B-21 | Sulfuric acid | $H_2SO_4$/Al | 170/7 | 40 | 50 | 100 | 0.26 |
| EX B-22 | Sulfuric acid | $H_2SO_4$/Al | 170/7 | 40 | 50 | 100 | 0.26 |
| EX B-23 | Sulfuric acid | $H_2SO_4$/Al | 170/7 | 40 | 50 | 100 | 0.26 |
| EX B-24 | Sulfuric acid | $H_2SO_4$/Al | 170/7 | 40 | 50 | 100 | 0.26 |
| EX B-25 | Sulfuric acid | $H_2SO_4$/Al | 170/7 | 40 | 50 | 100 | 0.26 |
| EX B-26 | Sulfuric acid | $H_2SO_4$/Al | 170/7 | 40 | 50 | 100 | 0.26 |
| EX B-27 | Sulfuric acid | $H_2SO_4$/Al | 170/7 | 40 | 50 | 100 | 0.26 |
| EX B-28 | Sulfuric acid | $H_2SO_4$/Al | 170/7 | 40 | 50 | 100 | 0.26 |
| EX B-29 | Sulfuric acid | $H_2SO_4$/Al | 170/7 | 25 | 50 | 100 | 0.26 |
| EX B-30 | Sulfuric acid | $H_2SO_4$/Al | 140/7 | 25 | 50 | 100 | 0.26 |
| EX B-31 | Sulfuric acid | $H_2SO_4$/Al | 170/7 | 40 | 50 | 50 | 0.13 |
| EX B-32 | Sulfuric acid | $H_2SO_4$/Al | 170/7 | 40 | 50 | 250 | 0.65 |
| CE B-1 | Sulfuric acid | $H_2SO_4$/Al | 170/7 | 40 | 50 | 100 | 0.26 |
| CE B-2 | Sulfuric acid | $H_2SO_4$/Al | 170/7 | 40 | 50 | 100 | 0.26 |
| CE B-3 | Sulfuric acid | $H_2SO_4$/Al | 170/7 | 40 | 50 | 100 | 0.26 |
| CE B-4 | Sulfuric acid | $H_2SO_4$/Al | 170/7 | 40 | 50 | 100 | 0.26 |
| CE B-5 | Sulfuric acid | $H_2SO_4$/Al | 170/7 | 40 | 50 | 100 | 0.26 |

TABLE 4-continued

| | | | | | | | |
|---|---|---|---|---|---|---|---|
| CE B-6 | Sulfuric acid | $H_2SO_4$/Al | 170/7 | 40 | 50 | 100 | 0.26 |
| CE B-7 | Sulfuric acid | $H_2SO_4$/Al | 170/7 | 40 | 50 | 100 | 0.26 |
| CE B-8 | Sulfuric acid | $H_2SO_4$/Al | 170/7 | 40 | 50 | 100 | 0.26 |
| CE B-9 | Sulfuric acid | $H_2SO_4$/Al | 170/7 | 40 | 50 | 100 | 0.26 |
| CE B-10 | Sulfuric acid | $H_2SO_4$/Al | 170/7 | 40 | 50 | 100 | 0.26 |
| CE B-11 | — | — | — | — | — | — | — |
| CE B-12 | — | — | — | — | — | — | — |
| CE B-13 | — | — | — | — | — | — | — |
| CE B-14 | — | — | — | — | — | — | — |
| CE B-15 | — | — | — | — | — | — | — |
| CE B-16 | — | — | — | — | — | — | — |
| CE B-17 | — | — | — | — | — | — | — |
| CE B-18 | — | — | — | — | — | — | — |
| CE B-19 | — | — | — | — | — | — | — |
| CE B-20 | — | — | — | — | — | — | — |
| CE B-21 | — | — | — | — | — | — | — |
| CE B-22 | — | — | — | — | — | — | — |
| CE B-23 | Sulfuric acid | $H_2SO_4$/Al | 170/7 | 40 | 20 | 100 | 0.26 |
| CE B-24 | Sulfuric acid | $H_2SO_4$/Al | 170/7 | 40 | 5 | 100 | 0.26 |

TABLE 5

| | Micropore | | | | | | | |
|---|---|---|---|---|---|---|---|---|
| | Large-diameter portion | | | Small-diameter portion | | | Ratio of small-diameter portion/ | Barrier layer |
| | Average diameter (nm) | Depth (nm) | Depth/average diameter | Average diameter (nm) | Depth (nm) | Pit density (pcs/$\mu m^2$) | large-diameter portion | thickness (nm) |
| EX B-1 | 25 | 25 | 1.00 | 8 | 975 | 500 | 0.32 | 25 |
| EX B-2 | 12 | 25 | 2.08 | 8 | 975 | 500 | 0.67 | 25 |
| EX B-3 | 20 | 25 | 1.25 | 8 | 975 | 500 | 0.40 | 25 |
| EX B-4 | 50 | 25 | 0.50 | 8 | 975 | 200 | 0.16 | 25 |
| EX B-5 | 60 | 25 | 0.42 | 8 | 975 | 200 | 0.13 | 25 |
| EX B-6 | 20 | 6 | 0.30 | 8 | 975 | 500 | 0.40 | 25 |
| EX B-7 | 25 | 10 | 0.40 | 8 | 975 | 500 | 0.32 | 25 |
| EX B-8 | 25 | 45 | 1.80 | 8 | 975 | 500 | 0.32 | 25 |
| EX B-9 | 40 | 60 | 1.50 | 8 | 975 | 200 | 0.20 | 25 |
| EX B-10 | 40 | 10 | 0.25 | 8 | 975 | 200 | 0.20 | 25 |
| EX B-11 | 40 | 15 | 0.38 | 8 | 975 | 200 | 0.20 | 25 |
| EX B-12 | 12 | 35 | 2.92 | 8 | 975 | 500 | 0.67 | 25 |
| EX B-13 | 12 | 45 | 3.75 | 8 | 975 | 500 | 0.67 | 25 |
| EX B-14 | 25 | 25 | 1.00 | 8 | 975 | 55 | 0.32 | 25 |
| EX B-15 | 25 | 25 | 1.00 | 8 | 975 | 200 | 0.32 | 25 |
| EX B-16 | 25 | 25 | 1.00 | 8 | 975 | 2800 | 0.32 | 25 |
| EX B-17 | 25 | 25 | 1.00 | 8 | 975 | 3800 | 0.32 | 25 |
| EX B-18 | 25 | 25 | 1.00 | 19 | 975 | 500 | 0.76 | 25 |
| EX B-19 | 25 | 25 | 1.00 | 13 | 975 | 500 | 0.52 | 25 |
| EX B-20 | 25 | 25 | 1.00 | 5 | 975 | 500 | 0.20 | 25 |
| EX B-21 | 25 | 25 | 1.00 | 8 | 900 | 500 | 0.32 | 25 |
| EX B-22 | 25 | 25 | 1.00 | 8 | 1880 | 500 | 0.32 | 25 |
| EX B-23 | 12 | 25 | 2.08 | 10 | 975 | 500 | 0.83 | 25 |
| EX B-24 | 12 | 25 | 2.08 | 8 | 975 | 500 | 0.67 | 25 |
| EX B-25 | 12 | 25 | 2.08 | 8 | 975 | 500 | 0.67 | 25 |
| EX B-26 | 12 | 25 | 2.08 | 8 | 975 | 500 | 0.67 | 25 |
| EX B-27 | 12 | 25 | 2.08 | 8 | 975 | 500 | 0.67 | 25 |
| EX B-28 | 12 | 25 | 2.08 | 8 | 975 | 500 | 0.67 | 25 |
| EX B-29 | 25 | 25 | 1.00 | 8 | 970 | 500 | 0.32 | 30 |
| EX B-30 | 25 | 25 | 1.00 | 8 | 965 | 500 | 0.32 | 35 |
| EX B-31 | 25 | 25 | 1.00 | 8 | 975 | 500 | 0.32 | 25 |
| EX B-32 | 25 | 25 | 1.00 | 8 | 975 | 500 | 0.32 | 25 |
| CE B-1 | 9 | 20 | 2.22 | 8 | 975 | 500 | 0.89 | 25 |
| CE B-2 | 15 | 3 | 0.20 | 8 | 975 | 500 | 0.53 | 25 |
| CE B-3 | 40 | 70 | 1.75 | 8 | 975 | 200 | 0.20 | 25 |
| CE B-4 | 12 | 150 | 12.50 | 8 | 975 | 500 | 0.67 | 25 |
| CE B-5 | 25 | 150 | 6.00 | 8 | 975 | 500 | 0.32 | 25 |
| CE B-6 | 50 | 150 | 3.00 | 8 | 975 | 200 | 0.16 | 25 |
| CE B-7 | 60 | 5 | 0.08 | 8 | 975 | 200 | 0.13 | 25 |
| CE B-8 | 12 | 50 | 4.17 | 8 | 975 | 500 | 0.67 | 25 |

TABLE 5-continued

| | Micropore | | | | | | | |
|---|---|---|---|---|---|---|---|---|
| | Large-diameter portion | | | Small-diameter portion | | | Ratio of small-diameter portion/ | Barrier layer |
| | Average diameter (nm) | Depth (nm) | Depth/average diameter | Average diameter (nm) | Depth (nm) | Pit density (pcs/μm$^2$) | large-diameter portion | thickness (nm) |
| CE B-9 | 25 | 25 | 1.00 | 22 | 975 | 500 | 0.88 | 25 |
| CE B-10 | 25 | 25 | 1.00 | 8 | 830 | 500 | 0.32 | 25 |
| CE B-11 | — | — | — | 8 | 980 | — | — | 20 |
| CE B-12 | 17 | 268 | 15.76 | 8 | 836 | 3500 | 0.47 | 12 |
| CE B-13 | 40 | 301 | 7.53 | 5 | 649 | 800 | 0.13 | 55 |
| CE B-14 | 20 | 268 | 13.40 | 8 | 682 | 900 | 0.40 | 45 |
| CE B-15 | 16 | 380 | 23.75 | 8 | 644 | 5000 | 0.50 | 5 |
| CE B-16 | 15 | 345 | 23.00 | 8 | 644 | 25 | 0.53 | 40 |
| CE B-17 | — | — | — | 8 | 980 | — | — | 20 |
| CE B-18 | — | — | — | 8 | 980 | — | — | 20 |
| CE B-19 | — | — | — | 8 | 980 | — | — | 20 |
| CE B-20 | — | — | — | 8 | 980 | — | — | 20 |
| CE B-21 | — | — | — | 8 | 980 | — | — | 20 |
| CE B-22 | 25 | 25 | 1.00 | 8 | 980 | 500 | 0.32 | 20 |
| CE B-23 | 25 | 25 | 1.00 | 8 | 980 | 500 | 0.32 | 20 |
| CE B-24 | 25 | 25 | 1.00 | 8 | 980 | 500 | 0.32 | 10 |

In Examples B-1 to 32, micropores having specified average diameters and depths were formed in the anodized aluminum film.

Comparative Examples B-11 and 17-21 apply the conventional process in which anodizing treatment is performed only once. The manufacturing conditions in Comparative Examples B-12 to 16 are the same as those in Examples B-1 to 5 described in paragraph [0136] of JP 11-291657 A.

[Manufacture of Presensitized Plate (A) (On-Press Developing Type Printing Plate)]

In order to ensure the hydrophilicity in non-image areas, silicate treatment was performed by dipping each lithographic printing plate support manufactured as described above into an aqueous solution containing 2.5 wt % of No. 3 sodium silicate at 50° C. for 7 seconds. The amount of deposited silicon was 10 mg/m$^2$. The plate was then rinsed by spraying with water. Then, an undercoat-forming coating liquid of the composition indicated below was applied onto each lithographic printing plate support to a coating weight after drying of 28 mg/m$^2$ to thereby form an undercoat.

<Undercoat-Forming Coating Liquid>

| | |
|---|---|
| Undercoating compound (1) of the structure shown below | 0.18 g |
| Hydroxyethylimino diacetic acid | 0.10 g |
| Methanol | 55.24 g |
| Water | 6.15 g |

Undercoating compound (1)

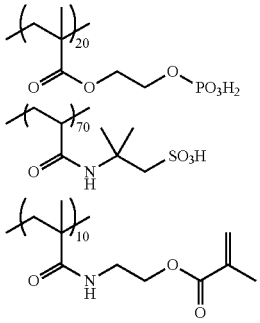

Then, an image recording layer-forming coating liquid was applied onto the thus formed undercoat by bar coating and dried in an oven at 100° C. for 60 seconds to form an image recording layer having a coating weight after drying of 1.3 g/m$^2$.

The image recording layer-forming coating liquid was obtained by mixing with stirring the photosensitive liquid and microgel liquid shown below just before use in application.

<Photosensitive Liquid>

| | |
|---|---|
| Binder polymer (1) [its structure is shown below] | 0.24 g |
| Infrared absorber (1) [its structure is shown below] | 0.030 g |
| Radical polymerization initiator (1) [its structure is shown below] | 0.162 g |
| Polymerizable compound, tris(acryloyloxyethyl)isocyanurate (NK ester A-9300 available from Shin-Nakamura Chemical Corporation) | 0.192 g |
| Low-molecular-weight hydrophilic compound, tris(2-hydroxyethyl)isocyanurate | 0.062 g |
| Low-molecular-weight hydrophilic compound (1) [its structure is shown below] | 0.052 g |
| Sensitizer Phosphonium compound (1) [its structure is shown below] | 0.055 g |
| Sensitizer Benzyl-dimethyl-octyl ammonium · $PF_6$ salt | 0.018 g |
| Betaine derivative (C-1) [its structure is shown below] | 0.010 g |
| Fluorosurfactant (1) (weight-average molecular weight: 10,000) [its structure is shown below] | 0.008 g |
| Methyl ethyl ketone | 1.091 g |
| 1-Methoxy-2-propanol | 8.609 g |

<Microgel Liquid>

| | |
|---|---|
| Microgel (1) | 2.640 g |
| Distilled water | 2.425 g |

The binder polymer (1), the infrared absorber (1), the radical polymerization initiator (1), the phosphonium compound (1), the low-molecular-weight hydrophilic compound (1), the betaine compound (C-1) and the fluorosurfactant (1) have the structures represented by the following formulas:

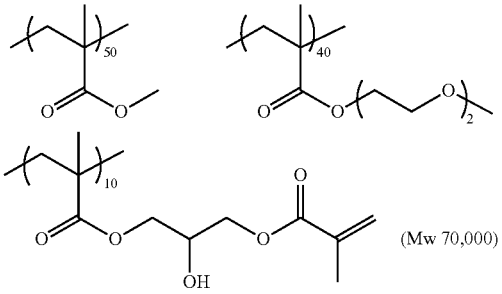

Binder polymer (1)

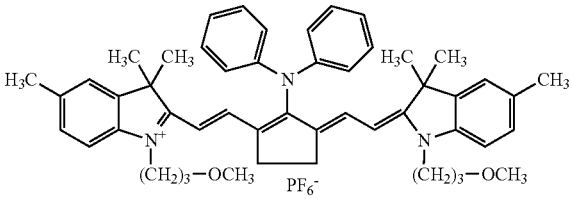

Infrared absorber (1)

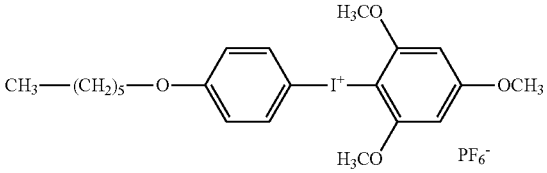

Polymerization initiator (1)

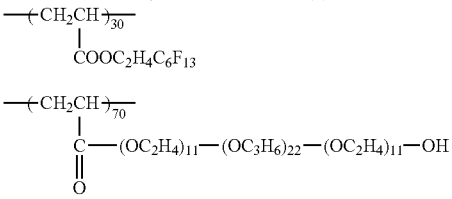

Fluorosurfactant (1)

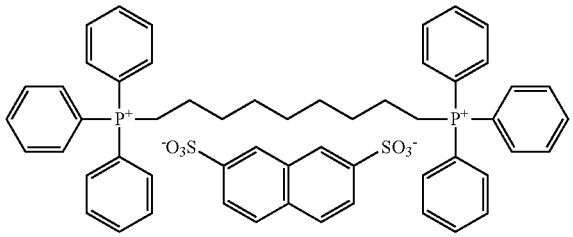

Phosphonium compound (1)

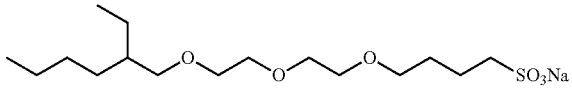

Low-molecular-weight hydrophilic compound (1)

(C-1)

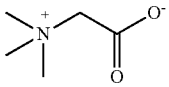

The microgel (1) was synthesized by the following procedure.

<Synthesis of Microgel (1)>

For the oil phase component, 10 g of an adduct of trimethylolpropane with xylene diisocyanate (Takenate D-110N available from Mitsui Takeda Chemicals Inc.), 3.15 g of pentaerythritol triacrylate (SR444 available from Nippon Kayaku Co., Ltd.) and 0.1 g of Pionin A-41C (available from Takemoto Oil & Fat Co., Ltd.) were dissolved in 17 g of ethyl acetate. For the aqueous phase component, 40 g of a 4 wt % aqueous solution of PVA-205 was prepared. The oil phase component and the aqueous phase component were mixed and emulsified in a homogenizer at 12,000 rpm for 10 minutes. The resulting emulsion was added to 25 g of distilled water and the mixture was stirred at room temperature for 30 minutes, then at 50° C. for 3 hours. The thus obtained microgel liquid was diluted with distilled water so as to have a solids concentration of 15 wt % and used as the microgel (1). The average particle size of the microgel as measured by a light scattering method was 0.2 μm.

Then, a protective layer-forming coating liquid of the composition indicated below was applied onto the thus formed image recording layer by bar coating and dried in an oven at 120° C. for 60 seconds to form a protective layer having a coating weight after drying of 0.15 g/m$^2$, thereby obtaining a presensitized plate.

<Protective Layer-Forming Coating Liquid>

| | |
|---|---|
| Dispersion of an inorganic layered compound (1) | 1.5 g |
| 6 wt % Aqueous solution of polyvinyl alcohol (CKS50; modified with sulfonic acid; degree of saponification: at least 99 mol %; degree of polymerization: 300; available from Nippon Synthetic Chemical Industry Co., Ltd.) | 0.55 g |
| 6 wt % Aqueous solution of polyvinyl alcohol (PVA-405; degree of saponification: 81.5 mol %; degree of polymerization: 500; available from Kuraray Co., Ltd.) | 0.03 g |
| 1 wt % Aqueous solution of surfactant (EMALEX 710 available from Nihon Emulsion Co., Ltd.) | 8.60 g |
| Ion exchanged water | 6.0 g |

The dispersion of the inorganic layered compound (1) was prepared by the following procedure.

(Preparation of Dispersion of Inorganic Layered Compound (1))

To 193.6 g of ion-exchanged water was added 6.4 g of synthetic mica Somasif ME-100 (available from Co-Op Chemical Co., Ltd.) and the mixture was dispersed in a homogenizer to an average particle size as measured by a laser scattering method of 3 μm. The resulting dispersed particles had an aspect ratio of at least 100.

[Evaluation of Presensitized Plate]

(On-Press Developability)

The resulting presensitized plate was exposed by Luxel PLATESETTER T-6000III from FUJIFILM Corporation equipped with an infrared semiconductor laser at an external drum rotation speed of 1,000 rpm, a laser power of 70% and a resolution of 2,400 dpi. The exposed image was set to contain a solid image and a 50% halftone chart of a 20 μm-dot FM screen.

The resulting presensitized plate after exposure was mounted without a development process on the plate cylinder of a Lithrone 26 press available from Komori Corporation. A fountain solution Ecolity-2 (FUJIFILM Corporation)/tap water at a volume ratio of 2/98 and Values-G (N) black ink (Dainippon Ink & Chemicals, Inc.) were used. The fountain solution and the ink were supplied by the standard automatic printing start-up procedure on the Lithrone 26 to perform on-press development, and 100 impressions were printed on Tokubishi art paper (76.5 kg) at a printing speed of 10,000 impressions per hour.

The on-press developability was evaluated as the number of sheets of printing paper required to reach the state in which no ink is transferred to halftone non-image areas after the completion of the on-press development of the unexposed areas of the 50% halftone chart on the printing press. The on-press developability was rated "very good" when the number of wasted sheets was up to 20, "good" when the number of wasted sheets was from 21 to 30, "fair" when the number of wasted sheets was 31 to 40, and "poor" when the number of wasted sheets was 41 or more. The results are shown in Table 6. The on-press developability is preferably not rated "poor" for practical use.

(Deinking Ability after Suspended Printing)

Once good impressions were obtained after the end of the on-press development, printing was suspended and the printing plate was left to stand on the printing press for 1 hour in a room at a temperature of 25° C. and a humidity of 50%. Then, printing was resumed and the deinking ability after suspended printing was evaluated as the number of sheets of printing paper required to obtain a good unstained impression. The deinking ability after suspended printing was rated "very good" when the number of wasted sheets was up to 75, "good" when the number of wasted sheets was 76 to 200, "fair" when the number of wasted sheets was 201 to 300 and "poor" when the number of wasted sheets was 301 or more. The results are shown in Table 6. The on-press developability is preferably not rated "poor" for practical use.

(Press Life)

On-press development was performed on the same type of printing press by the same procedure as above and printing was further continued. The press life was evaluated by the number of impressions at the time when the decrease in density of a solid image became visually recognizable. The press life was rated "extremely poor" when the number of impressions was less than 10,000, "very poor" when the number of impressions was at least 10,000 but less than 15,000, "poor" when the number of impressions was at least 15,000 but less than 20,000, "good" when the number of impressions was at least 20,000 but less than 25,000, "very good" when the number of impressions was at least 25,000 but less than 30,000, and "excellent" when the number of impressions was 30,000 or more. The results are shown in Table 6.

The press life is preferably not rated "extremely poor", "very poor" and "poor" for practical use.

(Scratch Resistance)

The surface of the resulting lithographic printing plate support was subjected to a scratch test to evaluate the scratch resistance of the lithographic printing plate support.

The scratch test was performed using a continuous loading scratching intensity tester (SB-53 manufactured by Shinto Scientific Co., Ltd.) while moving a sapphire needle with a diameter of 0.4 mm at a moving velocity of 10 cm/s at a load of 100 g.

As a result, the support in which scratches due to the needle did not reach the surface of the aluminum alloy plate (base) was rated "good" as having excellent scratch resistance and the support in which scratches reached the plate surface was rated "poor." The lithographic printing plate support exhibiting excellent scratch resistance at a load of 100 g can suppress the transfer of scratches to the image recording layer when the presensitized plate prepared therefrom is mounted on the plate cylinder or superposed on another, thus reducing scumming in non-image areas. The results are shown in Table 6.

(Resistance to Dotted Scumming)

The resulting presensitized plate was conditioned with a slip sheet at 25° C. and 70% RH for 1 hour, wrapped with aluminum kraft paper and heated in an oven set at 60° C. for 10 days.

Then, the temperature was decreased to room temperature. On-press development was performed on the same type of printing press by the same procedure as above and 500 impressions were made. The 500th impression was visually checked and the number per 80 $cm^2$ of print stains with a size of at least 20 μm was counted. The results are shown in Table 6.

The resistance to dotted scumming was rated "very poor" when the number of stains was at least 250, "poor" when the number of stains was at least 150 but less than 250, "good" when the number of stains was at least 100 but less than 150, "very good" when the number of stains was at least 50 but less than 100, and "excellent" when the number of stains was less than 50.

The resistance to dotted scumming is preferably not rated "very poor" and "poor" for practical use.

[Manufacture of Presensitized Plate (B)]

[Undercoat]

An undercoat-forming coating liquid of the composition indicated below was applied to each lithographic printing plate support manufactured as described above by bar coating to a coating weight after drying of 2 $mg/m^2$ and the coating liquid was dried at 80° C. for 20 seconds.

[Undercoat-Forming Coating Liquid]

| | |
|---|---|
| Polymer (P1) [its formula is shown below] | 0.3 part by weight |
| Pure water | 60.0 parts by weight |
| Methanol | 939.7 parts by weight |

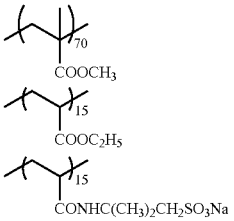

The photosensitive composition (1) shown below was applied by bar coating onto the prepared support and then dried at 90° C. for 1 minute to form a photosensitive layer. The photosensitive layer had a dry weight of 1.35 $g/m^2$.

(Photosensitive Composition (1))

| | |
|---|---|
| Polymerizable compound (1) shown below (PLEX6661-0 from Degussa Japan Co.,, Ltd.) | 1.69 parts by weight |
| Binder polymer (1) shown below | 1.87 parts by weight |
| Sensitizing dye (1) shown below | 0.13 part by weight |
| Polymerization initiator (1) shown below | 0.46 part by weight |
| Chain transfer agent (1) shown below | 0.44 part by weight |
| Dispersion of ϵ-phthalocyanine pigment (pigment: 15 parts by weight, dispersant (allyl methacrylate/methacrylic acid copolymer (weight-average molecular weight: 60,000, copolymerization molar ratio: 83/17)): 10 parts by weight, | 1.70 parts by weight |

-continued

| | |
|---|---|
| cyclohexanone: 15 parts by weight) | |
| Thermal polymerization inhibitor | 0.012 part by weight |
| N-Nitrosophenylhydroxylamine aluminum salt | |
| Yellow pigment dispersion | 0.5 part by weight |
| (Yellow pigment: Novoperm Yellow H2G (Clariant): 15 parts by weight, dispersant (allyl methacrylate/methacrylic acid copolymer (weight-average molecular weight: 60,000, copolymerization molar ratio: 83/17)): 10 parts by weight, cyclohexanone: 15 parts by weight) | |
| Fluorosurfactant (1) shown below (weight-average molecular weight: 10,000) | 0.03 part by weight |
| Methyl ethyl ketone | 27.0 parts by weight |
| Propylene glycol monomethyl ether | 26.7 parts by weight |

Polymerizable compound (1)

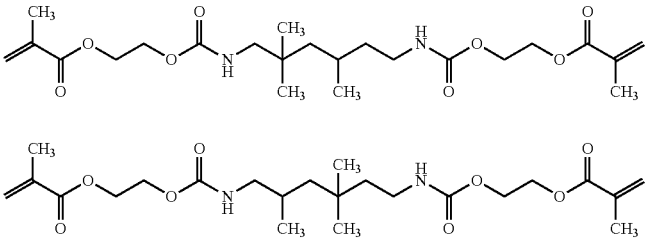

(Isomer mixture)

Binder polymer (1)

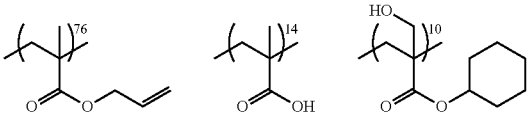

Sensitizing dye (1)

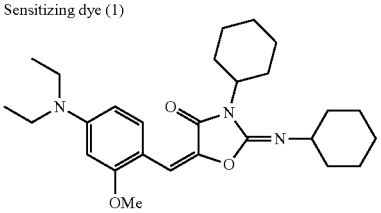

Polymerization initiator (1)

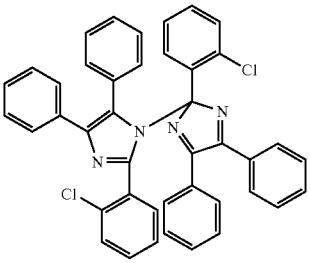

Chain transfer agent (1)

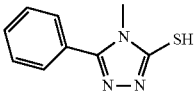

Fluorosurfactant (1)

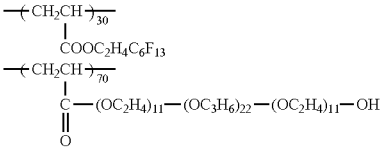

The protective layer-forming coating liquid of the composition indicated below was applied by bar coating onto the photosensitive layer to a dry coating weight of 2.5 g/m$^2$ and dried at 120° C. for 1 minute to obtain presensitized plates.

| (Protective Layer-Forming Coating Liquid) | |
|---|---|
| PVA105 (polyvinyl alcohol, degree of saponification: 98%, Kuraray Co., Ltd.) | 1.80 parts by weight |
| PVP-K30 (polyvinyl pyrrolidone, BASF) | 0.40 part by weight |
| EMALEX 710 (Nihon Emulsion Co., Ltd.) | 0.03 part by weight |
| Luviskol VA64W (BASF) | 0.04 part by weight |
| Polymer (P-1) shown above | 0.05 part by weight |
| Pure water | 36.5 parts by weight |

[Evaluation of Resistance to White Spot Formation]

[Blistering]

The resulting presensitized plate was allowed to stand for 30 days and subjected to exposure and development, and the number of white spots (aluminum defects) was counted in an area of 400 $cm^2$ (20 cm×20 cm).

Excellent: 0 to 10 white spots/400 $cm^2$

Very good: 11 to 20 white spots/400 $cm^2$

Good: 21 to 30 white spots/400 $cm^2$

Poor: 31 to 35 white spots/400 $cm^2$

Very poor: 36 or more white spots/400 $cm^2$

The resistance to white spot formation is preferably not rated "very poor" and "poor" for practical use.

TABLE 6

| | Press life | Deinking ability after suspended printing | On-press developability | Scratch resistance | Resistance to dotted scumming | Resistance to blown-out highlights |
|---|---|---|---|---|---|---|
| EX B-1 | Excellent | Very good | Very good | Good | Good | Good |
| EX B-2 | Excellent | Very good | Very good | Good | Good | Good |
| EX B-3 | Excellent | Very good | Very good | Good | Good | Good |
| EX B-4 | Excellent | Very good | Very good | Good | Good | Good |
| EX B-5 | Very good | Very good | Very good | Good | Good | Good |
| EX B-6 | Very good | Very good | Very good | Good | Good | Good |
| EX B-7 | Excellent | Very good | Very good | Good | Good | Good |
| EX B-8 | Excellent | Very good | Very good | Good | Good | Good |
| EX B-9 | Excellent | Good | Good | Good | Good | Good |
| EX B-10 | Very good | Good | Good | Good | Good | Good |
| EX B-11 | Excellent | Very good | Very good | Good | Good | Good |
| EX B-12 | Excellent | Very good | Very good | Good | Good | Good |
| EX B-13 | Excellent | Good | Good | Good | Good | Good |
| EX B-14 | Very good | Very good | Very good | Good | Good | Good |
| EX B-15 | Excellent | Very good | Very good | Good | Good | Good |
| EX B-16 | Excellent | Very good | Very good | Good | Good | Good |
| EX B-17 | Excellent | Good | Good | Good | Good | Good |
| EX B-18 | Excellent | Fair | Fair | Good | Good | Good |
| EX B-19 | Excellent | Good | Good | Good | Good | Good |
| EX B-20 | Excellent | Very good | Very good | Good | Good | Good |
| EX B-21 | Excellent | Very good | Very good | Good | Good | Good |
| EX B-22 | Excellent | Very good | Very good | Good | Good | Good |
| EX B-23 | Excellent | Very good | Very good | Good | Good | Good |
| EX B-24 | Very good | Very good | Very good | Good | Good | Good |
| EX B-25 | Good | Very good | Very good | Good | Good | Good |
| EX B-26 | Good | Very good | Very good | Good | Good | Good |
| EX B-27 | Very good | Very good | Very good | Good | Good | Good |
| EX B-28 | Excellent | Very good | Very good | Good | Good | Good |
| EX B-29 | Excellent | Very good | Very good | Good | Very good | Very good |
| EX B-30 | Excellent | Very good | Very good | Good | Excellent | Excellent |
| EX B-31 | Excellent | Very good | Very good | Good | Good | Good |
| EX B-32 | Excellent | Very good | Very good | Good | Good | Good |

| | Press life | Deinking ability after suspended printing | On-press developability | Scratch resistance | Resistance to dotted scumming | Resistance to white spot formation |
|---|---|---|---|---|---|---|
| CE B-1 | Poor | Very good | Very good | Good | Good | Good |
| CE B-2 | Poor | Very good | Very good | Good | Good | Good |
| CE B-3 | Excellent | Poor | Poor | Good | Good | Good |
| CE B-4 | Excellent | Poor | Poor | Good | Good | Good |
| CE B-5 | Excellent | Poor | Poor | Good | Good | Good |
| CE B-6 | Excellent | Poor | Poor | Good | Good | Good |
| CE B-7 | Poor | Very good | Very good | Good | Good | Good |
| CE B-8 | Excellent | Poor | Poor | Good | Good | Good |
| CE B-9 | Excellent | Poor | Poor | Good | Good | Good |
| CE B-10 | Excellent | Very good | Very good | Poor | Good | Good |
| CE B-11 | Poor | Very good | Very good | Good | Poor | Poor |
| CE B-12 | Excellent | Poor | Poor | Poor | Poor | Poor |
| CE B-13 | Excellent | Poor | Poor | Poor | Excellent | Excellent |
| CE B-14 | Excellent | Poor | Poor | Poor | Excellent | Excellent |
| CE B-15 | Excellent | Poor | Poor | Poor | Very poor | Very poor |
| CE B-16 | Excellent | Poor | Poor | Poor | Excellent | Excellent |
| CE B-17 | Very poor | Very good | Very good | Good | Poor | Poor |
| CE B-18 | Extremely poor | Very good | Very good | Good | Poor | Poor |
| CE B-19 | Extremely poor | Very good | Very good | Good | Poor | Poor |
| CE B-20 | Very poor | Very good | Very good | Good | Poor | Poor |
| CE B-21 | Poor | Very good | Very good | Good | Poor | Poor |

TABLE 6-continued

| | | | | | | |
|---|---|---|---|---|---|---|
| CE B-22 | Excellent | Very good | Very good | Good | Poor | Poor |
| CE B-23 | Excellent | Very good | Very good | Good | Poor | Poor |
| CE B-24 | Excellent | Very good | Very good | Good | Very poor | Very poor |

Table 6 revealed that in the lithographic printing plates and presensitized plates obtained using the lithographic printing plate supports in Examples B-1 to 32 each having an anodized aluminum film in which micropores having specified average diameters and depths were formed, the press life, deinking ability after suspended printing, resistance to dotted scumming, resistance to white spot formation, on-press developability and scratch resistance were excellent. The large-diameter portions and the small-diameter portions making up the micropores obtained in Examples B-1 to 28 and B-31 to 32 had a substantially straight tubular shape. The large-diameter portions making up the micropores obtained in Examples B-29 and 30 had a substantially straight tubular shape, and the small-diameter portions each had a substantially straight tubular main pore portion and a substantially conical enlarged-diameter portion as shown in FIG. 9B. In Examples B-29 and 30, the maximum diameter of the enlarged-diameter portions was larger by about 1 nm to about 5 nm than that of the main pore portions. In addition, in Examples B-29 and 30, the main pore portions accounted for about 90% of the total depth of the small-diameter portions.

It was confirmed that more beneficial effects are obtained particularly in Examples B-3 and 4 in which the average diameter of the large-diameter portions is within a predetermined range. It was also confirmed that more beneficial effects are obtained particularly in Examples B-7 and 8 in which the depth of the large-diameter portions is within a predetermined range, Examples B-11 and 12 in which the ratio of the depth to the average diameter of the large-diameter portions is within a predetermined range, and Examples B-15 and 16 in which the micropore density is within a predetermined range.

On the other hand, the results obtained in Comparative Examples B-1 to 24 which do not meet the average diameters and the depths according to the second aspect of the invention were inferior to those in Examples B-1 to 32.

Particularly in Comparative Examples B-12 to 16 in which Examples B-1 to 5 specifically disclosed in JP 11-291657 A were performed, the resistance to dotted scumming, the resistance to white spot formation, the deinking ability after suspended printing, and on-press developability were poor.

What is claimed is:

1. A lithographic printing plate support comprising: an aluminum plate; and an anodized film formed at a surface of the aluminum plate and having micropores which extend in a depth direction of the anodized film from a surface of the anodized film opposite from the aluminum plate, wherein each of the micropores has a large-diameter portion which extends to a depth A of 5 to 60 nm from the surface of the anodized film and a dendritic small-diameter portion which communicates with a bottom of the large-diameter portion, and branches off and extends to a depth of 900 to 2,000 nm from a communication position between the small-diameter portion and the large-diameter portion, wherein an aperture average diameter of the large-diameter portion at the surface of the anodized film is from 10 to 100 nm and a ratio of the depth A of the large-sized portion to the aperture average diameter of the large-diameter portion (depth A/aperture average diameter) is from 0.1 to 4.0, wherein a communication position average diameter of the small-diameter portion at the communication position is more than 0 but less than 20 nm, and wherein a ratio of the communication position average diameter of the small-diameter portion to the aperture average diameter of the large-diameter portion (communication position average diameter/aperture average diameter) is up to 0.85.

2. The lithographic printing plate support according to claim 1, wherein a thickness of the anodized film between a bottom of the small-diameter portion and the surface of the aluminum plate is at least 20 nm.

3. The lithographic printing plate support according to claim 1, wherein a small-diameter portion density A in a cross section of the anodized film at the communication position is 100 to 3,000 pcs/$\mu m^2$.

4. The lithographic printing plate support according to claim 1, wherein a small-diameter portion density B in a cross section of the anodized film at a central position in the depth direction of the small-diameter portion is larger than the small-diameter portion density A in the cross section of the anodized film at the communication position, and the density B is 300 to 9,000 pcs/$\mu m^2$.

5. A presensitized plate comprising: the lithographic printing plate support according to claim 1; and an image recording layer formed thereon.

6. A lithographic printing plate support comprising: an aluminum plate; and an anodized film formed at a surface of the aluminum plate and having micropores which extend in a depth direction of the anodized film from a surface of the anodized film opposite from the aluminum plate, wherein each of the micropores has a large-diameter portion which extends to a depth A of 5 to 60 nm from the surface of the anodized film and a small-diameter portion which communicates with a bottom of the large-diameter portion and extends to a depth of 900 to 2,000 nm from a communication position between the small-diameter portion and the large-diameter portion, wherein an aperture average diameter of the large-diameter portion at the surface of the anodized film is from 10 to 60 nm and a ratio of the depth A to the aperture average diameter (depth A/aperture average diameter) is from 0.1 to 4.0, wherein a communication position average diameter of the small-diameter portion at the communication position is more than 0 but less than 20 nm, wherein a ratio of the communication position average diameter of the small-diameter portion to the aperture average diameter of the large-diameter portion (communication position average diameter/aperture average diameter) is up to 0.85, and wherein a thickness of the anodized film between a bottom of the small-diameter portion and the surface of the aluminum plate is at least 25 nm.

7. The lithographic printing plate support according to claim 6, wherein the aperture average diameter of the large-diameter portion is from 10 to 50 nm.

8. The lithographic printing plate support according to claim 6, wherein the depth A is from 10 to 50 nm.

9. The lithographic printing plate support according to claim 6, wherein the ratio of the depth A to the aperture average diameter is at least 0.30 but less than 3.0.

10. The lithographic printing plate support according to claim 6, wherein the micropores are formed at a density of 100 to 3,000 pcs/$\mu m^2$.

11. A presensitized plate comprising: the lithographic printing plate support according to claim 6; and an image recording layer formed thereon.

12. The lithographic printing plate support according to claim 2, wherein a small-diameter portion density A in a cross section of the anodized film at the communication position is 100 to 3,000 pcs/$\mu m^2$.

13. The lithographic printing plate support according to claim 2, wherein a small-diameter portion density B in a cross section of the anodized film at a central position in the depth direction of the small-diameter portion is larger than the small-diameter portion density A in the cross section of the anodized film at the communication position, and the density B is 300 to 9,000 pcs/$\mu m^2$.

14. The lithographic printing plate support according to claim 3, wherein a small-diameter portion density B in a cross section of the anodized film at a central position in the depth direction of the small-diameter portion is larger than the small-diameter portion density A in the cross section of the anodized film at the communication position, and the density B is 300 to 9,000 pcs/$\mu m^2$.

15. The lithographic printing plate support according to claim 7, wherein the depth A is from 10 to 50 nm.

16. The lithographic printing plate support according to claim 7, wherein the ratio of the depth A to the aperture average diameter is at least 0.30 but less than 3.0.

17. The lithographic printing plate support according to claim 8, wherein the ratio of the depth A to the aperture average diameter is at least 0.30 but less than 3.0.

18. The lithographic printing plate support according to claim 7, wherein the micropores are formed at a density of 100 to 3,000 pcs/$\mu m^2$.

19. The lithographic printing plate support according to claim 8, wherein the micropores are formed at a density of 100 to 3,000 pcs/$\mu m^2$.

20. The lithographic printing plate support according to claim 9, wherein the micropores are formed at a density of 100 to 3,000 pcs/$\mu m^2$.

* * * * *